US010306389B2

(12) United States Patent
Fan et al.

(10) Patent No.: US 10,306,389 B2
(45) Date of Patent: May 28, 2019

(54) HEAD WEARABLE ACOUSTIC SYSTEM WITH NOISE CANCELING MICROPHONE GEOMETRY APPARATUSES AND METHODS

(71) Applicant: KOPIN CORPORATION, Westborough, MA (US)

(72) Inventors: Dashen Fan, Bellevue, WA (US); Xi Chen, San Jose, CA (US); Hua Bao, Santa Clara, CA (US); Eric Frederic Davis, San Francisco, CA (US)

(73) Assignee: KOPIN CORPORATION, Westborough, MA (US)

( * ) Notice: Subject to any disclaimer, the term of this patent is extended or adjusted under 35 U.S.C. 154(b) by 0 days.

(21) Appl. No.: 14/886,077

(22) Filed: Oct. 18, 2015

(65) Prior Publication Data

US 2016/0112817 A1 Apr. 21, 2016

Related U.S. Application Data

(63) Continuation-in-part of application No. 14/207,163, filed on Mar. 12, 2014, now Pat. No. 9,633,670, and
(Continued)

(51) Int. Cl.
*H04R 29/00* (2006.01)
*H04R 1/32* (2006.01)
(Continued)

(52) U.S. Cl.
CPC ..... *H04R 29/004* (2013.01); *G10L 19/008* (2013.01); *G10L 21/0208* (2013.01);
(Continued)

(58) Field of Classification Search
CPC ..... H04R 29/004; H04R 1/028; H04R 1/326; H04R 3/005; H04R 2203/12;
(Continued)

(56) References Cited

U.S. PATENT DOCUMENTS 3,378,649 A 4/1968 Mawby
3,789,163 A 1/1974 Dunlavy
(Continued)

FOREIGN PATENT DOCUMENTS

CN 202 102 188 1/2012
EP 2 323 422 A1 5/2011
(Continued)

OTHER PUBLICATIONS

Internation Search Report & Written Opinion for PCT/US2014/026332, Entitled "Dual Stage Noise Reduction Architecture for Desired Signal Extraction," dated Jul. 24, 2014.
(Continued)

*Primary Examiner* — Mark Fischer
(74) *Attorney, Agent, or Firm* — Peloquin, PLLC; Mark S. Peloquin, Esq.

(57) ABSTRACT

Systems and methods are described to extract desired audio from an apparatus that is worn on a user's head. The apparatus includes a head wearable device. A first microphone is positioned on the head wearable device to receive a voice signal from the user A first signal from the first microphone is input as a main channel to a noise cancellation unit. A second microphone is coupled to the head wearable device. A first acoustic distance between the first microphone and the user's mouth is less than a second acoustic distance between the second microphone and the user's mouth when the head wearable device is on the user's head. A second signal from the second microphone is input as a reference channel to the noise cancellation unit. A first signal-to-noise ratio of the first signal is larger than a second signal-to-noise ratio of the second signal.

42 Claims, 46 Drawing Sheets

Related U.S. Application Data a continuation-in-part of application No. 14/180,994, filed on Feb. 14, 2014, now Pat. No. 9,753,311.

(60) Provisional application No. 61/941,088, filed on Feb. 18, 2014, provisional application No. 61/912,844, filed on Dec. 6, 2013, provisional application No. 61/839,227, filed on Jun. 25, 2013, provisional application No. 61/839,211, filed on Jun. 25, 2013, provisional application No. 61/780,108, filed on Mar. 13, 2013.

(51) Int. Cl.

| | |
|---|---|
| ***G10L 19/008*** | (2013.01) |
| ***H04R 3/00*** | (2006.01) |
| ***H04R 1/02*** | (2006.01) |
| ***G10L 21/0208*** | (2013.01) |
| *G10L 25/78* | (2013.01) |
| *G10L 21/0216* | (2013.01) |

(52) U.S. Cl.

CPC ..... *H04R 1/028* (2013.01); *H04R 1/326* (2013.01); *H04R 3/005* (2013.01); *G10L 25/78* (2013.01); *G10L 2021/02165* (2013.01); *G10L 2021/02166* (2013.01); *H04R 2203/12* (2013.01); *H04R 2410/01* (2013.01)

(58) Field of Classification Search

CPC ..... H04R 2410/01; G10L 19/008; G10L 21/0208; G10L 25/78; G10L 2021/02165; G10L 2021/02166

See application file for complete search history.

(56) References Cited

U.S. PATENT DOCUMENTS 3,919,481 A 11/1975 Kalfaian
3,946,168 A 3/1976 Preves
4,773,095 A 9/1988 Zwicker et al.
4,904,078 A 2/1990 Gorike
4,966,252 A 10/1990 Drever
5,825,898 A * 10/1998 Marash ..... G01S 7/2813 367/119
6,091,546 A 7/2000 Spitzer
6,266,422 B1 7/2001 Ikeda
6,349,001 B1 2/2002 Spitzer
6,678,657 B1 1/2004 Bruckner
6,707,910 B1 3/2004 Valve
7,174,022 B1 2/2007 Zhang et al.
7,359,504 B1 4/2008 Reuss et al.
7,929,714 B2 4/2011 Bazarjani et al.
8,184,983 B1 5/2012 Ho et al.
8,543,061 B2 9/2013 Suhami
8,744,113 B1 6/2014 Rickards
8,958,572 B1 2/2015 Solbach
9,280,982 B1 3/2016 Kushner
2002/0106091 A1 8/2002 Furst
2003/0040908 A1 2/2003 Yang
2003/0147538 A1 8/2003 Elko
2003/0179888 A1 9/2003 Burnett
2004/0111258 A1 6/2004 Zangi
2005/0063552 A1 3/2005 Shuttleworth
2005/0069156 A1 3/2005 Haapapuro et al.
2005/0096899 A1 5/2005 Padhi
2005/0248717 A1 11/2005 Howell et al.
2006/0285714 A1 12/2006 Akino
2007/0160254 A1 7/2007 Ritter et al.
2008/0137874 A1 6/2008 Christoph
2008/0260189 A1 10/2008 Schobben
2008/0267427 A1 10/2008 Johnston
2008/0317259 A1 12/2008 Zhang et al.
2008/0317260 A1 12/2008 Short
2009/0089053 A1 4/2009 Wang
2009/0089054 A1 4/2009 Wang
2009/0112579 A1 4/2009 Li
2009/0129582 A1 5/2009 Chandran
2009/0154726 A1 6/2009 Taenzer
2009/0190774 A1 7/2009 Wang
2009/0299739 A1 12/2009 Chan
2010/0100386 A1 4/2010 Yu
2010/0198590 A1 8/2010 Tackin
2010/0208928 A1 8/2010 Chene et al.
2010/0241426 A1* 9/2010 Zhang ..... G10L 21/0208 704/226
2010/0278352 A1 11/2010 Petit
2010/0280824 A1 11/2010 Petit
2011/0038489 A1 2/2011 Visser
2011/0071825 A1 3/2011 Emori
2011/0081026 A1 4/2011 Ramakrishnan
2011/0091057 A1 4/2011 Derkx
2011/0099010 A1 4/2011 Zhang
2011/0106533 A1 5/2011 Yu
2011/0243349 A1 10/2011 Zavarehei
2011/0293103 A1 12/2011 Park
2012/0010881 A1 1/2012 Avendano
2012/0051548 A1* 3/2012 Visser ..... G10L 21/0208 381/56
2012/0075168 A1 3/2012 Osterhout et al.
2012/0084084 A1 4/2012 Zhu
2012/0123773 A1* 5/2012 Zeng ..... G10L 21/0208 704/226
2012/0123775 A1 5/2012 Murgia
2012/0162259 A1 6/2012 Sakai
2012/0209601 A1 8/2012 Jing
2012/0215519 A1 8/2012 Park
2012/0239394 A1 9/2012 Matsumoto
2012/0259631 A1 10/2012 Lloyd
2012/0282976 A1 11/2012 Suhami
2013/0030803 A1 1/2013 Liao
2013/0142343 A1 6/2013 Matsui
2013/0034243 A1 7/2013 Yermeche
2013/0314280 A1 11/2013 Maltsev et al.
2013/0332157 A1 12/2013 Iyengar
2014/0003622 A1 1/2014 Ikizyan
2014/0006019 A1 1/2014 Paajanen
2014/0010373 A1 1/2014 Gran
2014/0056435 A1 2/2014 Kjems
2014/0081631 A1 3/2014 Zhu
2014/0236590 A1 8/2014 Hu
2014/0268016 A1 9/2014 Chow et al.
2014/0270244 A1 9/2014 Fan
2014/0270316 A1 9/2014 Fan
2014/0278391 A1 9/2014 Braho
2014/0337021 A1 11/2014 Kim
2014/0358526 A1 12/2014 Abdelal
2015/0012269 A1 1/2015 Nakadai
2015/0032451 A1 1/2015 Gunn
2015/0106088 A1 4/2015 Jarvinen
2015/0172807 A1 6/2015 Olsson
2015/0215700 A1 7/2015 Sun
2015/0230023 A1 8/2015 Fujieda
2015/0262590 A1 9/2015 Joder
2015/0262591 A1 9/2015 Hill
2015/0269954 A1 9/2015 Ryan
2015/0287406 A1 10/2015 Kristjansson
2015/0294674 A1 10/2015 Takahashi
2015/0318902 A1 11/2015 Sugiyama
2016/0005422 A1 1/2016 Zad Issa
2016/0029121 A1 1/2016 Nesta

FOREIGN PATENT DOCUMENTS

EP 2 469 323 A1 6/2012
JP 58013008 A 1/1983
JP 06-338827 A 12/1994
JP 06338827 A 12/1994
JP 9252340 9/1997
JP 10-301600 A 11/1998
JP 10301600 A 11/1998
JP 2003-271191 A 9/2003
JP 2011015018 A 1/2011
KR 10-0857822 B1 9/2008

(56) References Cited

FOREIGN PATENT DOCUMENTS

| | | | |
|---|---|---|---|
| KR | 10-0936772 | B1 | 1/2010 |
| WO | WO 2000/02419 | | 1/2000 |
| WO | WO 2009/076016 | | 6/2009 |
| WO | WO 2011/087770 | A2 | 7/2011 |
| WO | WO 2012/040386 | | 3/2012 |
| WO | WO 2012/097014 | A1 | 7/2012 |
| WO | WO 2014/158426 | A1 | 10/2014 |
| WO | WO 2014/163794 | A2 | 10/2014 |
| WO | WO 2014/163796 | A1 | 10/2014 |
| WO | WO 2014/163797 | A1 | 10/2014 |

OTHER PUBLICATIONS

Zhang, Xianxian, Noise Estimation Based on an Adaptive Smoothing Factor for Improving Speech Quality in a Dual-Microphone Noise Suppression System, 2011, IEEE, 5 pgs, US.

Internation Search Report & Written Opinion, PCT/US2014/016547, Entitled, "Sound Induction Ear Speaker for Eye Glasses," dated Apr. 29, 2015 (15 pages).

Internation Search Report & Written Opinion, PCT/US2014/010557, Entitled, "Sound Induction Ear Speaker for Eye Glasses," dated Sep. 24, 2014 (15 pages).

Internation Search Report & Written Opinion, PCT/US2014/016558, Entitled, "Eye Glasses with Microphone Array," dated Jun. 12, 2014 (12 pages).

Internation Search Report & Written Opinion, PCT/US2014/016570, Entitled, "Noise Cancelling Microphone Apparatus," dated Jun. 25, 2014 (19 pages).

International Search Report & Written Opinion for PCT/US2014/026332, Entitled "Apparatuses and Methods for Acoustic Channel Auto-Balancing During Multi- . . . ," dated Jul. 30, 2014.

Internation Search Report & Written Opinion for PCT/US2014/026605, Entitled "Apparatuses and Methods for Multi-Channel Signal Compression During Desired . . . ," dated Jul. 24, 2014.

* cited by examiner

FIGURE 3B

320

| | 322 | 324 | 326 | 328 |
|---|---|---|---|---|
| | | | PLOTTED VALUES: X, Y | |
| | MICROPHONE PAIR USED FOR SNR MEASUREMENTS | ~ΔL | X | Y SNR DIFFERENCE dB |
| 330 | 2, 1 | $\Delta L_2 \approx d_2 - d_1$ | 1 | 5.55 |
| 332 | 3, 1 | $\Delta L_3 \approx d_3 - d_1$ | 2 | 6.33 |
| 334 | 6, 1 | $\Delta L_6 \approx d_6 - d_1$ | 3 | 7.68 |
| 336 | 4, 1 | $\Delta L_4 \approx d_4 - d_1$ | 4 | 9.25 |
| 338 | 5, 1 | $\Delta L_5 \approx d_5 - d_1$ | 5 | 9.79 |
| 340 | 7, 1 | $\Delta L_7 \approx d_7 - d_1$ | 6 | 10.4 |
| 342 | 8, 1 | $\Delta L_8 \approx d_8 - d_1$ | 7 | 10.48 |

344 $\Delta L_2 < \Delta L_3 < \Delta L_6 < \Delta L_4 < \Delta L_5 < \Delta L_7 < \Delta L_8$

FIGURE 4B

420

| | 422 | 424 | 426 | 428 |
|---|---|---|---|---|
| | | | PLOTTED VALUES: X, Y | |
| | MICROPHONE PAIR USED FOR SNR MEASUREMENTS (primary, reference) | ~ΔL | X | Y SNR DIFFERENCE dB |
| 430 | 2, 6 | $\Delta L_6 \approx d_6 - d_2$ | 1 | 1.2 |
| 432 | 2, 3 | $\Delta L_3 \approx d_3 - d_2$ | 2 | 1.66 |
| 434 | 2, 4 | $\Delta L_4 \approx d_4 - d_2$ | 3 | 3.99 |
| 436 | 2, 5 | $\Delta L_5 \approx d_5 - d_2$ | 4 | 4.09 |
| 438 | 2, 7 | $\Delta L_7 \approx d_7 - d_2$ | 5 | 5.57 |
| 440 | 2, 8 | $\Delta L_8 \approx d_8 - d_2$ | 6 | 5.2 |

442 $\Delta L_6 < \Delta L_3 < \Delta L_4 < \Delta L_5 < \Delta L_7 < \Delta L_8$

FIGURE 5B

520

| | 522 | 524 | 526 | 528 |
|---|---|---|---|---|
| | | | PLOTTED VALUES: X, Y | |
| | MICROPHONE PAIR USED FOR SNR MEASUREMENTS (primary, reference) | ~ΔL | X | Y SNR DIFFERENCE dB |
| 530 | 3, 6 | $\Delta L_6 \approx d_6 - d_3$ | 1 | 0 |
| 532 | 3, 4 | $\Delta L_4 \approx d_4 - d_3$ | 2 | 2.78 |
| 534 | 3, 5 | $\Delta L_5 \approx d_5 - d_3$ | 3 | 2.91 |
| 536 | 3, 7 | $\Delta L_7 \approx d_7 - d_3$ | 4 | 5.16 |
| 538 | 3, 8 | $\Delta L_8 \approx d_8 - d_3$ | 5 | 4.03 |

540 $\Delta L_6 < \Delta L_4 < \Delta L_5 < \Delta L_7 < \Delta L_8$

FIGURE 28E

2893

2894

2896

| 2895a | 2895b | 2895c | 2895d | 2895e |
|---|---|---|---|---|
| X | Y=X | $Y=Log_{10}(X)$ | Y=ln(X) | $Y=Log_2(X)$ |
| 0.01 | 0.01 | -2 | -4.60 | -6.64 |
| 0.10 | 0.10 | -1 | -2.30 | -3.32 |
| 1.00 | 1.00 | 0 | 0 | 0 |
| 10.00 | 10.00 | 1 | 2.30 | 3.32 |
| 100.0 | 100.0 | 2 | 4.60 | 6.64 |
| 1000.0 | 1000.0 | 3 | 6.90 | 9.96 |

HEAD WEARABLE ACOUSTIC SYSTEM WITH NOISE CANCELING MICROPHONE GEOMETRY APPARATUSES AND METHODS

RELATED APPLICATIONS

This patent application is a continuation-in-part of United States Non-Provisional Patent Application titled "Dual Stage Noise Reduction Architecture For Desired Signal Extraction," filed on Mar. 12, 2014, Ser. No. 14/207,163 which claims priority from United States Provisional Patent Application titled "Noise Canceling Microphone Apparatus," filed on Mar. 13, 2013, Ser. No. 61/780,108 and from United States Provisional Patent Application titled "Systems and Methods for Processing Acoustic Signals," filed on Feb. 18, 2014, Ser. No. 61/941,088.

This patent application is also a continuation-in-part of United States Non-Provisional Patent Application titled "Eye Glasses With Microphone Array," filed on Feb. 14, 2014, Ser. No. 14/180,994 which claims priority from U.S. Provisional Patent Application Ser. No. 61/780,108 filed on Mar. 13, 2013, and from U.S. Provisional Patent Application Ser. No. 61/839,211 filed on Jun. 25, 2013, and from U.S. Provisional Patent Application Ser. No. 61/839,227 filed on Jun. 25, 2013, and from U.S. Provisional Patent Application Ser. No. 61/912,844 filed on Dec. 6, 2013.

U.S. Provisional Patent Application Ser. No. 61/780,108 is hereby incorporated by reference. U.S. Provisional Patent Application Ser. No. 61/941,088 is hereby incorporated by reference. U.S. Non-Provisional patent application Ser. No. 14/207,163 is hereby incorporated by reference. U.S. Non-Provisional patent application Ser. No. 14/180,994 is hereby incorporated by reference. U.S. Provisional Patent Application Ser. No. 61/839,211 is hereby incorporated by reference. U.S. Provisional Patent Application Ser. No. 61/839,227 is hereby incorporated by reference. U.S. Provisional Patent Application Ser. No. 61/912,844 is hereby incorporated by reference.

BACKGROUND OF THE INVENTION

1. Field of Invention

The invention relates generally to wearable devices which detect and process acoustic signal data and more specifically to reducing noise in head wearable acoustic systems.

2. Art Background

Acoustic systems employ acoustic sensors such as microphones to receive audio signals. Often, these systems are used in real world environments which present desired audio and undesired audio (also referred to as noise) to a receiving microphone simultaneously. Such receiving microphones are part of a variety of systems such as a mobile phone, a handheld microphone, a hearing aid, etc. These systems often perform speech recognition processing on the received acoustic signals. Simultaneous reception of desired audio and undesired audio have a negative impact on the quality of the desired audio. Degradation of the quality of the desired audio can result in desired audio which is output to a user and is hard for the user to understand. Degraded desired audio used by an algorithm such as in speech recognition (SR) or Automatic Speech Recognition (ASR) can result in an increased error rate which can render the reconstructed speech hard to understand. Either of which presents a problem.

Handheld systems require a user's fingers to grip and/or operate the device in which the handheld system is implemented. Such as a mobile phone for example. Occupying a user's fingers can prevent the user from performing mission critical functions. This can present a problem.

Undesired audio (noise) can originate from a variety of sources, which are not the source of the desired audio. Thus, the sources of undesired audio are statistically uncorrelated with the desired audio. The sources can be of a non-stationary origin or from a stationary origin. Stationary applies to time and space where amplitude, frequency, and direction of an acoustic signal do not vary appreciably. For, example, in an automobile environment engine noise at constant speed is stationary as is road noise or wind noise, etc. In the case of a non-stationary signal, noise amplitude, frequency distribution, and direction of the acoustic signal vary as a function of time and or space. Non-stationary noise originates for example, from a car stereo, noise from a transient such as a bump, door opening or closing, conversation in the background such as chit chat in a back seat of a vehicle, etc. Stationary and non-stationary sources of undesired audio exist in office environments, concert halls, football stadiums, airplane cabins, everywhere that a user will go with an acoustic system (e.g., mobile phone, tablet computer etc. equipped with a microphone, a headset, an ear bud microphone, etc.) At times the environment the acoustic system is used in is reverberant, thereby causing the noise to reverberate within the environment, with multiple paths of undesired audio arriving at the microphone location. Either source of noise, i.e., non-stationary or stationary undesired audio, increases the error rate of speech recognition algorithms such as SR or ASR or can simply make it difficult for a system to output desired audio to a user which can be understood. All of this can present a problem.

Various noise cancellation approaches have been employed to reduce noise from stationary and non-stationary sources. Existing noise cancellation approaches work better in environments where the magnitude of the noise is less than the magnitude of the desired audio, e.g., in relatively low noise environments. Spectral subtraction is used to reduce noise in speech recognition algorithms and in various acoustic systems such as in hearing aids. Systems employing Spectral Subtraction do not produce acceptable error rates when used in Automatic Speech Recognition (ASR) applications when a magnitude of the undesired audio becomes large. This can present a problem.

In addition, existing algorithms, such as Spectral Subtraction, etc., employ non-linear treatment of an acoustic signal. Non-linear treatment of an acoustic signal results in an output that is not proportionally related to the input. Speech Recognition (SR) algorithms are developed using voice signals recorded in a quiet environment without noise. Thus, speech recognition algorithms (developed in a quiet environment without noise) produce a high error rate when non-linear distortion is introduced in the speech process through non-linear signal processing. Non-linear treatment of acoustic signals can result in non-linear distortion of the desired audio which disrupts feature extraction which is necessary for speech recognition, this results in a high error rate. All of which can present a problem.

Various methods have been used to try to suppress or remove undesired audio from acoustic systems, such as in Speech Recognition (SR) or Automatic Speech Recognition (ASR) applications for example. One approach is known as a Voice Activity Detector (VAD). A VAD attempts to detect when desired speech is present and when undesired speech is present. Thereby, only accepting desired speech and treating as noise by not transmitting the undesired speech. Traditional voice activity detection only works well for a single sound source or a stationary noise (undesired audio)

whose magnitude is small relative to the magnitude of the desired audio. Therefore, traditional voice activity detection renders a VAD a poor performer in a noisy environment. Additionally, using a VAD to remove undesired audio does not work well when the desired audio and the undesired audio are arriving simultaneously at a receive microphone. This can present a problem.

Acoustic systems used in noisy environments with a single microphone present a problem in that desired audio and undesired audio are received simultaneously on a single channel. Undesired audio can make the desired audio unintelligible to either a human user or to an algorithm designed to use received speech such as a Speech Recognition (SR) or an Automatic Speech Recognition (ASR) algorithm. This can present a problem. Multiple channels have been employed to address the problem of the simultaneous reception of desired and undesired audio. Thus, on one channel, desired audio and undesired audio are received and on the other channel an acoustic signal is received which also contains undesired audio and desired audio. Over time the sensitivity of the individual channels can drift which results in the undesired audio becoming unbalanced between the channels. Drifting channel sensitivities can lead to inaccurate removal of undesired audio from desired audio. Nonlinear distortion of the original desired audio signal can result from processing acoustic signals obtained from channels whose sensitivities drift over time. This can present a problem.

BRIEF DESCRIPTION OF THE DRAWINGS

The invention may best be understood by referring to the following description and accompanying drawings that are used to illustrate embodiments of the invention. The invention is illustrated by way of example in the embodiments and is not limited in the figures of the accompanying drawings, in which like references indicate similar elements.

FIG. 3B illustrates signal-to-noise ratio difference measurements for main microphone as located in FIG. 3A, according to embodiments of the invention.

FIG. 4B illustrates signal-to-noise ratio difference measurements for main microphone as located in FIG. 4A, according to embodiments of the invention.

FIG. 5B illustrates signal-to-noise ratio difference measurements for main microphone as located in FIG. 5A, according to embodiments of the invention.

FIG. 28E illustrates different functions to provide compression according to embodiments of the invention.

DETAILED DESCRIPTION

In the following detailed description of embodiments of the invention, reference is made to the accompanying drawings in which like references indicate similar elements, and in which is shown by way of illustration, specific embodiments in which the invention may be practiced. These embodiments are described in sufficient detail to enable those of skill in the art to practice the invention. In other instances, well-known circuits, structures, and techniques have not been shown in detail in order not to obscure the understanding of this description. The following detailed description is, therefore, not to be taken in a limiting sense, and the scope of the invention is defined only by the appended claims.

Apparatuses and methods are described for detecting and processing acoustic signals containing both desired audio and undesired audio within a head wearable device. In one or more embodiments, noise cancellation architectures combine multi-channel noise cancellation and single channel noise cancellation to extract desired audio from undesired audio. In one or more embodiments, multi-channel acoustic signal compression is used for desired voice activity detection. In one or more embodiments, acoustic channels are auto-balanced.

Figure 1:
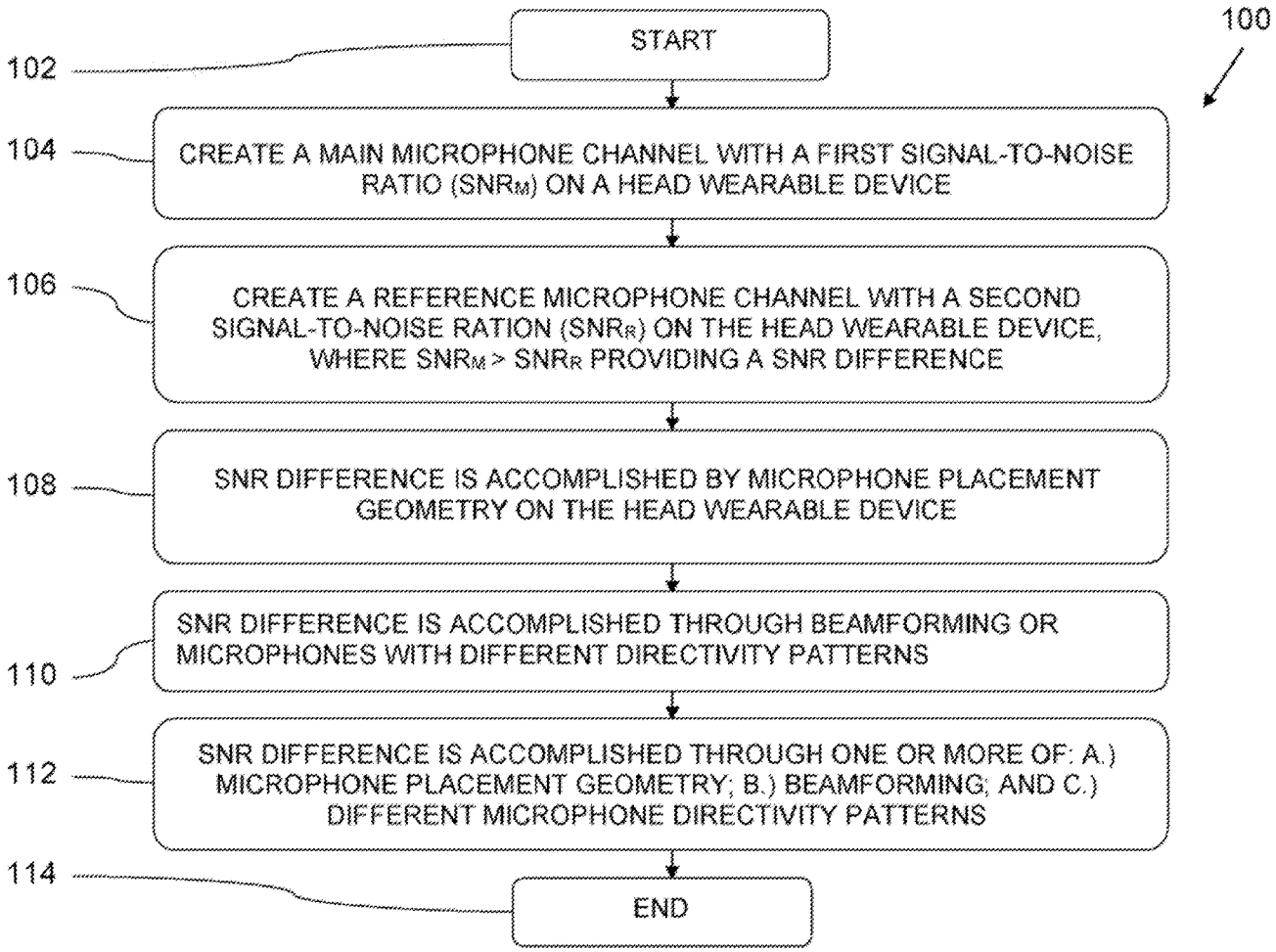
FIG. 1 illustrates a general process for microphone configuration on a head wearable device according to embodiments of the invention.

FIG. 1 illustrates a general process at 100 for microphone configuration on a head wearable device according to embodiments of the invention. With reference to FIG. 1, a process starts at a block 102. At a block 104, a "main" or "primary" microphone channel is created on a head wearable device using one or more microphones. The main microphone(s) is positioned to optimize reception of desired audio thereby enhancing a first signal-to-noise ratio associated with the main microphone, indicated as $SNR_M$. At a block 106, a reference microphone channel is created on the head wearable device using one or more microphones. The reference microphone(s) is positioned on the head wearable device to provide a lower signal-to-noise ratio with respect to detection of desired audio from the user, thereby resulting in a second signal-to-noise ratio indicated as $SNR_R$. Thus, at a block 108 a signal-to-noise ratio difference is accomplished by placement geometry of the microphones on the head wearable device, resulting in the first signal-to-noise ratio $SNR_M$ being greater than the second signal-to-noise ratio $SNR_R$.

At a block 110 a signal-to-noise ratio difference is accomplished through beamforming by creating different response patterns (directivity patterns) for the main microphone channel and the reference microphone channel(s). Utilizing different directivity patterns to create a signal-to-noise ratio difference is described more fully below in conjunction with the figures that follow.

In various embodiments, at a block 112 a signal-to-noise ratio difference is accomplished through a combination of one or more of microphone placement geometry, beamforming, and utilizing different directivity patterns for the main and reference channels. At a block 114 the process ends.

Figure 2:
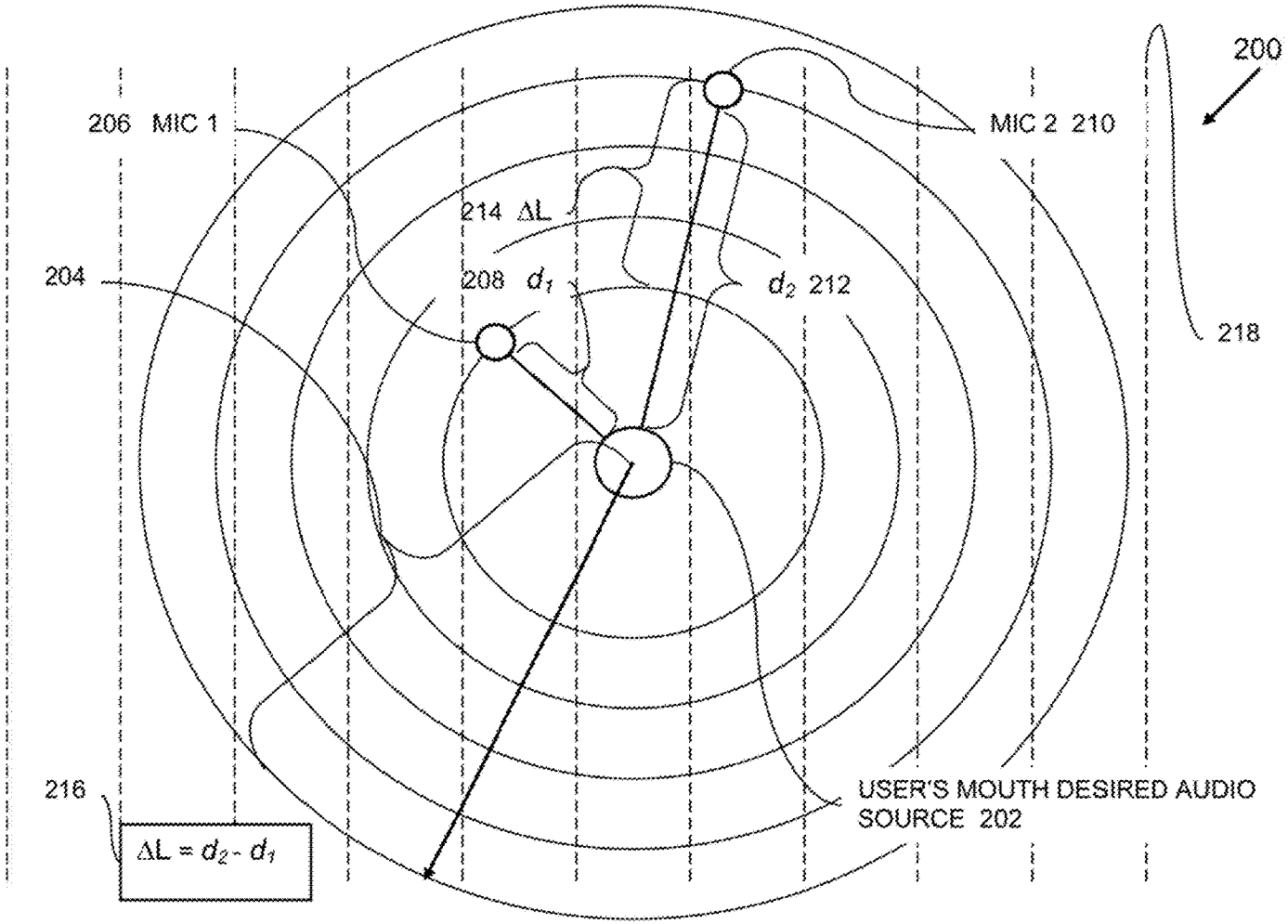
FIG. 2 illustrates microphone placement geometry according to embodiments of the invention.

FIG. 2 illustrates, generally at 200, microphone placement geometry according to embodiments of the invention. With reference to FIG. 200, a source of desired audio, a user's mouth is indicated at 202, from which desired audio 204 emanates. The source 202 provides desired audio 204 to the microphones mounted on a head wearable device. A first microphone 206 is positioned at a distance indicated by $d_1$ 208 from the source 202. A second microphone 210 is positioned at a distance indicated by $d_2$ 212 from the source 202. The system of 200 is also exposed to undesired audio as indicated by 218.

With respect to the source 202, the first microphone 206 and the second microphone 210 are at different acoustic distances from the source 202 as represented by $\Delta L$ at 214. The difference in acoustic distances $\Delta L$ 214 is given by equation 216. As used in this description of embodiments, the distances $d_1$ and $d_2$ represent the paths that the acoustic wave travels to reach the respective microphones 206 and 210. Thus, these distances might be linear or they might be curved depending on the particular location of a microphone on a head wearable device and the acoustic frequency of interest. For clarity in illustration, these paths and the corresponding distances have been indicated with straight lines however, no limitation is implied thereby.

Undesired audio 218 typically results from various sources that are located at distances that are much greater than the distances $d_1$ and $d_3$. For example, construction noise, car noise, airplane noise, etc. all originate at distances that are typically several orders of magnitude larger than $d_1$ and $d_2$. Thus, undesired audio 218 is substantially correlated at microphone locations 206 and 210 or is at least received at a fairly uniform level at each location. The difference in acoustic distance $\Delta L$ at 214 decreases an amplitude of the desired audio 204 received at the second microphone 210 relative to the first microphone 208, due to various mechanisms. One such mechanism is, for example, spherical spreading which causes the desired audio signal to fall off as a function of $I/r^2$, where r is the distance (e.g. 208 or 212) between a source (e.g., 202) and a receive location (e.g., 206 or 210). Reduction in desired audio at the second microphone location 210 decreases a signal-to-noise ratio at 210 relative to 206 since the noise amplitude is substantially the same at each location but the signal amplitude is decreased at 210 relative to the amplitude received at 206. Another related mechanism to path length is a difference in an acoustic impedance along one path versus another, thereby resulting in a curved acoustic path instead of a straight path. Collectively, the mechanisms combine to decrease an amplitude of desired audio received at a reference microphone location relative to a main microphone location. Thus, placement geometry is used to provide a signal-to-noise ratio difference between two microphone locations which is used by the noise cancellation system, which is described further below, to reduce undesired audio from the main microphone channel.

Microphone placement geometry admits various configurations for placement of a primary microphone and a reference microphone. In various embodiments, a general microphone placement methodology is described and presented in conjunction with FIG. 3A through FIG. 5C immediately below which permit microphones to be placed in various locations on a headwear device.

Figure 3A:
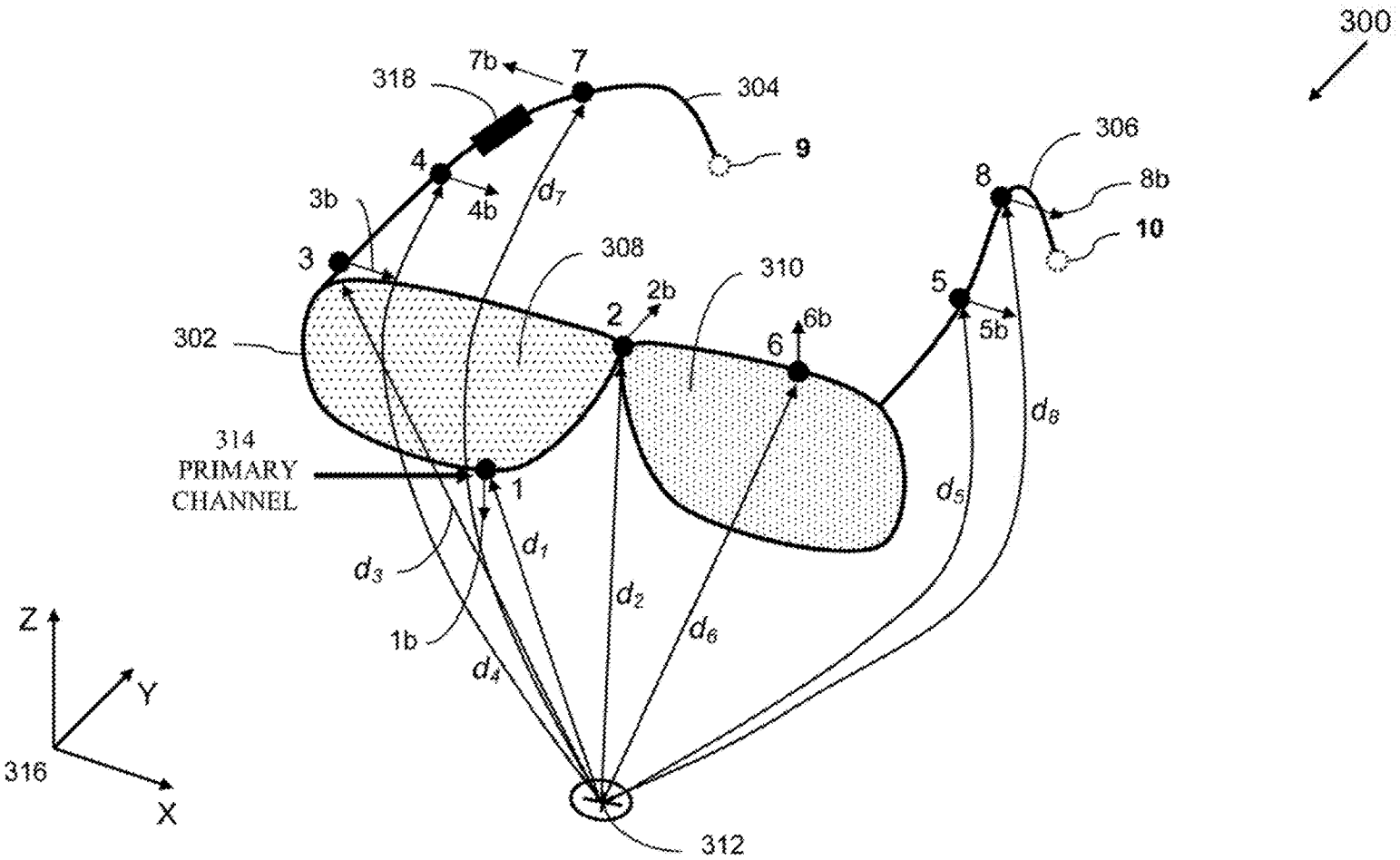
FIG. 3A illustrates generalized microphone placement with a primary microphone at a first location according to embodiments of the invention.

FIG. 3A illustrates, generally at 300, generalized microphone placement with a primary microphone at a first location according to embodiments of the invention. With reference to FIG. 3A, a head wearable device 302 is illustrated. As used in this detailed description of embodiments a head wearable device can be any of the devices that are configured to wear on a user's head such as but not limited to glasses, goggles, a helmet, a visor, a head band, etc. In the discussion presented in conjunction with FIG. 3A through FIG. 5C immediately below it is recognized that this discussion is equally applicable to any head wear device, such as those shown in FIG. 8 through FIG. 19 as well as to those head wearable devices not specifically shown in the figures herein. Thus, embodiments of the invention are applicable to head wearable devices that are as of yet unnamed or yet to be invented.

Referring back to FIG. 3A, in one embodiment, the head wearable device has a frame 302 with attached temple 304 and temple 306, a glass 308, and a glass 310. In various embodiments, the head wearable device 302 is a pair of glasses that are worn on a user's head. A number of microphones are located on the head wearable device 302, such as a microphone 1, a microphone 2, a microphone 3, a microphone 4, a microphone 5, a microphone 6, a microphone 7, a microphone 8, and optionally a microphone 9 and a microphone 10. In various embodiments, the head wearable device including frame 302/temples 304 and 306 as illustrated, can be sized to include electronics 318 for signal processing as described further below. Electronics 318 provides electrical coupling to the microphones mounted on the head wearable device 302.

The head wearable device 302 has an internal volume, defined by its structure, within which electronics 318 can be mounted. Alternatively electronics 318 can be mounted externally to the structure. In one or more embodiments, an access panel is provided to access the electronics 318. In other embodiments no access door is provided explicitly but the electronics 318 can be contained within the volume of the head wearable device 302. In such cases, the electronics 318 can be inserted prior to assembly of a head wearable device where one or more parts interlock together thereby forming a housing which captures the electronics 318 therein. In yet other embodiments, a head wearable device is molded around electronics 318 thereby encapsulating the electronics 318 within the volume of the head wearable device 302. In various non-limiting embodiments, electronics 318 include an adaptive noise cancellation unit, a single channel noise cancellation unit, a filter control, a power supply, a desired voice activity detector, a filter, etc. Other components of electronics 118 are described below in the figures that follow.

The head wearable device 302 can include a switch (not shown) which is used to power up or down the head wearable device 302. The head wearable device 302 can contain a data processing system within its volume for processing acoustic signals which are received by the microphones associated therewith. The data processing system can contain one or more of the elements of the system illustrated in FIG. 31 described further below. Thus, the illustrations of FIG. 3A through FIG. 5C do not limit embodiments of the invention.

The headwear device of FIG. 3A illustrates that microphones can be placed in any location on the device. The ten locations chosen for illustration within the figures are selected merely for illustration of the general principles of placement geometry and do not limit embodiments of the invention. Accordingly, microphones can be used in different locations other than those illustrated and different microphones can be used in the various locations. For the purpose of illustration and without any limitation, the measurements that were made in conjunction with the illustrations of FIG. 3A through FIG. 5C omni-directional microphones were used. In other embodiments, directive microphones are used. In the example configuration used for the signal-to-noise ratio measurements, each microphone was mounted within a housing and each housing had a port opening to the environment. A direction for a port associated with microphone 1 is shown by arrow b. A direction for a port associated with microphone 2 is shown by arrow 2*b*. A direction for a port associated with microphone 3 is shown by arrow 3*b*. A direction for a port associated with microphone 4 is shown by arrow 4*b*. A direction for a port associated with microphone 5 is shown by arrow 5*b*. A direction for a port associated with microphone 6 is shown by arrow 6*b*. A direction for a port associated with microphone 7 is shown by arrow 7*b*. A direction for a port associated with microphone 8 is shown by arrow 8*b*.

A user's mouth is illustrated at 312 and is analogous to the source of desired audio shown in FIG. 2 at 202. An acoustic path length (referred to herein as acoustic distance or distance) from the user's mouth 312 to each microphone is illustrated with an arrow from the user's mouth 312 to the respective microphone locations. For example, $d_1$ indicates the acoustic distance from the user's mouth 312 to microphone 1. $d_2$ indicates the acoustic distance from the user's mouth 312 to microphone 2. $d_3$ indicates the acoustic distance from the user's mouth 312 to microphone 3. $d_4$ indicates the acoustic distance from the user's mouth 312 to microphone 4. $d_5$ indicates the acoustic distance from the user's mouth 312 to microphone 5. $d_6$ indicates the acoustic distance from the user's mouth 312 to microphone 6. $d_7$ indicates the acoustic distance from the user's mouth 312 to microphone 7. $d_8$ indicates the acoustic distance from the user's mouth 312 to microphone 8. Similarly, optional microphone 9 and microphone 10 have acoustic distances as well; however they are not so labeled to preserve clarity in the figure.

In FIG. 3A, microphones 1, 2, 3, and 6 and the user's mouth 312 fall substantially in an X-Z plane (see coordinate system 316), the corresponding acoustic distances $d_1$, $d_2$, $d_3$, and $d_6$ have been indicated with substantially straight lines. The paths to microphones 4, 5, 7, and 8, i.e., $d_4$, $d_5$, $d_7$, and $d_8$ are represented as curved paths which reflect the fact that the user's head is not transparent to the acoustic field. Thus, in such cases, the acoustic path is somewhat curved. In general, the acoustic path between the source of desired audio and a microphone on the head wearable device can be linear or curved. As long as the path length is sufficiently different between a main microphone and a reference microphone the requisite signal-to-noise ratio difference will be obtained which is needed by the noise cancellation system in order to achieve an acceptable level of noise cancellation.

Figure 3C:
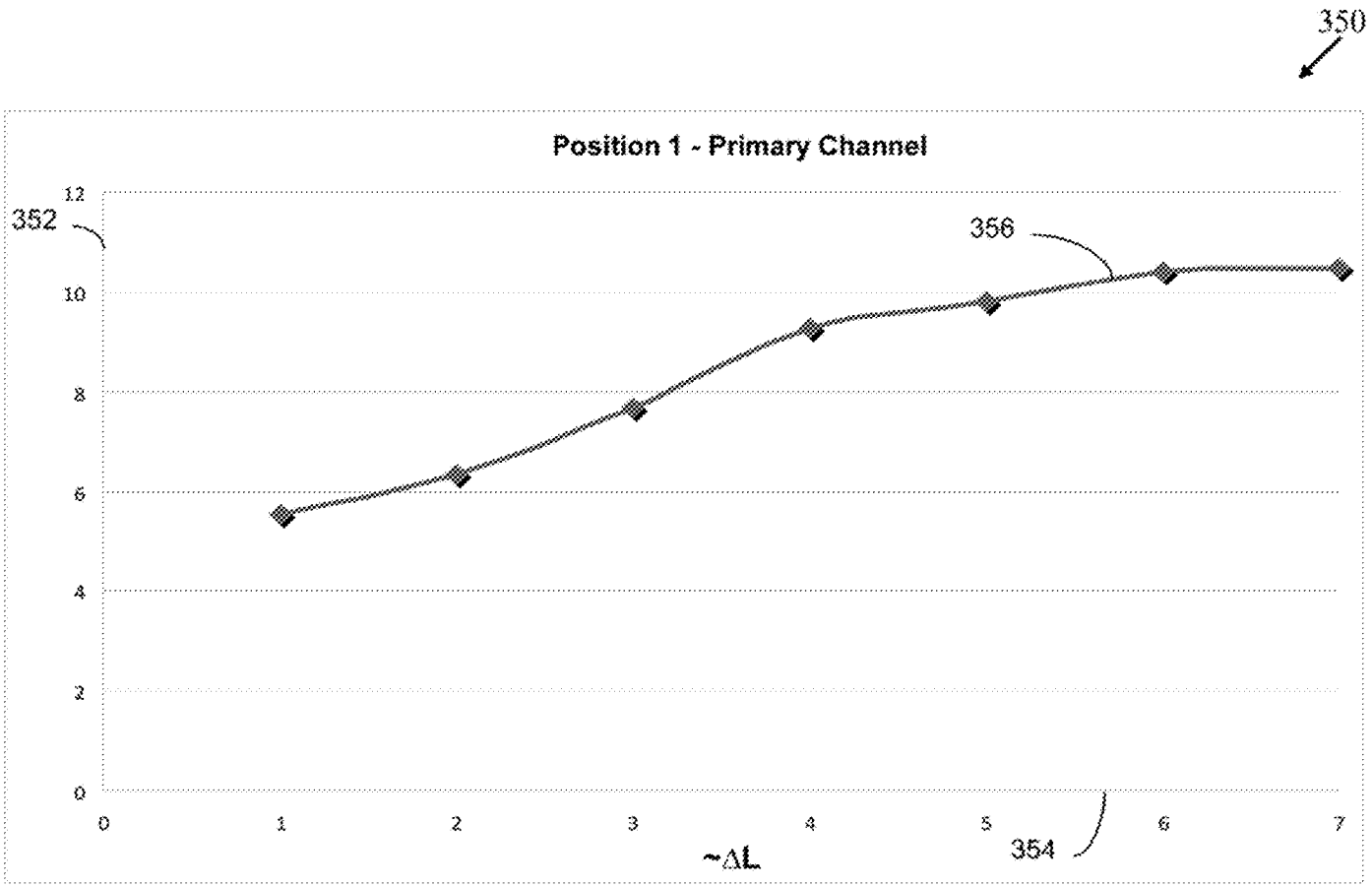
FIG. 3C illustrates signal-to-noise ratio difference versus increasing microphone acoustic separation distance for the data shown in FIG. 3B according to embodiments of the invention.

To make the measurements presented in FIG. 3B and FIG. 3C, an acoustic test facility was used to measure signal-to-noise ratio difference between primary and reference microphone locations. The test facility included a manikin with a built-in speaker was used to simulate a user wearing a head wearable device. A speaker positioned at a location of the user's mouth was used to produce the desired audio signal. The manikin was placed inside of an anechoic chamber of the acoustic test facility. Background noise was generated within the anechoic chamber with an array of speakers. A pink noise spectrum was used during the measurements; however, other weightings in frequency can be used for the background noise field. During these measurements, the spectral amplitude level of the background noise was set to 75 dB/uPa/Hz. A head wearable device was placed on the manikin. During the test, microphones were located at the positions shown in FIG. 3A on the head wearable device. A microphone for a main or primary channel is selected as microphone 1 for the first sequence of measurements which are illustrated in FIG. 3B and FIG. 3C directly below.

The desired audio signal consisted of the word "Camera." This word was transmitted through the speaker in the manikin. The received signal corresponding to the word "Camera" at microphone 1 was processed through the noise cancellation system (as described below in the figures that follow), gated in time, and averaged to produce the "signal" amplitude corresponding with microphone 1. The corresponding signal corresponding to the word "Camera" was measured in turn at each of the other microphones at locations 2, 3, 4, 5, 6, 7, and 8. Similarly, at each microphone location, background noise spectral levels were measured. With these measurements, signal-to-noise ratios were computed at each microphone location and then signal-to-noise ratio difference was computed for microphone pairs as shown in the figures directly below.

FIG. 3B illustrates, generally at 320, signal-to-noise ratio difference measurements for a main microphone as located in FIG. 3A, according to embodiments of the invention. With reference to FIG. 3B and FIG. 3A, microphone 1 is used as the main or primary microphone at 314. A variety of locations were then used to place the reference microphone, such as microphone 2, microphone 3, microphone 6, microphone 4, microphone 5, microphone 7, and microphone 8. In FIG. 3B, column 322 indicates the microphone pair used for a set of measurements. A column 324 indicates the approximate difference in acoustic path length between the given microphone pair of column 322. Approximate acoustic path length difference ~ΔL is given by equation 216 in FIG. 2. Column 326 lists a non-dimensional number ranging from 1 to 7 for the seven different microphone pairs used for signal-to-noise ratio measurements. A column 328 lists the signal-to-noise ratio difference for the given microphone pair listed in the column 322. Each row, 330, 332, 334, 336, 338, 340, and 342 lists a different microphone pair, where the reference microphone has changed while the main microphone 314 is held constant as microphone 1. Note that the approximate difference in acoustic path lengths for the various microphone pairs can be arranged in increasing order as shown by equation 344. The microphone pairs have been arranged in the rows 330-342 in increasing approximate acoustic path length difference 324 according to equation 344. Signal-to-noise ratio difference varies from 5.55 dB for microphone 2 used as a reference microphone to 10.48 dB when microphone 8 is used as the reference microphone.

FIG. 3C illustrates, generally at 350, signal-to-noise ratio difference versus increasing microphone acoustic separation distance for the data shown in FIG. 3B according to embodiments of the invention. With reference to FIG. 3C, signal-to-noise ratio difference is plotted on a vertical axis at 352 and the non-dimensional X value from column 326 (FIG. 3B) is plotted on the horizontal axis at 354. Note, as described above, the non-dimensional X value is representative of approximate acoustic path length difference ~ΔL. The X axis 354 does not correspond exactly with ~ΔL, but it is related to ~ΔL because the data have been arranged and plotted in increasing approximate acoustic path length difference ~ΔL. Such ordering of the data helps to illustrate the character of signal-to-noise ratio difference described above in conjunction with FIG. 2, i.e., signal-to-noise ratio difference will increase with increasing acoustic path length difference between main and reference microphones. This behavior is discerned by observing that signal-to-noise ratio difference is increasing as a function of ~ΔL, with a curve 356 which plots data from columns 328 as a function of the data from column 326 (FIG. 3B).

Figure 4A:
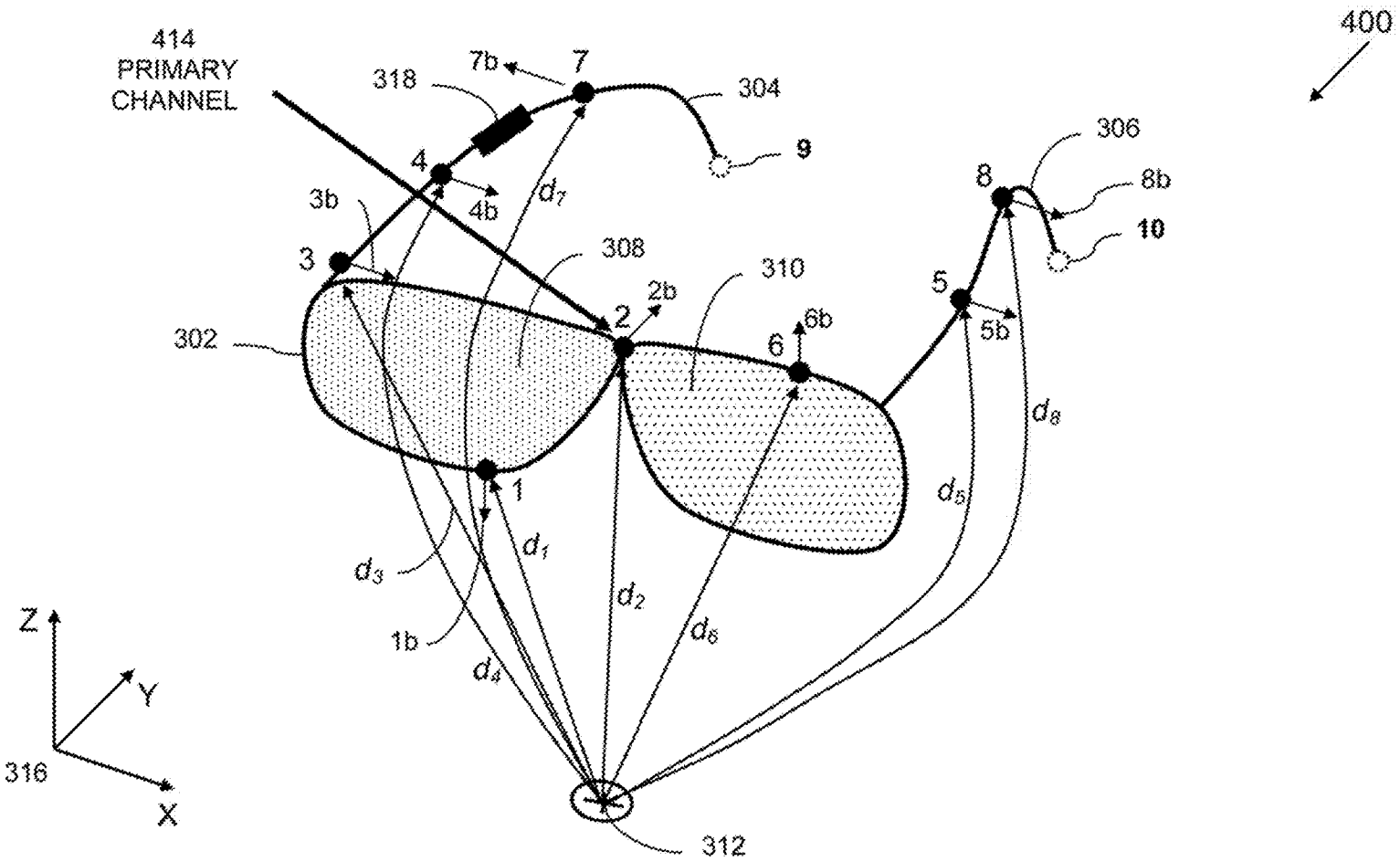
FIG. 4A illustrates generalized microphone placement with a primary microphone at a second location according to embodiments of the invention.

FIG. 4A illustrates, generally at 400 generalized microphone placements with a primary microphone at a second location according to embodiments of the invention. In FIG. 4A, the second location for the main microphone 414 is the location occupied by microphone 2. The tests described above were repeated with microphone 2 as the main microphone and the reference microphone locations were alternatively those of microphone 6, microphone 3, microphone 4, microphone 5, microphone 7, and microphone 8. These data are described below in conjunction with FIG. 4B and FIG. 4C.

FIG. 4B illustrates, generally at 420, signal-to-noise ratio difference measurements for main microphone as located in FIG. 4A, according to embodiments of the invention. With reference to FIG. 4B and FIG. 4A, microphone 2 is used as the main or primary microphone 414. A variety of locations were then used to place the reference microphone, such as microphone 6, microphone 3, microphone 4, microphone 5, microphone 7, and microphone 8. In FIG. 4B, column 422 indicates the microphone pair used for a set of measurements. A column 424 indicates the approximate difference in acoustic path length between the given microphone pair of column 422. Approximate acoustic path length difference ~ΔL is given by equation 216 in FIG. 2. Column 426 lists a non-dimensional number ranging from 1 to 6 for the six different microphone pairs used for signal-to-noise ratio measurements. A column 428 lists the signal-to-noise ratio difference for the given microphone pair listed in the column 422. Each row, 430, 432, 434, 336, 438, and 440 lists a different microphone pair, where the reference microphone has changed while the main microphone 414 is held constant as microphone 2. Note that the approximate difference in acoustic path lengths for the various microphone pairs can be arranged in increasing order as shown by equation 442. The microphone pairs have been arranged in the rows 430-440 in increasing approximate acoustic path length difference 424 according to equation 442. Signal-to-noise ratio difference varies from 1.2 dB for microphone 6 used as a reference microphone to 5.2 dB when microphone 8 is used as the reference microphone.

Figure 4C:
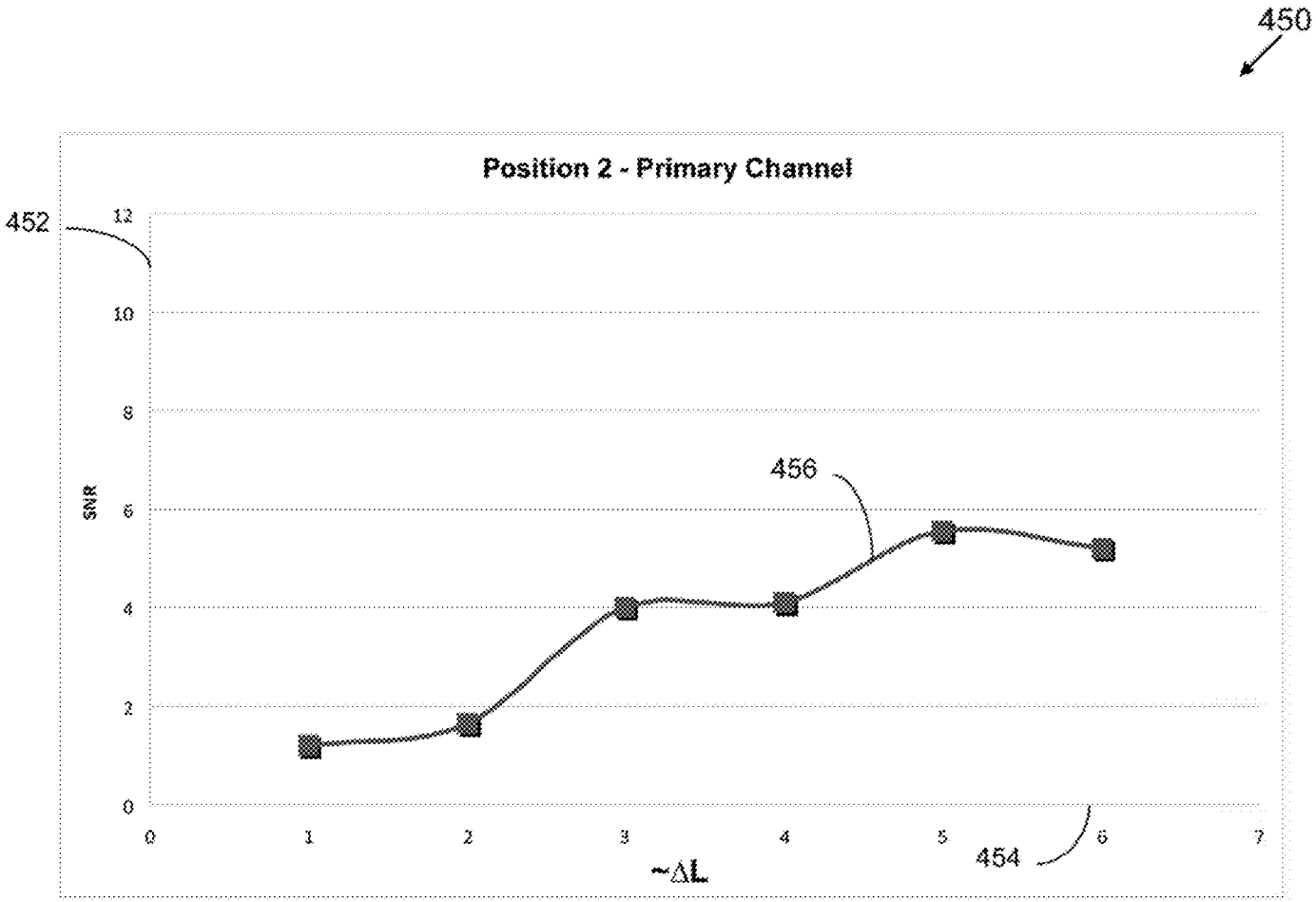
FIG. 4C illustrates signal-to-noise ratio difference versus increasing microphone acoustic separation distance for the data shown in FIG. 4B according to embodiments of the invention.

FIG. 4C illustrates, generally at 450, signal-to-noise ratio difference versus increasing microphone acoustic separation distance for the data shown in FIG. 4B according to embodiments of the invention. With reference to FIG. 4C, signal-to-noise ratio difference is plotted on a vertical axis at 452 and the non-dimensional X value from column 426 (FIG. 4B) is plotted on the horizontal axis at 454. Note, as described above, the non-dimensional X value is representative of approximate acoustic path length difference ~ΔL. The X axis 454 does not correspond exactly with ~ΔL, but it is related to ~ΔL because the data have been arranged and plotted in increasing approximate acoustic path length difference ~ΔL. Such ordering of the data helps to illustrate the character of signal-to-noise ratio difference described above in conjunction with FIG. 2, i.e., signal-to-noise ratio difference will increase with increasing acoustic path length difference between main and reference microphones. This behavior is discerned by observing that signal-to-noise ration difference is increasing as a function of ~ΔL, with a curve 456, which plots data from columns 428 as a function of the data from column 426 (FIG. 4B).

Figure 5A:
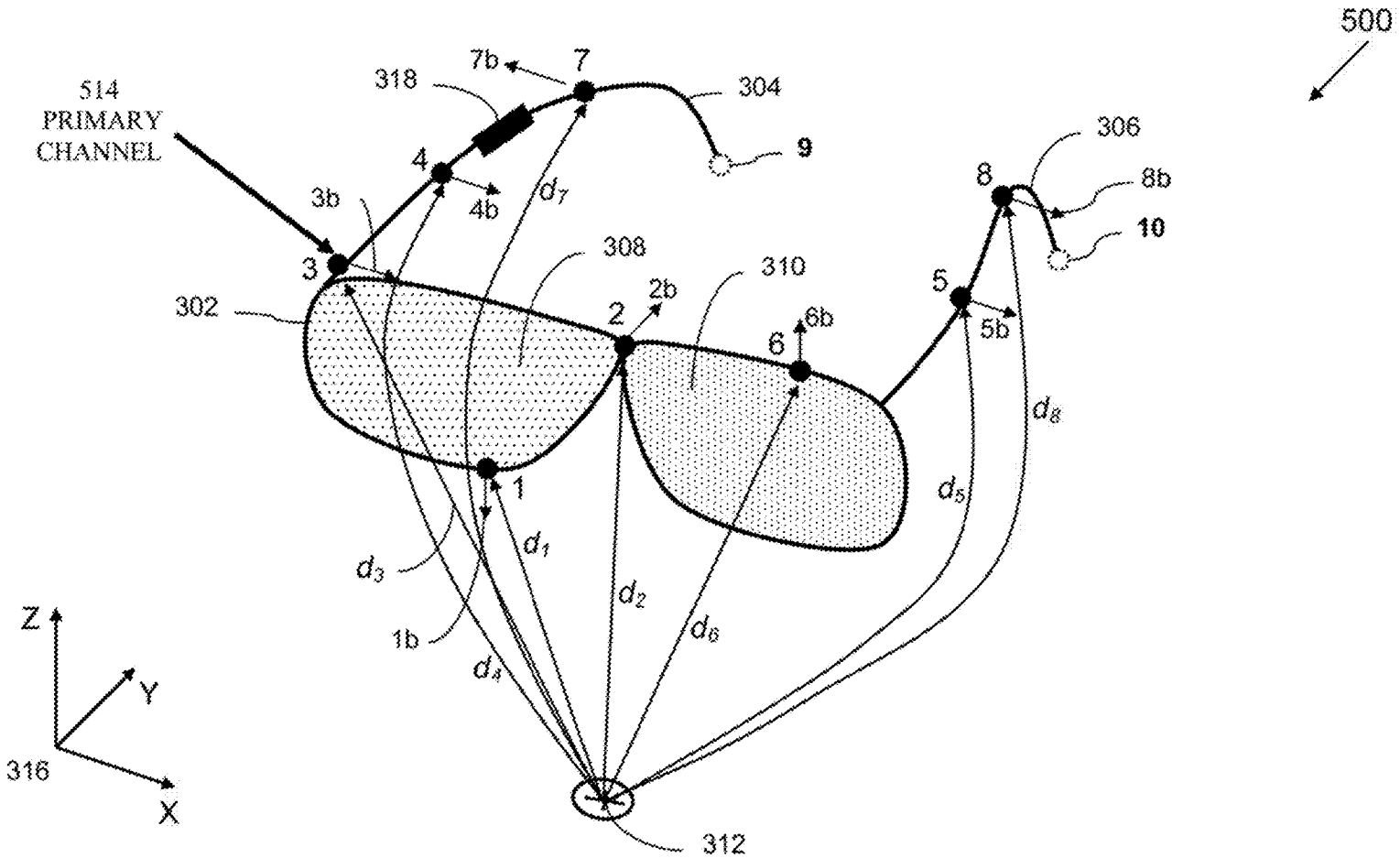
FIG. 5A illustrates generalized microphone placement with a primary microphone at a third location according to embodiments of the invention.

FIG. 5A illustrates, generally at 500, generalized microphone placement with a primary microphone at a third location according to embodiments of the invention. In FIG. 5A, the third location for the main microphone 514 is the location occupied by microphone 3. The tests described above were repeated with microphone 3 as the main microphone and the reference microphone locations were alternatively those of microphone 6, microphone 4, microphone 5, microphone 7, and microphone 8. These data are described below in conjunction with FIG. 5B and FIG. 5C.

FIG. 5B illustrates, generally at 520, signal-to-noise ratio difference measurements for main microphone as located in FIG. 5A, according to embodiments of the invention. With reference to FIG. 5B and FIG. 5A, microphone 3 is used as the main or primary microphone 514. A variety of locations were then used to place the reference microphone, such as microphone 6, microphone 4, microphone 5, microphone 7, and microphone 8. In FIG. 5B, column 522 indicates the microphone pair used for a set of measurements. A column 524 indicates the approximate difference in acoustic path length between the given microphone pair of column 522. Approximate acoustic path length difference ~ΔL is given by equation 216 in FIG. 2. Column 526 lists non-dimensional number ranging from 1 to 5 for the five different microphone pairs used for signal-to-noise ratio measurements. A column 528 lists the signal-to-noise ratio difference for the given microphone pair listed in the column 522. Each row, 530, 532, 534, 536, and 538 lists a different microphone pair, where the reference microphone has changed while the main microphone 514 is held constant as microphone 3. Note that the approximate difference in acoustic path lengths for the various microphone pairs can be arranged in increasing order as shown by equation 540. The microphone pairs have been arranged in the rows 530-538 in increasing approximate acoustic path length difference 524 according to equation 540. Signal-to-noise ratio difference varies from 0 dB for microphone 6 used as a reference microphone to 5.16 dB when microphone 7 is used as the reference microphone.

Figure 5C:
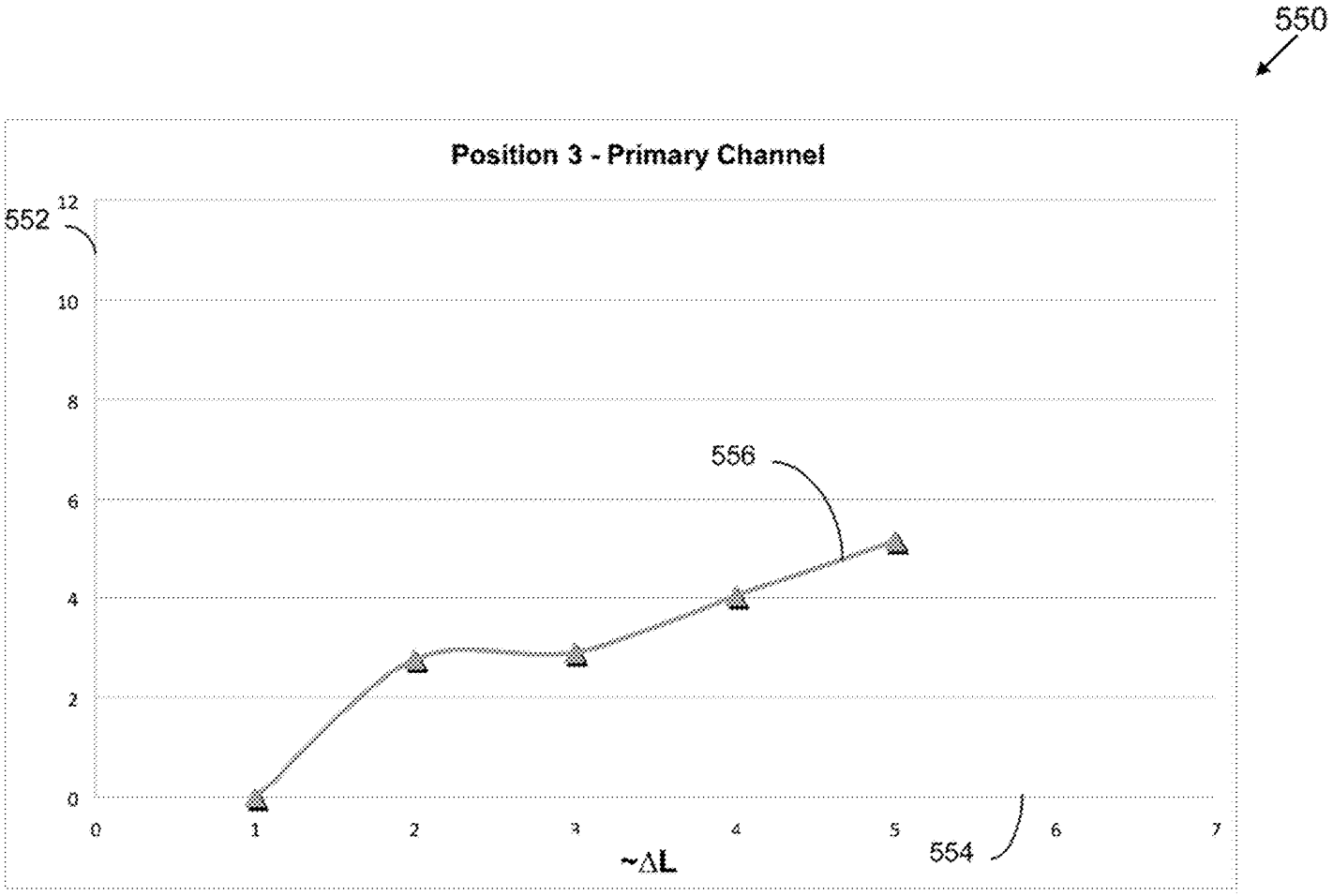
FIG. 5C illustrates signal-to-noise ratio difference versus increasing microphone acoustic separation distance for the data shown in FIG. 5B according to embodiments of the invention.

FIG. 5C illustrates, generally at 550, signal-to-noise ratio difference versus increasing microphone acoustic separation distance for the data shown in FIG. 5B according to embodiments of the invention. With reference to FIG. 5C, signal-to-noise ratio difference is plotted on a vertical axis at 552 and the non-dimensional X value from column 526 (FIG. 5B) is plotted on the horizontal axis at 554. Note, as described above, the non-dimensional X value is representative of approximate acoustic path length difference ~ΔL. The X axis 554 does not correspond exactly with ~ΔL, but it is related to ~ΔL because the data have been arranged and plotted in increasing approximate acoustic path length difference ~ΔL. Such ordering of the data helps to illustrate the character of signal-to-noise ratio difference described above in conjunction with FIG. 2, i.e., signal-to-noise ratio difference will increase with increasing acoustic path length difference between main and reference microphones. This behavior is discerned by observing that signal-to-noise ratio difference is increasing as a function of ~ΔL, with a curve 556, which plots data from columns 528 as a function of the data from column 526 (FIG. 5B).

Note that within the views presented in the figures above, specific locations for the microphones have been chosen for the purpose of illustration only. These locations do not limit embodiments of the invention. Other locations for microphones on a head wearable device are used in other embodiments.

Thus, as described above in conjunction with FIG. 1 block 108 and FIG. 2 through FIG. 5C, in various embodiments, microphone placement geometry is used to create an acoustic path length difference between two microphones and a corresponding signal-to-noise ratio difference between a main and a reference microphone. The signal-to-noise ratio difference can also be accomplished through the use of different directivity patterns for the main and reference microphones. In some embodiments beamforming is used to create different directivity patterns for a main and a reference channel. For example, in FIG. 5A, acoustic path lengths $d_3$ and $d_6$ are too similar in value, thus this choice of locations for the main and reference microphones did not produce an adequate signal-to-noise ratio difference (0 dB at column 528 row 530 FIG. 5B). In such a case, variation in microphone directivity pattern (one or both microphones) and/or beamforming can be used to create the needed signal-to-noise ratio difference between the main and the reference channels.

A directional microphone can be used to decrease reception of desired audio and/or to increase reception of undesired audio, thereby lowering a signal-to-noise ratio of a second microphone (reference microphone), which results in an increase in the signal-to-noise ratio difference between the primary and reference microphones. An example is illustrated in FIG. 3A using a second microphone (not shown) and the techniques taught in FIG. 6 and FIG. 7 below. In some embodiments, the second microphone can be substantially co-located with microphone 1. In other embodiments, the second microphone is located an equivalent distance from the source 312 as is the first microphone. In some embodiments, the second microphone is a directional microphone whose main response axis is substantially perpendicular to (or equivalently stated misaligned with) the acoustic path $d_1$. Thus, a null or a direction of lesser response to desired audio from 312 for the second microphone exists in the direction of desired audio $d_1$. This results in a decrease in the signal-to-noise ratio of the second microphone and an increase in a signal-to-noise ratio difference calculated between the first microphone and the second microphone. Note that the two microphones can be placed in any location on the head wearable device 302, which includes co-location as described above. In other embodiments, one or more microphone elements are used as inputs to a beamformer resulting in main and reference channels having different directivity patterns and a resulting signal-to-noise ratio difference there between.

Figure 6:
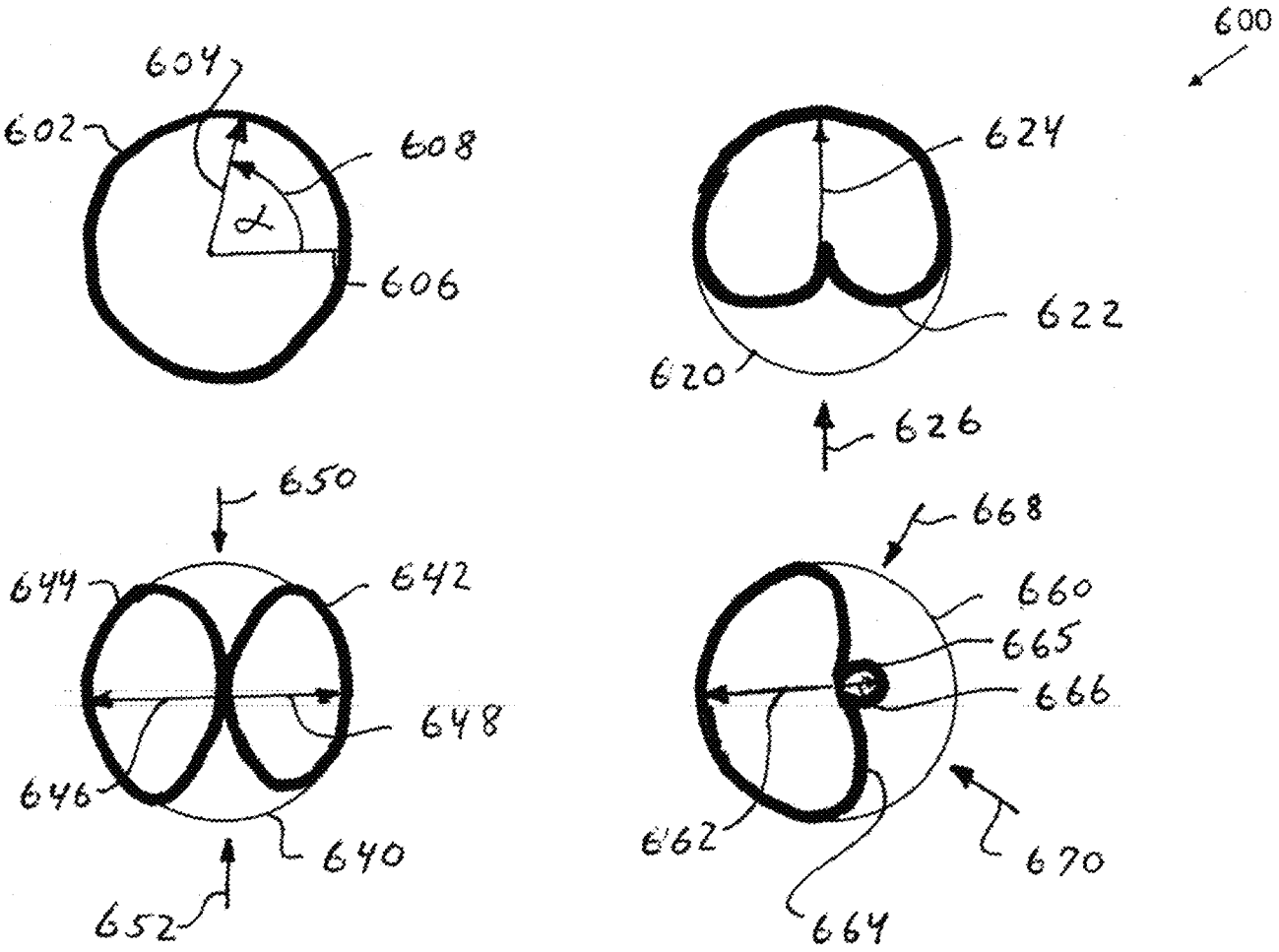
FIG. 6 illustrates microphone directivity patterns according to embodiments of the invention.

FIG. 6 illustrates, generally at 600, microphone directivity patterns according to embodiments of the invention. With reference to FIG. 6, an omni-directional microphone directivity pattern is illustrated with circle 602 having constant radius 604 indicating uniform sensitivity as a function of angle alpha ($\alpha$) at 608 measured from reference 606.

An example of a directional microphone having a cardioid directivity pattern 622 is illustrated within plot 620 where the cardioid directivity pattern 622 has a peak sensitivity axis indicated at 624 and a null indicated at 626. A cardioid directivity pattern can be formed with two omni-directional microphones or with an omni-directional microphone and a suitable mounting structure for the microphone.

An example of a directional microphone having a bidirectional directivity pattern 642/644 is illustrated within plot 640 where a first lobe 642 of the bidirectional directivity pattern has a first peak sensitivity axis indicated at 648 the second lobe 644 has a second peak sensitivity axis indicated at 646. A first null exists at a direction 650 and a second null exists at a direction 652.

An example of a directional microphone having a super-cardioid directivity pattern is illustrated with plot 660 where the super-cardioid directivity pattern 664/665 has a peak sensitivity axis indicated at a direction 662, a minor sensitivity axis indicated at a direction 666 and nulls indicated at directions 668 and 670.

Figure 7:
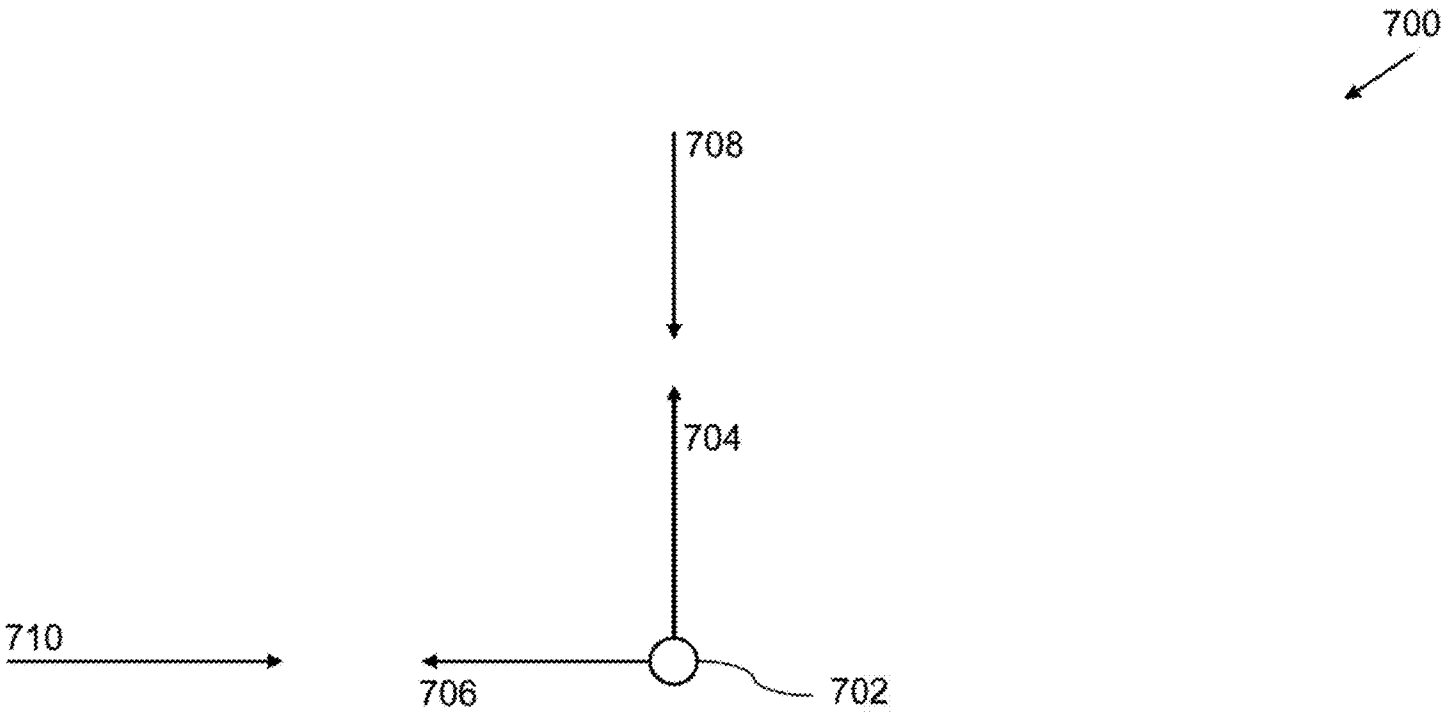
FIG. 7 illustrates a misaligned reference microphone response axis according to embodiments of the invention.

FIG. 7 illustrates, generally at 700, a misaligned reference microphone response axis according to embodiments of the invention. With reference to FIG. 7, a microphone is indicated at 702. The microphone 702 is a directional microphone having a main response axis 706 and a null in its directivity pattern indicated at 704. An incident acoustic field is indicated arriving from a direction 708. In various embodiments, the microphone 702 is for example a bidirectional microphone as illustrated in FIG. 6 above. Suitably positioned on a head wearable device, the directional microphone 702 decreases a signal-to-noise ratio when used as a reference microphone by limiting response to desired audio coming from direction 708 while responding to undesired audio, coming from a direction 710. The response of the directive microphone 702 will produce an increase in a signal-to-noise ratio difference as described above.

Thus, within the teachings of embodiments presented herein one or more main microphones and one or more reference microphones are placed in locations on a head wearable device to obtain suitable signal-to-noise ratio difference between a main and a reference microphone. Such signal-to-noise ratio difference enables extraction of desired audio from an acoustic signal containing both desired audio and undesired audio as described below in conjunction with the figures that follow. Microphones can be placed at various locations on the head wearable device, including co-locating a main and a reference microphone at a common position on a head wearable device.

In some embodiments, the techniques of microphone placement geometry are combined together with different directivity patterns obtained at the microphone level or through beamforming to produce a signal-to-noise ratio difference between a main and a reference channel according to a block 112 (FIG. 1).

Figure 8:
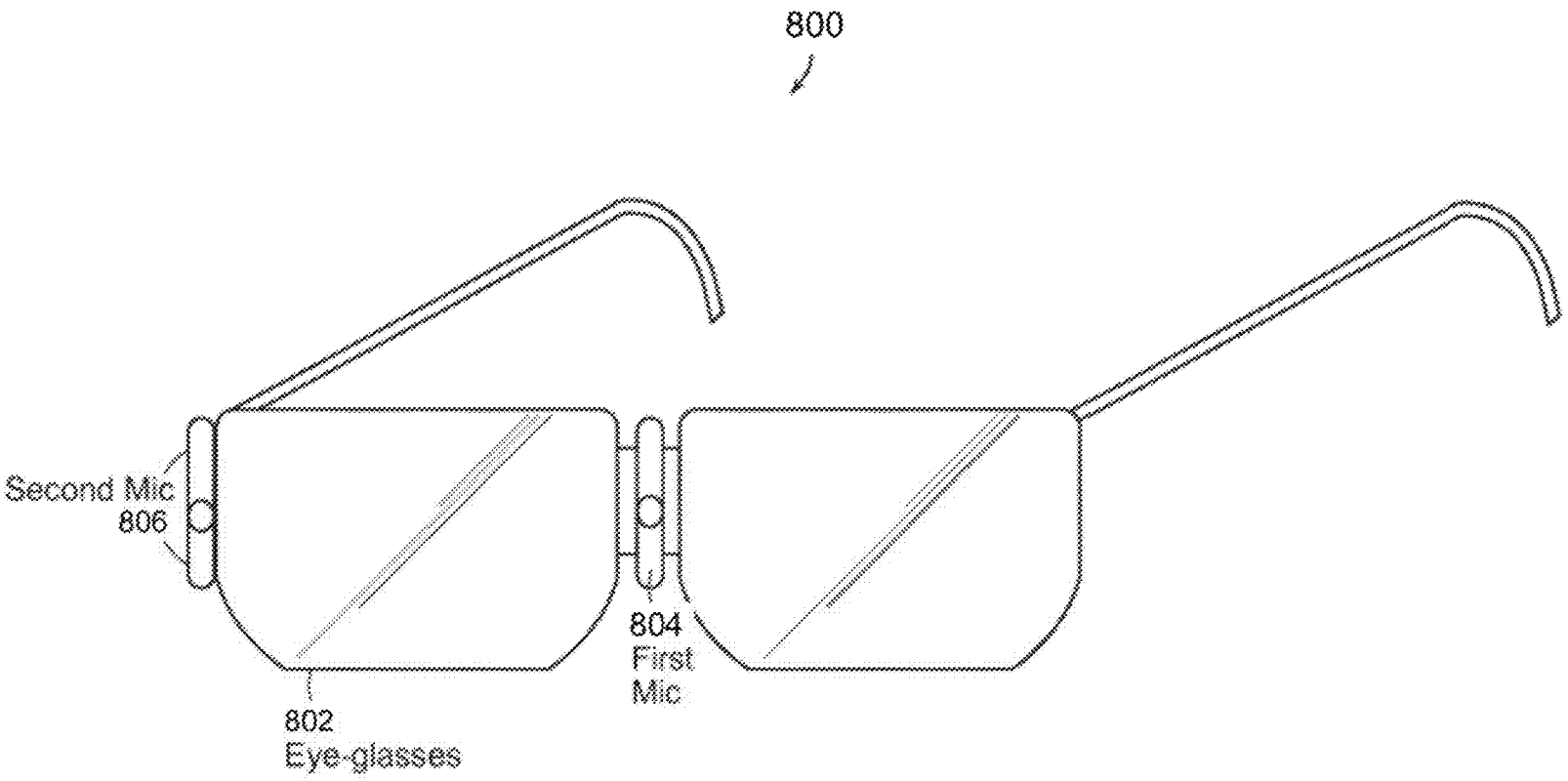
FIG. 8 is a diagram illustrating an embodiment of eyeglasses of the invention having two embedded microphones.

In various embodiments, a head wearable device is an eyewear device as described below in conjunction with the figures that follow. FIG. 8 is an illustration of an example of one embodiment of an eyewear device 800 of the invention. As shown therein, eyewear device 800 includes eye-glasses 802 having embedded microphones. The eye-glasses 802 have two microphones 804 and 806. First microphone 804 is arranged in the middle of the eye-glasses 802 frame. Second microphone 806 is arranged on the side of the eye-glasses 802 frame. The microphones 804 and 806 can be pressure-gradient microphone elements, either bi- or uni-directional. In one or more embodiments, each microphone 804 and 806 is a microphone assembly within a rubber boot. The rubber boot provides an acoustic port on the front and the back side of the microphone with acoustic ducts. The two microphones 804 and 806 and their respective boots can be identical. The microphones 804 and 806 can be sealed air-tight (e.g., hermetically sealed). The acoustic ducts are filled with windscreen material. The ports are sealed with woven fabric layers. The lower and upper acoustic ports are sealed with a water-proof membrane. The microphones can be built into the structure of the eye glasses frame. Each microphone has top and bottom holes, being acoustic ports. In an embodiment, the two microphones 804 and 806, which can be pressure-gradient microphone elements, can each be replaced by two omni-directional microphones.

Figure 9:
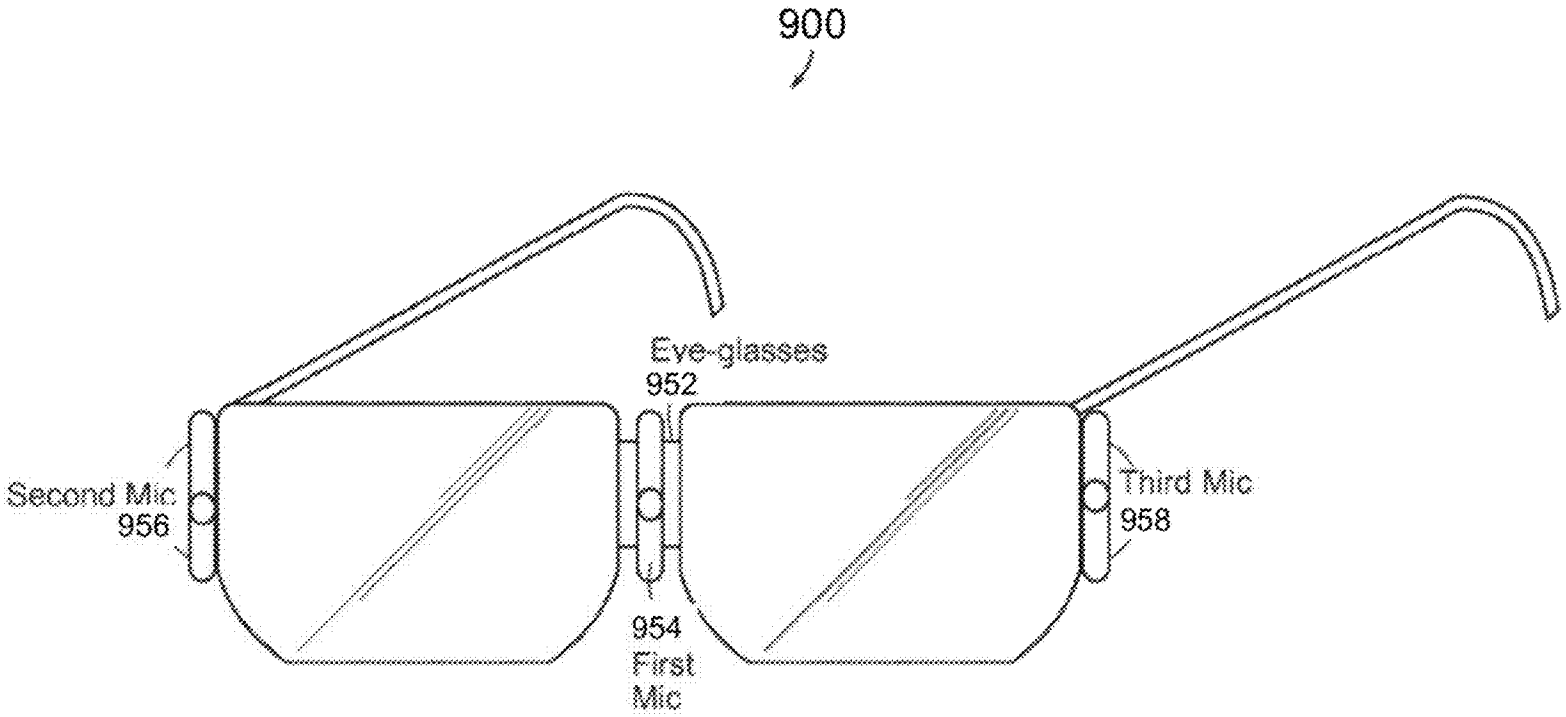
FIG. 9 is a diagram illustrating an embodiment of eyeglasses of the invention having three embedded microphones.

FIG. 9 is an illustration of another example of an embodiment of the invention. As shown in FIG. 9, eyewear device 900 includes eye-glasses 952 having three embedded microphones. The eye-glasses 952 of FIG. 9 are similar to the eye-glasses 802 of FIG. 8, but instead employ three microphones instead of two. The eye-glasses 952 of FIG. 9 have a first microphone 954 arranged in the middle of the eye-glasses 952, a second microphone 956 arranged on the left side of the eye-glasses 952, and a third microphone 958 arranged on the right side of the eye-glasses 952. The three microphones can be employed in the three-microphone embodiment described above.

Figure 10:
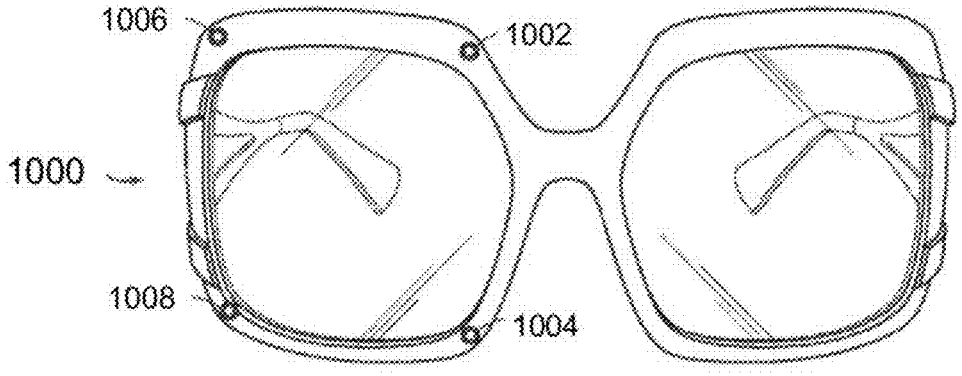
FIG. 10 is an illustration of another embodiment of the invention employing four omni directional microphones at four acoustic ports in place of two bidirectional microphones.

FIG. 10 is an illustration of an embodiment of eyewear 1000 of the present invention that replaces the two bi-directional microphones shown in FIG. 8, for example, with four omni-directional microphones 1002, 1004, 1006, 1008, and electronic beam steering. Replacing the two bi-directional microphones with four omni-directional microphones provides eyewear frame designers more flexibility and manufacturability. In example embodiments having four omni-directional microphones, the four omni-directional microphones can be located anywhere on the eyewear frame, preferably with the pairs of microphones lining up vertically about a lens. In this embodiment, omni-directional microphones 1002 and 1004 are main microphones for detecting the primary sound that is to be separated from interference, and microphones 1004, 1008 are reference microphones that detect background noise that is to be separated from the primary sound. The array of microphones can be omni directional microphones, wherein the omni-directional microphones can be any combination of the following: electric condenser microphones, analog microelectromechanical systems (MEMS) microphones, or digital MEMS microphones.

Figure 11:
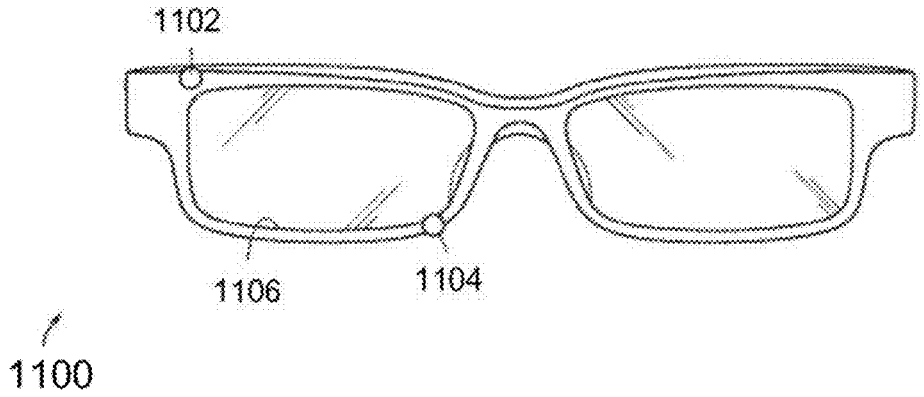
FIG. 11 is a schematic representation of eyewear of the invention employing two omni directional microphones placed diagonally across the lens opening defined by the front frame of the eyewear.

Another example embodiment of the present invention, shown in FIG. 11, includes an eyewear device with a noise canceling microphone array, the eyewear device including an eyeglasses frame 1100, an array of microphones coupled to the eyeglasses frame, the array of microphones including at least a first microphone 1102 and a second microphone 1104, the first microphone coupled to the eyeglasses frame about a temple region, the temple region can be located approximately between a top corner of a lens opening and a support arm, and providing a first audio channel output, and the second microphone coupled to the eyeglasses frame about an inner lower corner of the lens opening, and providing a second audio channel output. The second microphone is located diagonally across lens opening 1106, although it can be positioned anywhere along the inner frame of the lens, for example the lower corner, upper corner, or inner frame edge. Further, the second microphone can be along the inner edge of the lens at either the left or right of the nose bridge.

Figure 12:
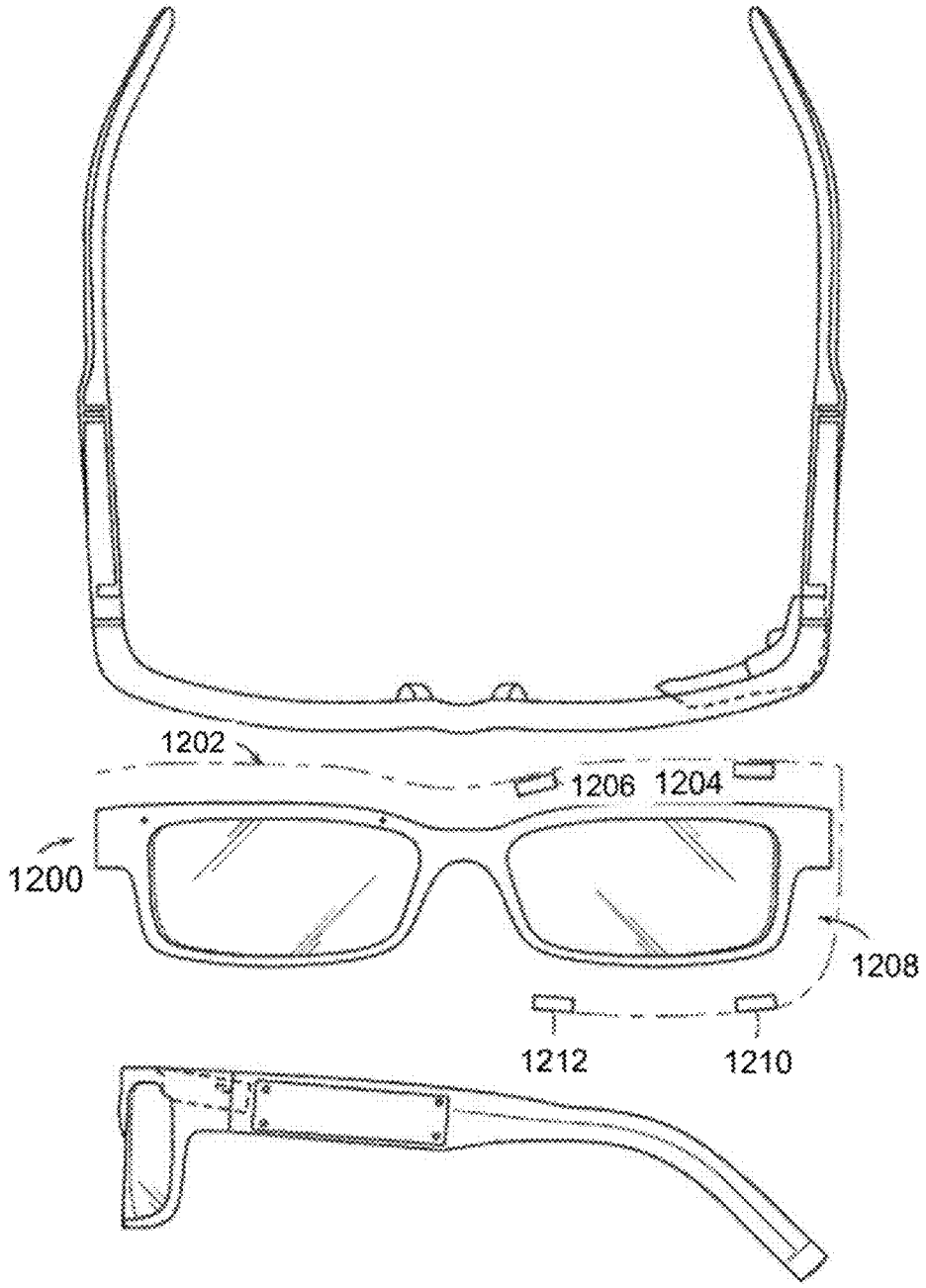
FIG. 12 is an illustration of another embodiment of the invention employing four omni directional microphones placed along the top and bottom portions of the eyeglasses frame.

In yet another embodiment of the invention, the array of microphones can be coupled to the eyeglasses frame using at least one flexible printed circuit board (PCB) strip, as shown in FIG. 12. In this embodiment, eyewear device of the invention 1200 includes upper flexible PCB strip 1202 including the first 1204 and fourth 1206 microphones and a lower flexible PCB strip 1208 including the second 1210 and third 1212 microphones.

Figure 13:
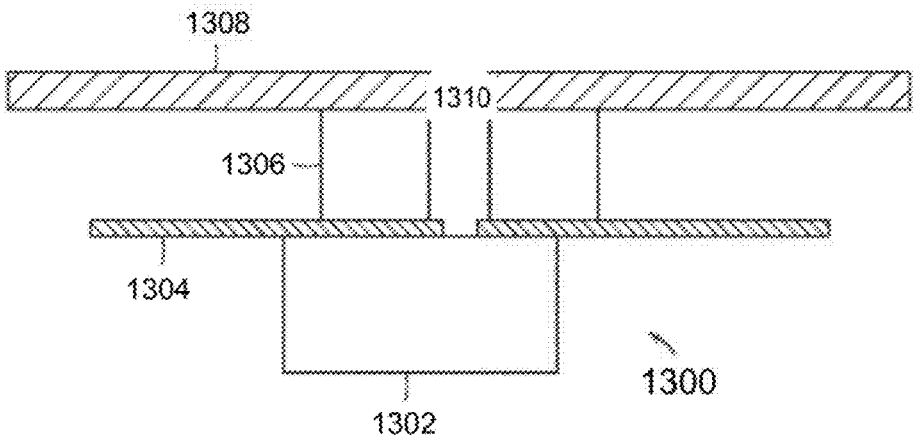
FIG. 13 is an illustration of another embodiment of the invention wherein microphones have been placed at a temple portion of the eyewear facing inward and at a lower center corner of the front frame of the eyewear and facing down.

In further example embodiments, the eyeglasses frame can further include an array of vents corresponding to the array of microphones. The array of microphones can be bottom port or top port microelectromechanical systems (MEMS) microphones. As can be seen in FIG. 13, which is a microphone component of the eyewear of FIG. 12, MEMS microphone component 1300 includes MEMS microphone 1302 is affixed to flexible printed circuit board (PCB) 1304. Gasket 1306 separates flexible PCB 1304 from device case 1308. Vent 1310 is defined by flexible PCB 1304, gasket 1306 and device case 1308. Vent 1310 is an audio canal to channel audio waves to MEMS microphone 1302. The first and fourth MEMS microphones can be coupled to the upper flexible PCB strip, the second and third MEMS microphones can be coupled to the lower flexible PCB strip, and the array of MEMS microphones can be arranged such that the bottom ports or top ports receive acoustic signals through the corresponding vents.

Figure 14:
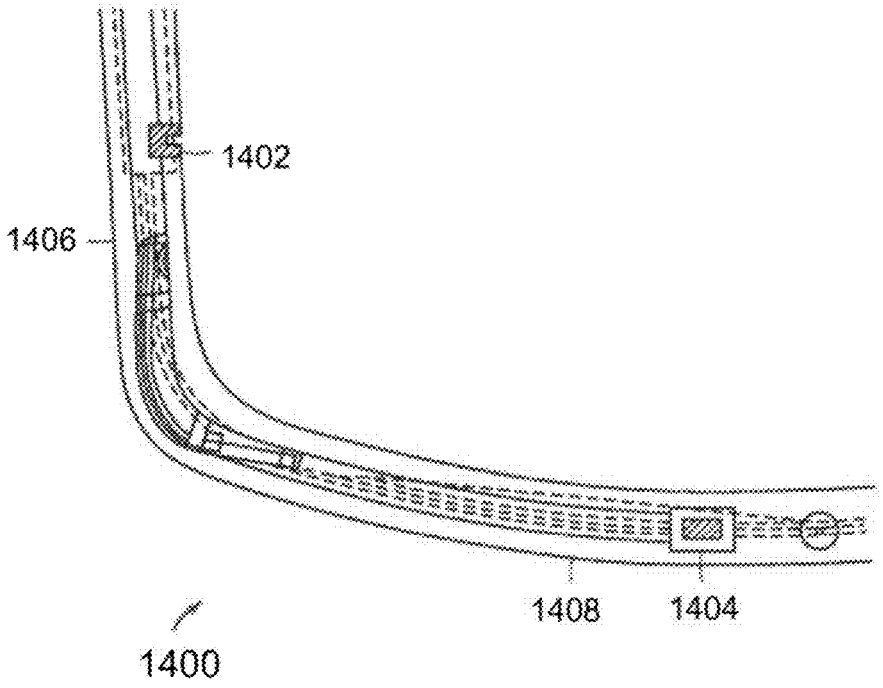
FIG. 14 is an illustration of another embodiment of the invention wherein microphones have been placed at a temple portion of the eyewear facing inward and at a lower center corner of the front frame of the eyewear and facing down.

FIG. 14 shows another alternate embodiment of eyewear 1400 where microphones 1402, 1404 are placed at the temple region 1406 and front frame 1408, respectively.

Figure 15:
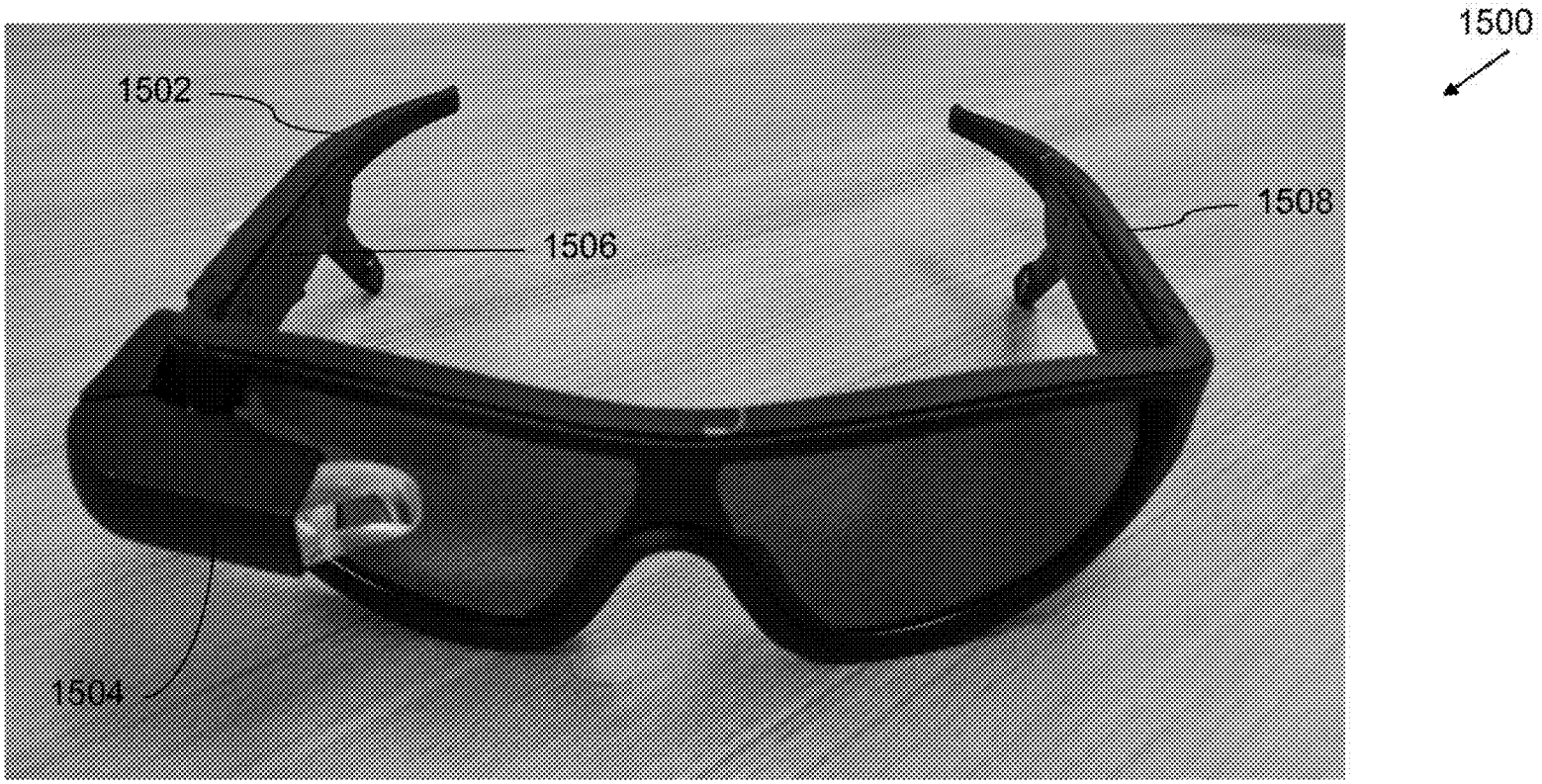
FIG. 15 illustrates an eye glass with built-in acoustic noise cancellation system according to embodiments of the invention.

FIG. 15 illustrates, generally at 1500, an eye glass with built-in acoustic noise cancellation system according to embodiments of the invention. With reference to FIG. 15, a head wearable device 1502 includes one or more microphones used for a main acoustic channel and one or more microphones used for a reference acoustic channel. The head wearable device 1502 is configured as a wearable computer with information display 1504. In various embodiments, electronics are included at 1506 and/or at 1508. In various embodiments, electronics can include noise cancellation electronics which are described more fully below in conjunction with the figures that follow. In other embodiments, noise cancellation electronics are not co-located with the head wearable device 1502 but are located externally from the head wearable device 1502. In such embodiments, a wireless communication link such as is compatible with the BLUETOOTH® protocol, ZIGBEE®, etc. is provided to send the acoustic signals received from the microphones to an external location for processing by noise cancellation electronics.

Figure 16:
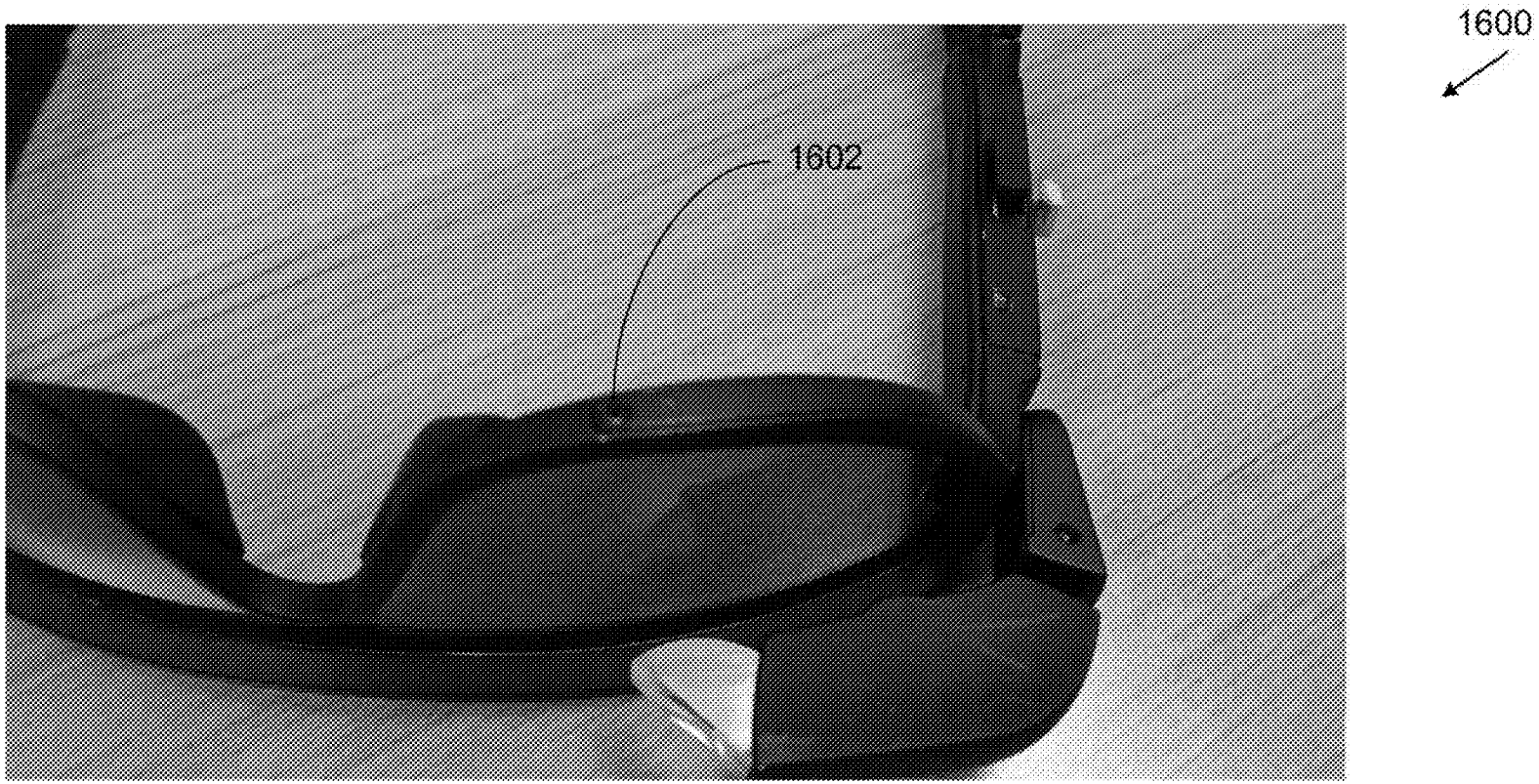
FIG. 16 illustrates a primary microphone location in the head wearable device from FIG. 15 according to embodiments of the invention.

FIG. 16 illustrates, generally at 1600, a primary microphone location in the head wearable device from FIG. 15 according to embodiments of the invention. With reference to FIG. 16, a main microphone location is illustrated at 1602.

Figure 17:
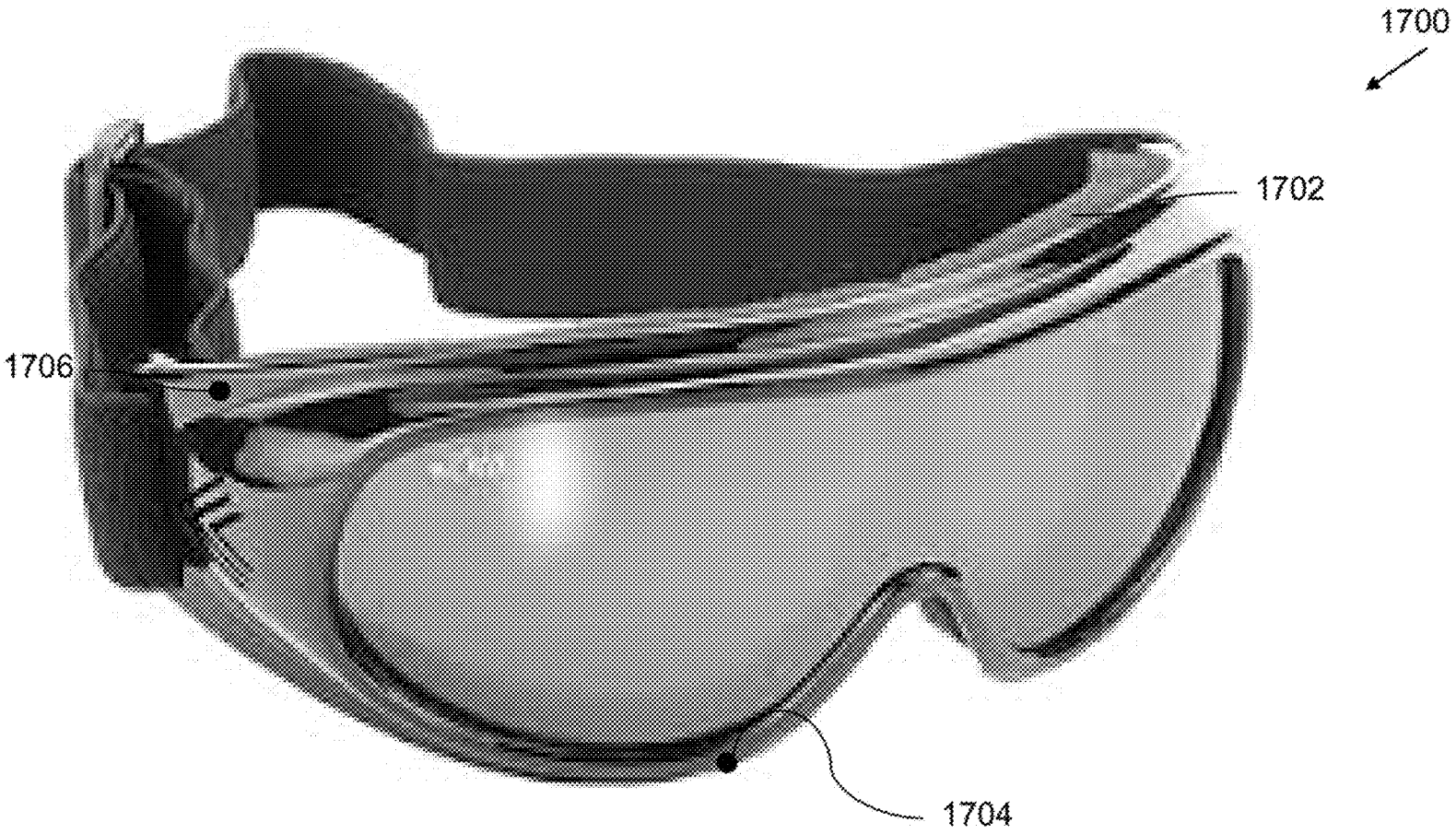
FIG. 17 illustrates goggles with built-in acoustic noise cancellation system according to embodiments of the invention.

FIG. 17 illustrates, generally at 1700, goggles with built-in acoustic noise cancellation system according to embodiments of the invention. With reference to FIG. 17, a head wearable device in the form of goggles 1702 is configured with a main microphone at a location 1704 and a reference microphone at a location 1706. In various embodiments, noise cancellation electronics are included within goggles 1702. Noise cancellation electronics are described more fully below in conjunction with the figures that follow. In other embodiments, noise cancellation electronics are not co-located with the head wearable device 1702 but are located external from the head wearable device 1702. In such embodiments, a wireless communication link such as is compatible with the BLUETOOTH® protocol, ZIGBEE® protocol, etc. is provided to send the acoustic signals received from the microphones to an external location for processing by noise cancellation electronics.

Figure 18:
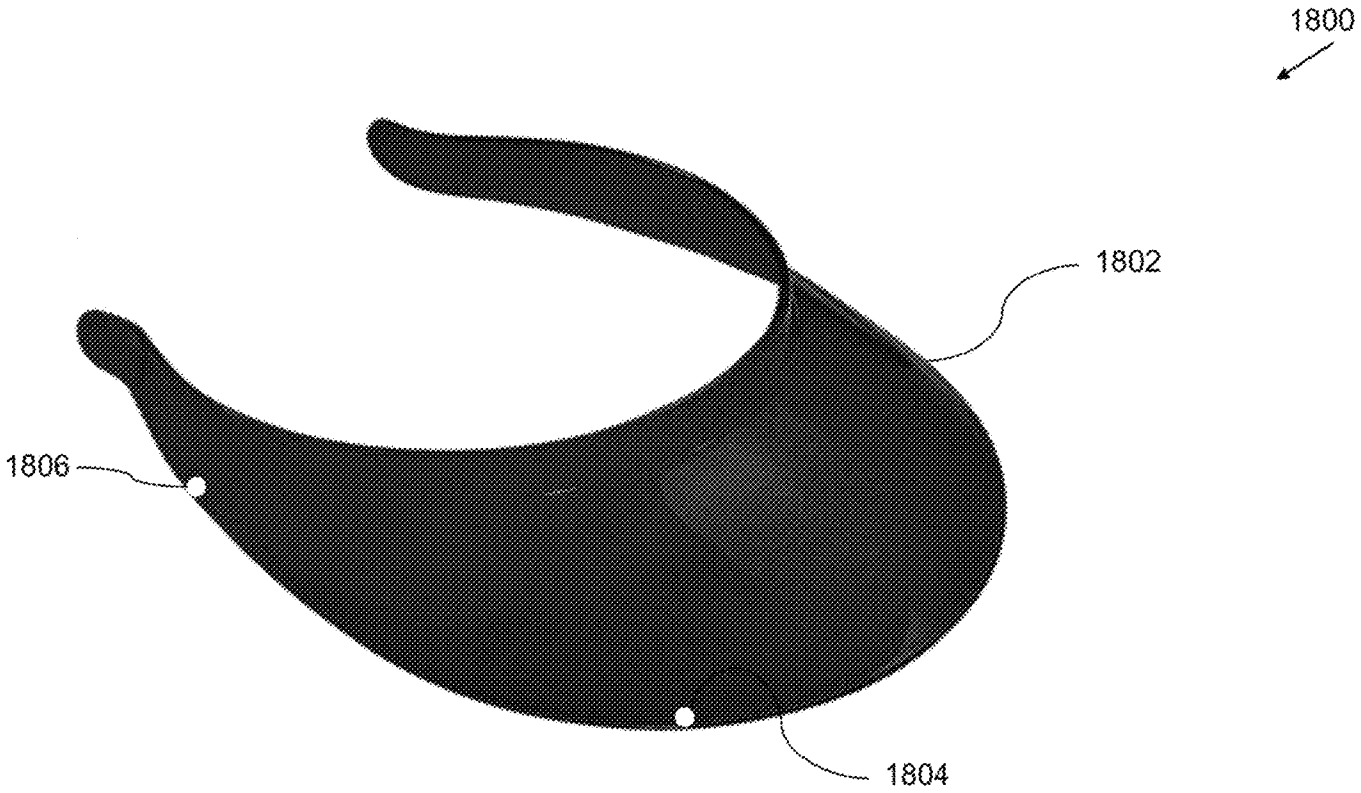
FIG. 18 illustrates a visor with built-in acoustic noise cancellation system according to embodiments of the invention.

FIG. 18 illustrates, generally at 1800, a visor with built-in acoustic noise cancellation system according to embodiments of the invention. With reference to FIG. 18, a head wearable device in the form of a visor 1802 has a main microphone 1804 and a reference microphone 1806. In various embodiments, noise cancellation electronics are included within the visor 1802. Noise cancellation electronics are described more fully below in conjunction with the figures that follow. In other embodiments, noise cancellation electronics are not co-located with the head wearable device 1802 but are located external from the head wearable device 1802. In such embodiments, a wireless communication link such as is compatible with the BLUETOOTH® protocol, ZIGBEE® protocol, etc. is provided to send the acoustic signals received from the microphones to an external location for processing by noise cancellation electronics.

Figure 19:
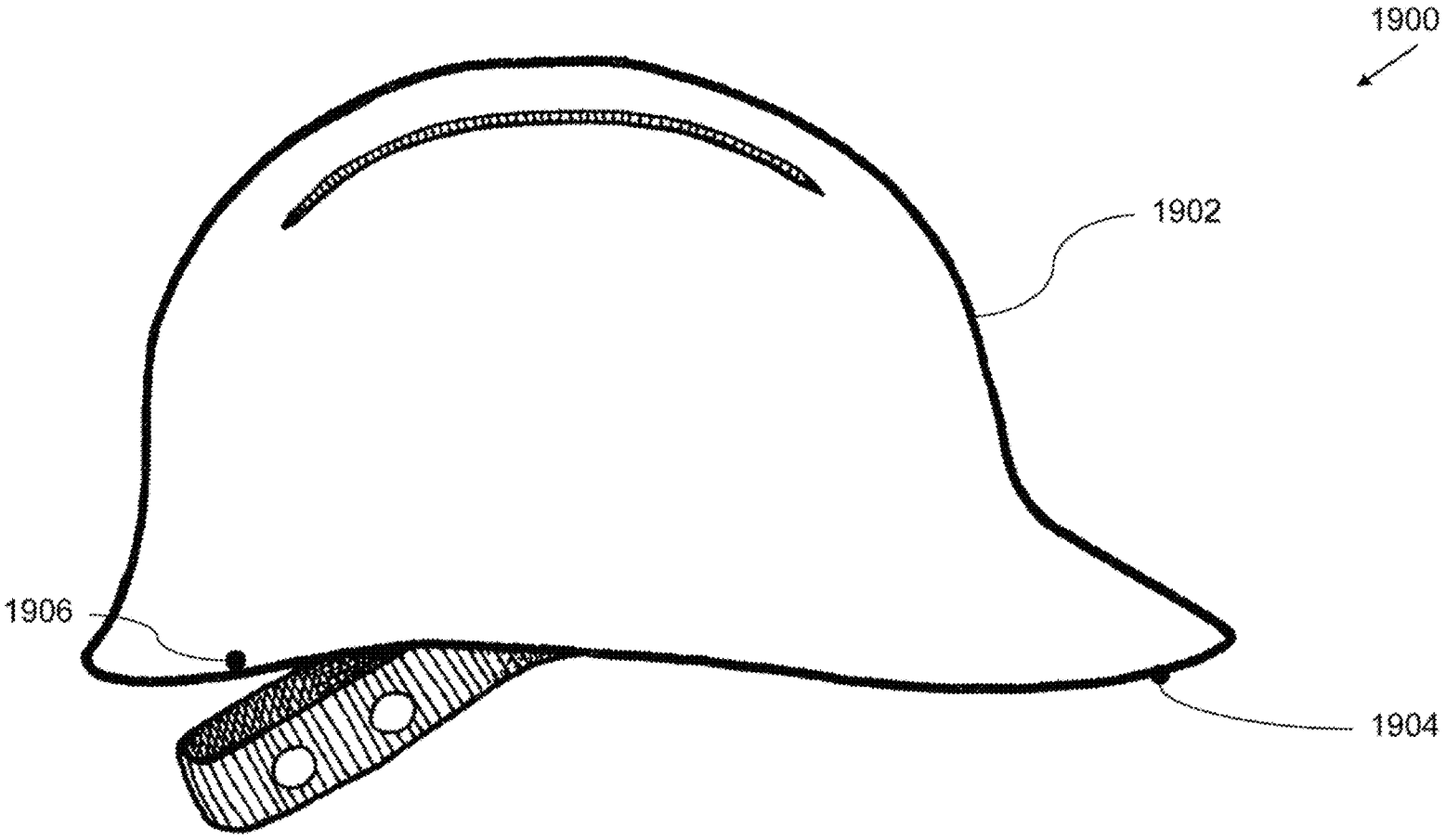
FIG. 19 illustrates a helmet with built-in acoustic noise cancellation system according to embodiments of the invention.

FIG. 19 illustrates, generally at 1900, a helmet with built-in acoustic noise cancellation system according to embodiments of the invention. With reference to FIG. 19, a head wearable device in the form of a helmet 1902 has a main microphone 1904 and a reference microphone 1906. In various embodiments, noise cancellation electronics are included within the helmet 1902. Noise cancellation electronics are described more fully below in conjunction with the figures that follow. In other embodiments, noise cancellation electronics are not co-located with the head wearable device 1902 but are located external from the head wearable device 1902. In such embodiments, a wireless communication link such as is compatible with the BLUETOOTH® protocol, ZIGBEE® protocol, etc. is provided to send the acoustic signals received from the microphones to an external location for processing by noise cancellation electronics.

Figure 20:
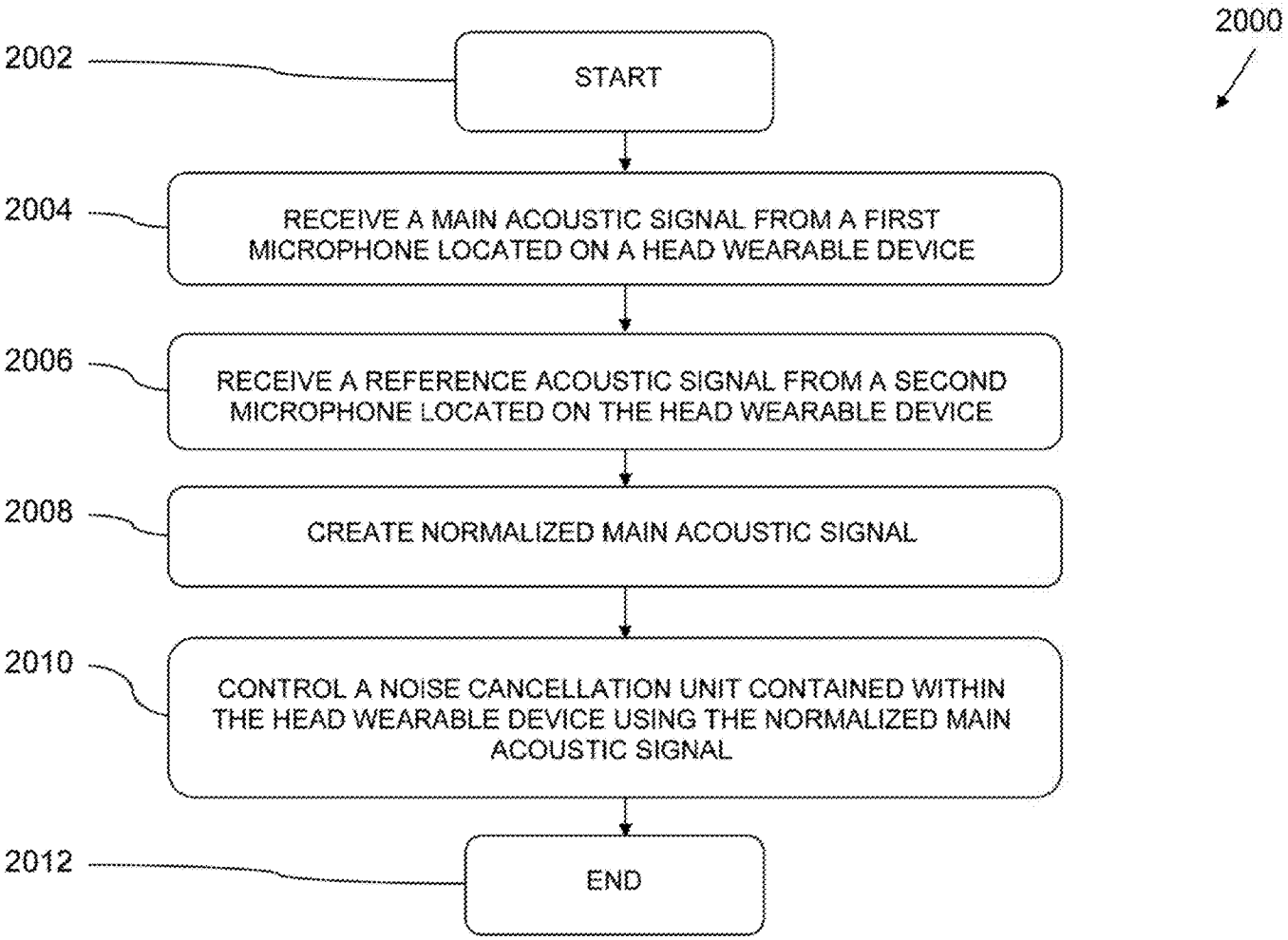
FIG. 20 illustrates a process for extracting a desired audio signal according to embodiments of the invention.

FIG. 20 illustrates, generally at 2000, a process for extracting a desired audio signal according to embodiments of the invention. With reference to FIG. 20, a process starts at a block 2002. At a block 2004, a main acoustic signal is received from a main microphone located on a head wearable device. At a block 2006, a reference acoustic signal is received from a reference microphone located on the head wearable device. At a block 2008, a normalized main acoustic signal is formed. In various embodiments, the normalized main acoustic signal is formed using one or more reference acoustic signals as described in the figures below. At a block 2010 the normalized main acoustic signal is used to control noise cancellation using an acoustic signal processing system contained within the head wearable device. The process stops at a block 2012.

Figure 21:
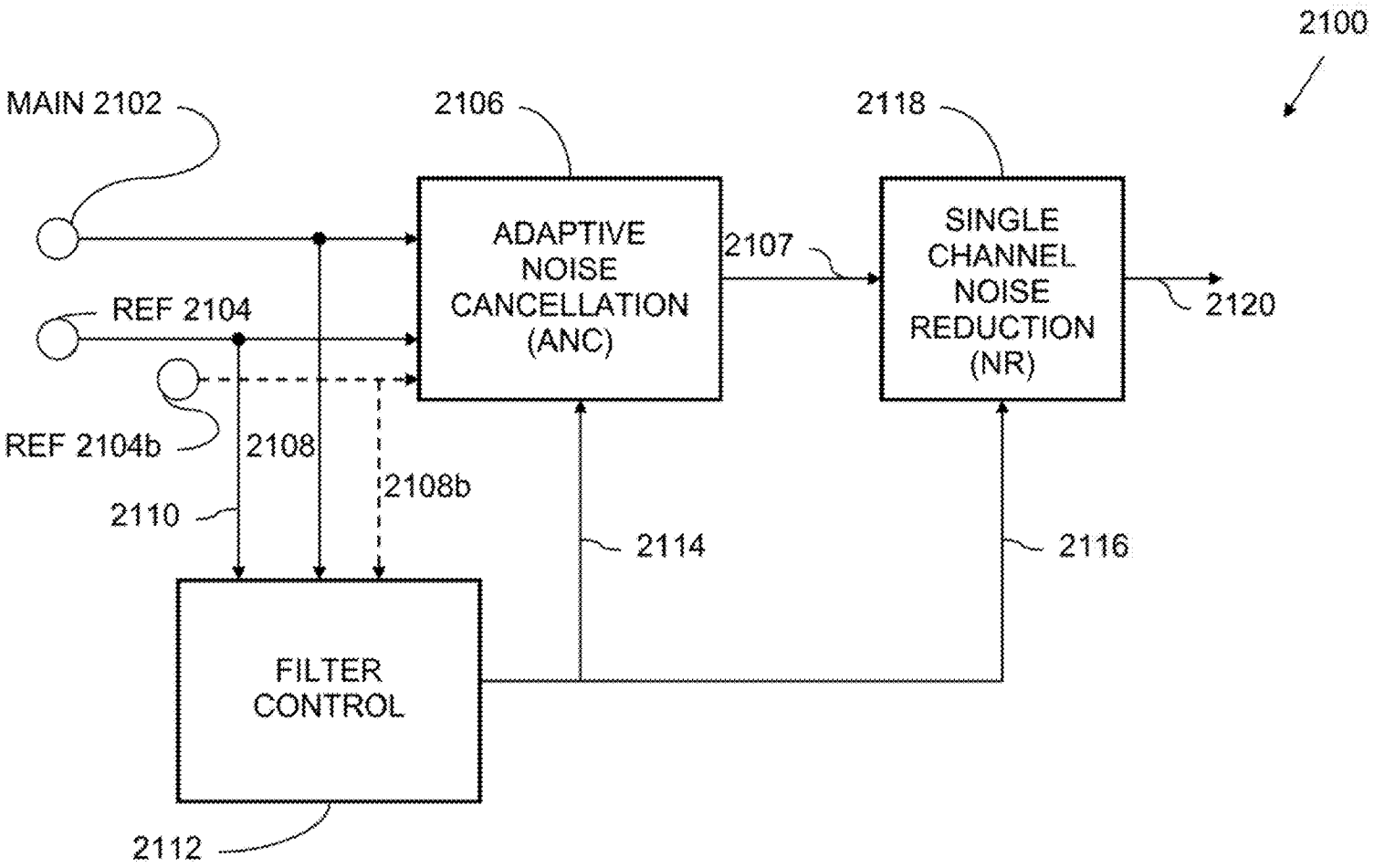
FIG. 21 illustrates system architecture, according to embodiments of the invention.

FIG. 21 illustrates, generally at 2100, system architecture, according to embodiments of the invention. With reference to FIG. 21, two acoustic channels are input into an adaptive noise cancellation unit 2106. A first acoustic channel, referred to herein as main channel 2102, is referred to in this description of embodiments synonymously as a "primary" or a "main" channel. The main channel 2102 contains both desired audio and undesired audio. The acoustic signal input on the main channel 2102 arises from the presence of both desired audio and undesired audio on one or more acoustic elements as described more fully below in the figures that follow. Depending on the configuration of a microphone or microphones used for the main channel the microphone elements can output an analog signal. The analog signal is converted to a digital signal with an analog-to-digital converter (AD) converter (not shown). Additionally, amplification can be located proximate to the microphone element(s) or AD converter. A second acoustic channel, referred to herein as reference channel 2104 provides an acoustic signal which also arises from the presence of desired audio and undesired audio. Optionally, a second reference channel 2104*b* can be input into the adaptive noise cancellation unit 2106. Similar to the main channel and depending on the configuration of a microphone or microphones used for the reference channel, the microphone elements can output an analog signal. The analog signal is converted to a digital signal with an analog-to-digital converter (AD) converter (not shown). Additionally, amplification can be located proximate to the microphone element(s) or AD converter. In some embodiments the microphones are implemented as digital microphones.

In some embodiments, the main channel 2102 has an omni-directional response and the reference channel 2104 has an omni-directional response. In some embodiments, the acoustic beam patterns for the acoustic elements of the main channel 2102 and the reference channel 2104 are different. In other embodiments, the beam patterns for the main channel 2102 and the reference channel 2104 are the same; however, desired audio received on the main channel 2102 is different from desired audio received on the reference channel 2104. Therefore, a signal-to-noise ratio for the main channel 2102 and a signal-to-noise ratio for the reference channel 2104 are different. In general, the signal-to-noise ratio for the reference channel is less than the signal-to-noise-ratio of the main channel. In various embodiments, by way of non-limiting examples, a difference between a main channel signal-to-noise ratio and a reference channel signal-to-noise ratio is approximately 1 or 2 decibels (dB) or more. In other non-limiting examples, a difference between a main channel signal-to-noise ratio and a reference channel signal-to-noise ratio is 1 decibel (dB) or less. Thus, embodiments of the invention are suited for high noise environments, which can result in low signal-to-noise ratios with respect to desired audio as well as low noise environments, which can have higher signal-to-noise ratios. As used in this description of embodiments, signal-to-noise ratio means the ratio of desired audio to undesired audio in a channel. Furthermore, the term "main channel signal-to-noise ratio" is used interchangeably with the term "main signal-to-noise ratio." Similarly, the term "reference channel signal-to-noise ratio" is used interchangeably with the term "reference signal-to-noise ratio."

The main channel 2102, the reference channel 2104, and optionally a second reference channel 2104*b* provide inputs to an adaptive noise cancellation unit 2106. While a second reference channel is shown in the figures, in various embodiments, more than two reference channels are used. Adaptive noise cancellation unit 2106 filters undesired audio from the main channel 2102, thereby providing a first stage of filtering with multiple acoustic channels of input. In various embodiments, the adaptive noise cancellation unit 2106 utilizes an adaptive finite impulse response (FIR) filter. The environment in which embodiments of the invention are used can present a reverberant acoustic field. Thus, the adaptive noise cancellation unit 2106 includes a delay for the main channel sufficient to approximate the impulse response of the environment in which the system is used. A magnitude of the delay used will vary depending on the particular application that a system is designed for including whether or not reverberation must be considered in the design. In some embodiments, for microphone channels positioned very closely together (and where reverberation is not significant) a magnitude of the delay can be on the order of a fraction of a millisecond. Note that at the low end of a range of values, which could be used for a delay, an acoustic travel time between channels can represent a minimum delay value. Thus, in various embodiments, a delay value can range from approximately a fraction of a millisecond to approximately 500 milliseconds or more depending on the application. Further description of the adaptive noise cancellation unit 1106 and the components associated therewith are provided below in conjunction with the figures that follow.

An output 2107 of the adaptive noise cancellation unit 2106 is input into a single channel noise cancellation unit 2118. The single channel noise cancellation unit 2118 filters the output 2107 and provides a further reduction of undesired audio from the output 2107, thereby providing a second stage of filtering. The single channel noise cancellation unit 2118 filters mostly stationary contributions to undesired audio. The single channel noise cancellation unit 2118 includes a linear filter, such as for example a Wiener filter, a Minimum Mean Square Error (MMSE) filter implementation, a linear stationary noise filter, or other Bayesian filtering approaches which use prior information about the parameters to be estimated. Filters used in the single channel noise cancellation unit 2118 are described more fully below in conjunction with the figures that follow.

Acoustic signals from the main channel 2102 are input at 2108 into a filter control 2112. Similarly, acoustic signals from the reference channel 2104 are input at 2110 into the filter control 2112. An optional second reference channel is input at 2108*b* into the filter control 2112. Filter control 2112 provides control signals 2114 for the adaptive noise cancellation unit 2106 and control signals 2116 for the single channel noise cancellation unit 2118. In various embodiments, the operation of filter control 2112 is described more completely below in conjunction with the figures that follow. An output 2120 of the single channel noise cancellation unit 2118 provides an acoustic signal which contains mostly desired audio and a reduced amount of undesired audio.

The system architecture shown in FIG. 21 can be used in a variety of different systems used to process acoustic signals according to various embodiments of the invention. Some examples of the different acoustic systems are, but are not limited to, a mobile phone, a handheld microphone, a boom microphone, a microphone headset, a hearing aid, a hands free microphone device, a wearable system embedded in a frame of an eyeglass, a near-to-eye (NTE) headset display or headset computing device, a head wearable device of general configuration such as but not limited to glasses, goggles, a visor, a head band, a helmet, etc. The environments that these acoustic systems are used in can have multiple sources of acoustic energy incident upon the acoustic elements that provide the acoustic signals for the main channel 2102 and the reference channel 2104. In various embodiments, the desired audio is usually the result of a user's own voice (see FIG. 2 above). In various embodiments, the undesired audio is usually the result of the combination of the undesired acoustic energy from the multiple sources that are incident upon the acoustic elements used for both the main channel and the reference channel. Thus, the undesired audio is statistically uncorrelated with the desired audio. In addition, there is a non-causal relationship between the undesired audio in the main channel and the undesired audio in the reference channel. In such a case, echo cancellation does not work because of the non-causal relationship and because there is no measurement of a pure noise signal (undesired audio) apart from the signal of interest (desired audio). In echo cancellation noise reduction systems, a speaker, which generated the acoustic signal, provides a measure of a pure noise signal. In the context of the embodiments of the system described herein, there is no speaker, or noise source from which a pure noise signal could be extracted.

Figure 22:
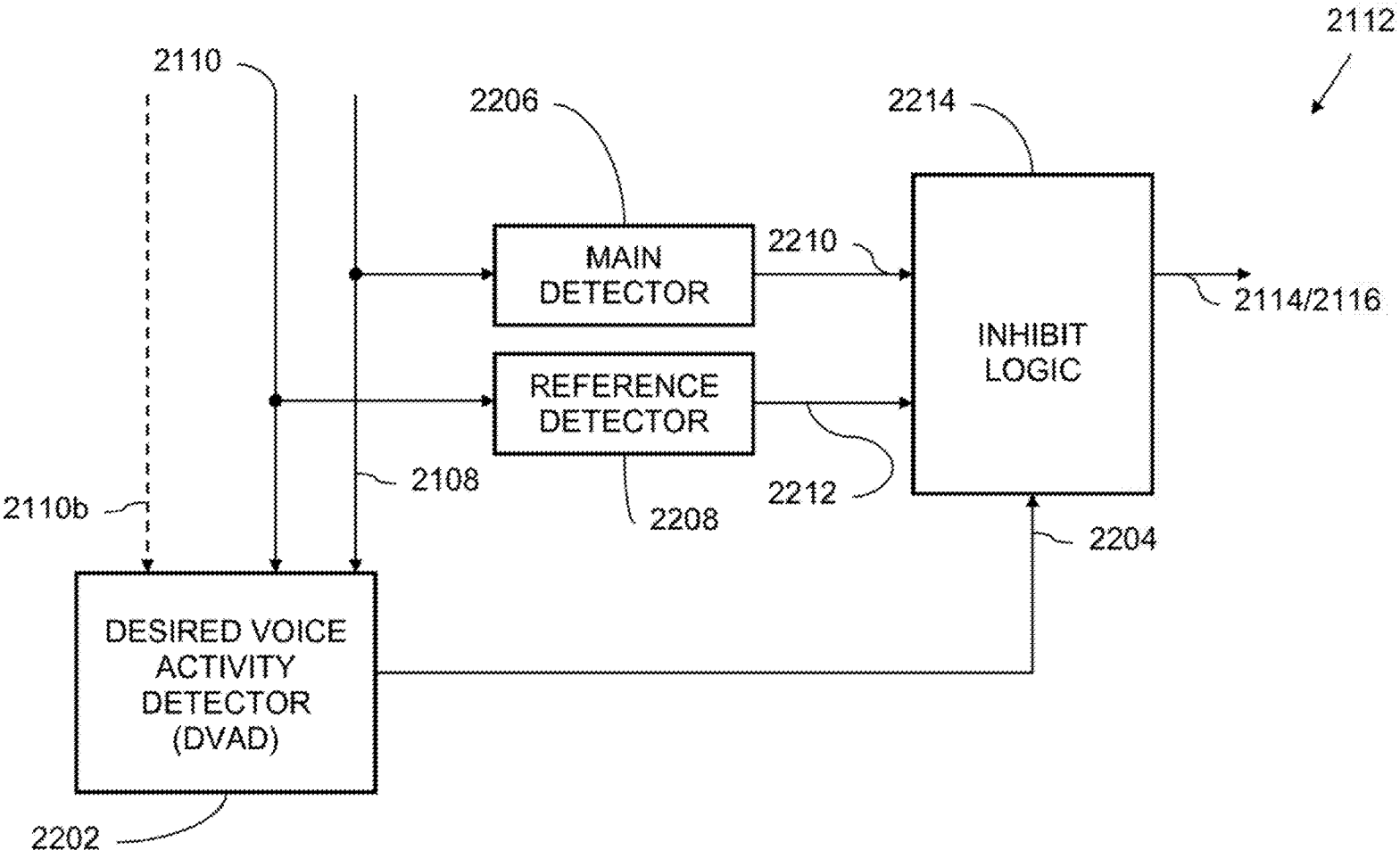
FIG. 22 illustrates filter control, according to embodiments of the invention.

FIG. 22 illustrates, generally at 2112, filter control, according to embodiments of the invention. With reference to FIG. 22, acoustic signals from the main channel 2102 are input at 2108 into a desired voice activity detection unit 2202. Acoustic signals at 2108 are monitored by main channel activity detector 2206 to create a flag that is associated with activity on the main channel 2102 (FIG. 21). Optionally, acoustic signals at 2110*b* are monitored by a second reference channel activity detector (not shown) to create a flag that is associated with activity on the second reference channel. Optionally, an output of the second reference channel activity detector is coupled to the inhibit control logic 2214. Acoustic signals at 2110 are monitored by reference channel activity detector 2208 to create a flag that is associated with activity on the reference channel 2104 (FIG. 21). The desired voice activity detection unit 2202 utilizes acoustic signal inputs from 2110, 2108, and optionally 2110*b* to produce a desired voice activity signal 2204. The operation of the desired voice activity detection unit 2202 is described more completely below in the figures that follow.

In various embodiments, inhibit logic unit 2214 receives as inputs, information regarding main channel activity at 2210, reference channel activity at 2212, and information pertaining to whether desired audio is present at 2204. In various embodiments, the inhibit logic 2214 outputs filter control signal 2114/2116 which is sent to the adaptive noise cancellation unit 2106 and the single channel noise cancellation unit 2118 of FIG. 21 for example. The implementation and operation of the main channel activity detector 2206, the reference channel activity detector 2208 and the inhibit logic 2214 are described more fully in United States Patent U.S. Pat. No. 7,386,135 titled "Cardioid Beam With A Desired Null Based Acoustic Devices, Systems and Methods," which is hereby incorporated by reference.

In operation, in various embodiments, the system of FIG. 21 and the filter control of FIG. 22 provide for filtering and removal of undesired audio from the main channel 2102 as successive filtering stages are applied by adaptive noise cancellation unit 2106 and single channel nose cancellation unit 2118. In one or more embodiments, throughout the system, application of the signal processing is applied linearly. In linear signal processing an output is linearly related to an input. Thus, changing a value of the input, results in a proportional change of the output. Linear application of signal processing processes to the signals preserves the quality and fidelity of the desired audio, thereby substantially eliminating or minimizing any non-linear distortion of the desired audio. Preservation of the signal quality of the desired audio is useful to a user in that accurate reproduction of speech helps to facilitate accurate communication of information.

In addition, algorithms used to process speech, such as Speech Recognition (SR) algorithms or Automatic Speech Recognition (ASR) algorithms benefit from accurate presentation of acoustic signals which are substantially free of non-linear distortion. Thus, the distortions which can arise from the application of signal processing processes which are non-linear are eliminated by embodiments of the invention. The linear noise cancellation algorithms, taught by embodiments of the invention, produce changes to the desired audio which are transparent to the operation of SR and ASR algorithms employed by speech recognition engines. As such, the error rates of speech recognition engines are greatly reduced through application of embodiments of the invention.

Figure 23:
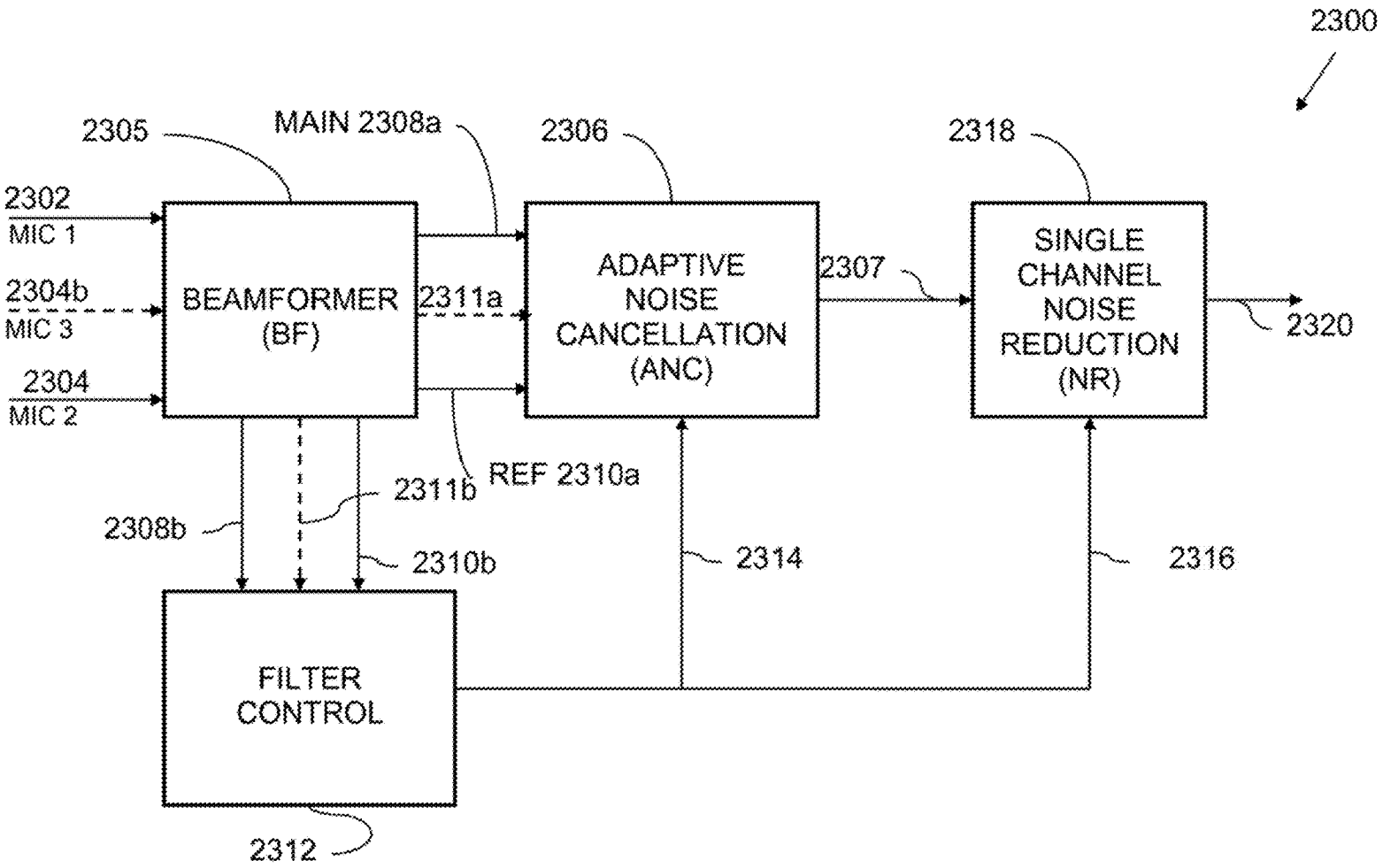
FIG. 23 illustrates another diagram of system architecture, according to embodiments of the invention.

FIG. 23 illustrates, generally at 2300, another diagram of system architecture, according to embodiments of the invention. With reference to FIG. 23, in the system architecture presented therein, a first channel provides acoustic signals from a first microphone at 2302 (nominally labeled in the figure as MIC 1). A second channel provides acoustic signals from a second microphone at 2304 (nominally labeled in the figure as MIC 2). In various embodiments, one or more microphones can be used to create the signal from the first microphone 2302. In various embodiments, one or more microphones can be used to create the signal from the second microphone 2304. In some embodiments, one or more acoustic elements can be used to create a signal that contributes to the signal from the first microphone 2302 and to the signal from the second microphone 2304 (see FIG. 25C described below). Thus, an acoustic element can be shared by 2302 and 2304. In various embodiments, arrangements of acoustic elements which provide the signals at 2302, 2304, the main channel, and the reference channel are described below in conjunction with the figures that follow.

A beamformer 2305 receives as inputs, the signal from the first microphone 2302 and the signal from the second microphone 2304 and optionally a signal from a third microphone 2304*b* (nominally labeled in the figure as MIC 3). The beamformer 2305 uses signals 2302, 2304 and optionally 2304*b* to create a main channel 2308*a* which contains both desired audio and undesired audio. The beamformer 2305 also uses signals 2302, 2304, and optionally 2304*b* to create one or more reference channels 2310*a* and optionally 2311*a*. A reference channel contains both desired audio and undesired audio. A signal-to-noise ratio of the main channel, referred to as "main channel signal-to-noise ratio" is greater than a signal-to-noise ratio of the reference channel, referred to herein as "reference channel signal-to-noise ratio." The beamformer 2305 and/or the arrangement of acoustic elements used for MIC 1 and MIC 2 provide for a main channel signal-to-noise ratio which is greater than the reference channel signal-to-noise ratio.

The beamformer 2305 is coupled to an adaptive noise cancellation unit 2306 and a filter control unit 2312. A main channel signal is output from the beamformer 2305 at 2308*a* and is input into an adaptive noise cancellation unit 2306. Similarly, a reference channel signal is output from the beamformer 2305 at 2310*a* and is input into the adaptive noise cancellation unit 2306. The main channel signal is also output from the beamformer 2305 and is input into a filter control 2312 at 2308*b*. Similarly, the reference channel signal is output from the beamformer 2305 and is input into the filter control 2312 at 2310*b*. Optionally, a second reference channel signal is output at 2311*a* and is input into the adaptive noise cancellation unit 2306 and the optional second reference channel signal is output at 2311*b* and is input into the filter control 2012.

The filter control 2312 uses inputs 2308*b*, 2310*b*, and optionally 2311*b* to produce channel activity flags and desired voice activity detection to provide filter control signal 2314 to the adaptive noise cancellation unit 2306 and filter control signal 2316 to a single channel noise reduction unit 2318.

The adaptive noise cancellation unit 2306 provides multi-channel filtering and filters a first amount of undesired audio from the main channel 2308*a* during a first stage of filtering to output a filtered main channel at 2307. The single channel noise reduction unit 2318 receives as an input the filtered main channel 2307 and provides a second stage of filtering, thereby further reducing undesired audio from 2307. The single channel noise reduction unit 2318 outputs mostly desired audio at 2320.

In various embodiments, different types of microphones can be used to provide the acoustic signals needed for the embodiments of the invention presented herein. Any transducer that converts a sound wave to an electrical signal is suitable for use with embodiments of the invention taught herein. Some non-limiting examples of microphones are, but are not limited to, a dynamic microphone, a condenser microphone, an Electret Condenser Microphone, (ECM), and a microelectromechanical systems (MEMS) microphone. In other embodiments a condenser microphone (CM) is used. In yet other embodiments micro-machined microphones are used. Microphones based on a piezoelectric film are used with other embodiments. Piezoelectric elements are made out of ceramic materials, plastic material, or film. In yet other embodiments micromachined arrays of microphones are used. In yet other embodiments, silicon or polysilicon micromachined microphones are used. In some embodiments, bi-directional pressure gradient microphones are used to provide multiple acoustic channels. Various microphones or microphone arrays including the systems described herein can be mounted on or within structures such as eyeglasses or headsets.

Figure 24A:
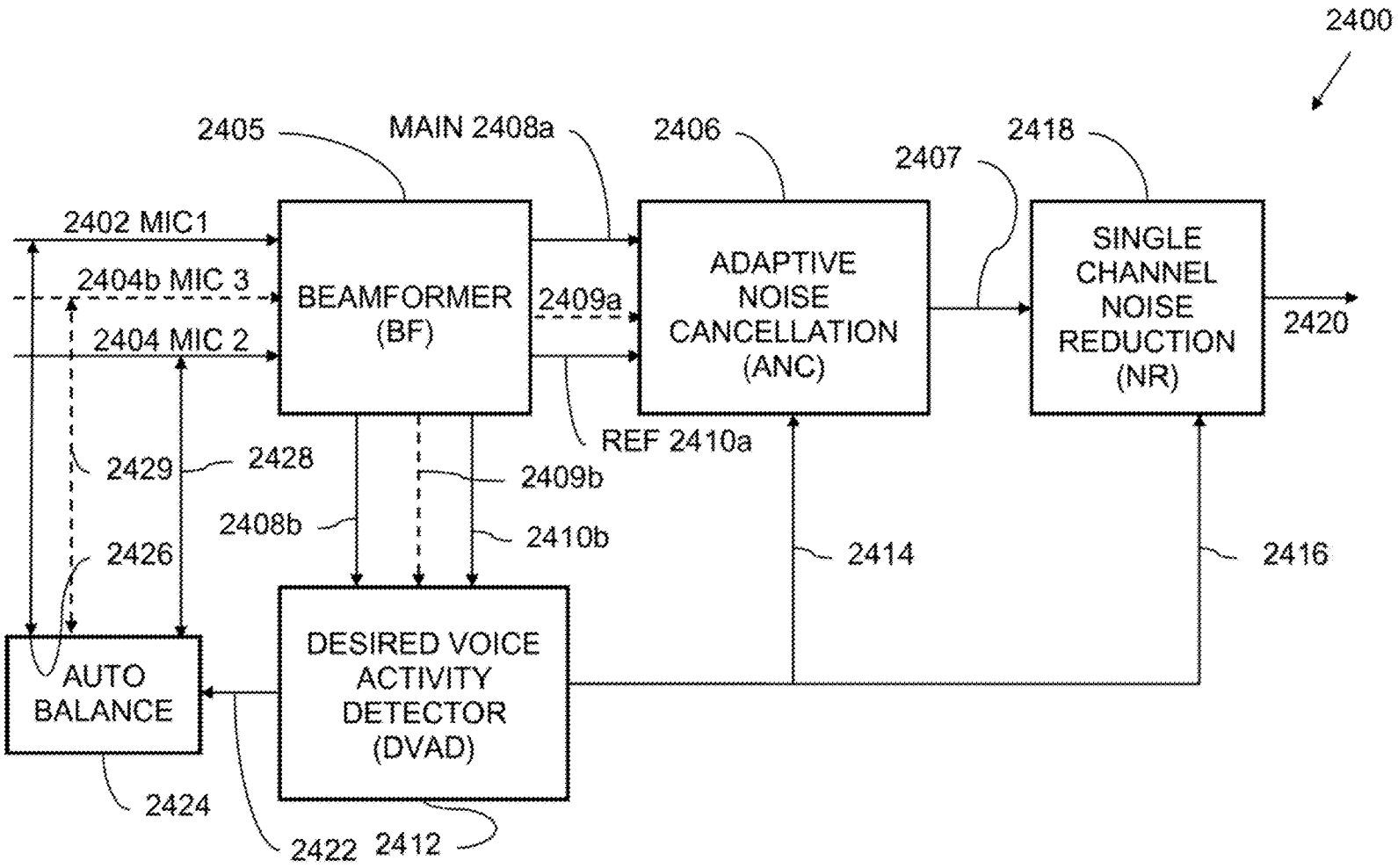
FIG. 24A illustrates another diagram of system architecture incorporating auto-balancing, according to embodiments of the invention.

FIG. 24A illustrates, generally at 2400, another diagram of system architecture incorporating auto-balancing, according to embodiments of the invention. With reference to FIG. 24A, in the system architecture presented therein, a first channel provides acoustic signals from a first microphone at 2402 (nominally labeled in the figure as MIC 1). A second channel provides acoustic signals from a second microphone at 2404 (nominally labeled in the figure as MIC 2). In various embodiments, one or more microphones can be used to create the signal from the first microphone 2402. In various embodiments, one or more microphones can be used to create the signal from the second microphone 2404. In some embodiments, as described above in conjunction with FIG. 23, one or more acoustic elements can be used to create a signal that becomes part of the signal from the first microphone 2402 and the signal from the second microphone 2404. In various embodiments, arrangements of acoustic elements which provide the signals 2402, 2404, the main channel, and the reference channel are described below in conjunction with the figures that follow.

A beamformer 2405 receives as inputs, the signal from the first microphone 2402 and the signal from the second microphone 2404. The beamformer 2405 uses signals 2402 and 2404 to create a main channel which contains both desired audio and undesired audio. The beamformer 2405 also uses signals 2402 and 2404 to create a reference channel. Optionally, a third channel provides acoustic signals from a third microphone at 2404*b* (nominally labeled in the figure as MIC 3), which are input into the beamformer 2405. In various embodiments, one or more microphones can be used to create the signal 2404*b* from the third microphone. The reference channel contains both desired audio and undesired audio. A signal-to-noise ratio of the main channel, referred to as "main channel signal-to-noise ratio" is greater than a signal-to-noise ratio of the reference channel, referred to herein as "reference channel signal-to-noise ratio." The beamformer 2405 and/or the arrangement of acoustic elements used for MIC 1, MIC 2, and optionally MIC 3 provide for a main channel signal-to-noise ratio that is greater than the reference channel signal-to-noise ratio. In some embodiments bi-directional pressure-gradient microphone elements provide the signals 2402, 2404, and optionally 2404*b*.

The beamformer 2405 is coupled to an adaptive noise cancellation unit 2406 and a desired voice activity detector 2412 (filter control). A main channel signal is output from the beamformer 2405 at 2408*a* and is input into an adaptive noise cancellation unit 2406. Similarly, a reference channel signal is output from the beamformer 2405 at 2410*a* and is input into the adaptive noise cancellation unit 2406. The main channel signal is also output from the beamformer 2405 and is input into the desired voice activity detector 2412 at 2408*b*. Similarly, the reference channel signal is output from the beamformer 2405 and is input into the desired voice activity detector 2412 at 2410*b*. Optionally, a second reference channel signal is output at 2409*a* from the beamformer 2405 and is input to the adaptive noise cancellation unit 2406, and the second reference channel signal is output at 2409*b* from the beamformer 2405 and is input to the desired vice activity detector 2412.

The desired voice activity detector 2412 uses input 2408*b*, 2410*b*, and optionally 2409*b* to produce filter control signal 2414 for the adaptive noise cancellation unit 2408 and filter control signal 2416 for a single channel noise reduction unit 2418. The adaptive noise cancellation unit 2406 provides multi-channel filtering and filters a first amount of undesired audio from the main channel 2408*a* during a first stage of filtering to output a filtered main channel at 2407. The single channel noise reduction unit 2418 receives as an input the filtered main channel 2407 and provides a second stage of filtering, thereby further reducing undesired audio from 2407. The single channel noise reduction unit 2418 outputs mostly desired audio at 2420

The desired voice activity detector 2412 provides a control signal 2422 for an auto-balancing unit 2424. The auto-balancing unit 2424 is coupled at 2426 to the signal path from the first microphone 2402. The auto-balancing unit 2424 is also coupled at 2428 to the signal path from the second microphone 2404. Optionally, the auto-balancing unit 2424 is also coupled at 2429 to the signal path from the third microphone 2404*b*. The auto-balancing unit 2424 balances the microphone response to far field signals over the operating life of the system. Keeping the microphone channels balanced increases the performance of the system and maintains a high level of performance by preventing drift of microphone sensitivities. The auto-balancing unit is described more fully below in conjunction with the figures that follow.

Figure 24B:
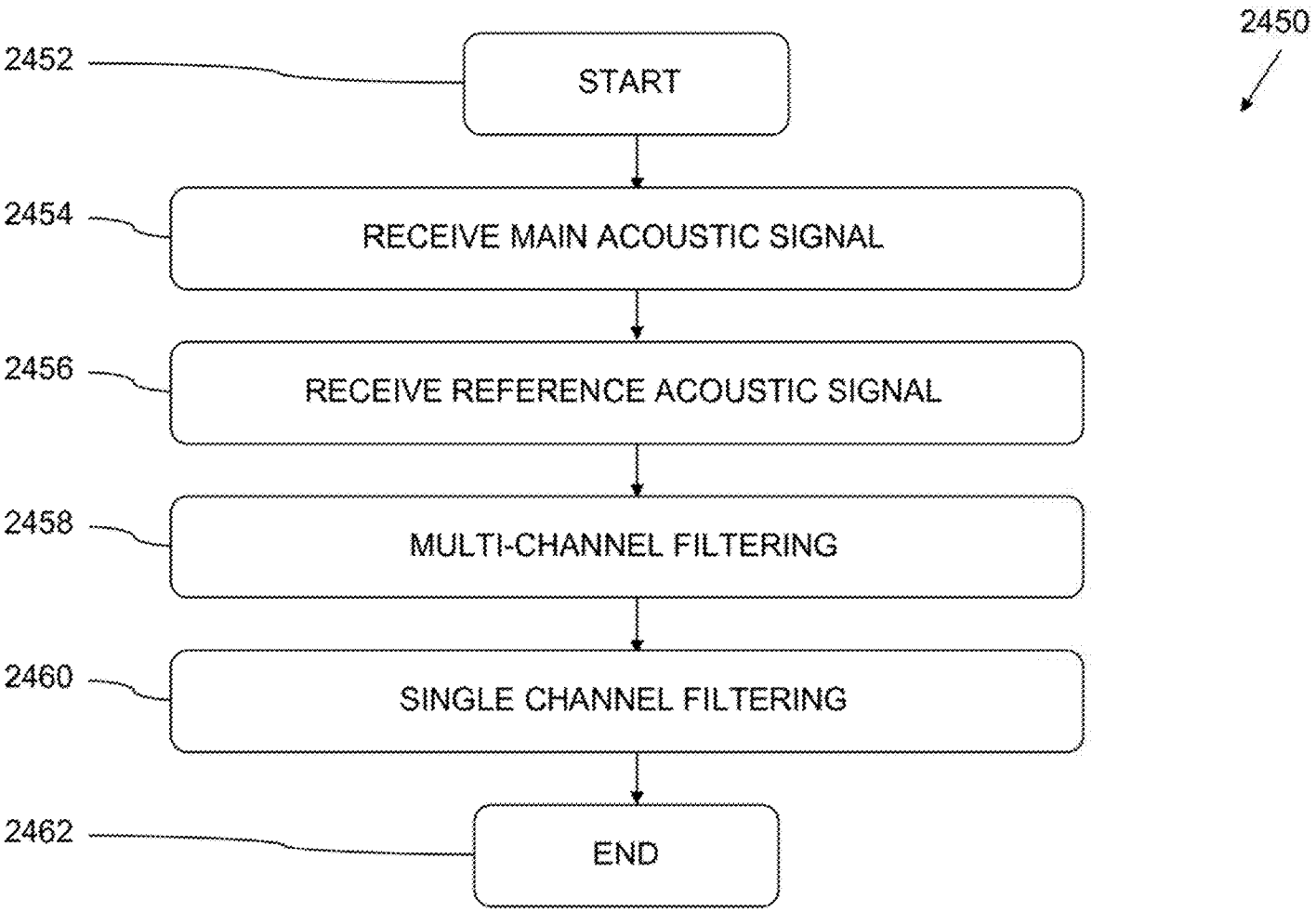
FIG. 24B illustrates processes for noise reduction, according to embodiments of the invention.

FIG. 24B illustrates, generally at 2450, processes for noise reduction, according to embodiments of the invention. With reference to FIG. 24B, a process begins at a block 2452. At a block 2454 a main acoustic signal is received by a system. The main acoustic signal can be for example, in various embodiments such a signal as is represented by 2102 (FIG. 21), 2302/2308*a*/2308*b* (FIG. 23), or 2402/2408*a*/2408*b* (FIG. 24A). At a block 2456 a reference acoustic signal is received by the system. The reference acoustic signal can be for example, in various embodiments such a signal as is represented by 2104 and optionally 2104*b* (FIG. 21), 2304/2310*a*/2310*b* and optionally 2304*b*/2311*a*/2311*b* (FIG. 23), or 2404/2410*a*/2410*b* and optionally 2404*b*/2409*a*2409*b* (FIG. 24A). At a block 2458 adaptive filtering is performed with multiple channels of input, such as using for example the adaptive filter unit 2106 (FIG. 21), 2306 (FIG. 23), and 2406 (FIG. 24A) to provide a filtered acoustic signal for example as shown at 2107 (FIG. 21), 2307 (FIG. 23), and 2407 (FIG. 24A). At a block 2460 a single channel unit is used to filter the filtered acoustic signal which results from the process of the block 2458. The single channel unit can be for example, in various embodiments, such a unit as is represented by 2118 (FIG. 21), 2318 (FIG. 23), or 2418 (FIG. 24A). The process ends at a block 2462.

In various embodiments, the adaptive noise cancellation unit, such as 2106 (FIG. 21), 2306 (FIG. 23), and 2406 (FIG. 24A) is implemented in an integrated circuit device, which may include an integrated circuit package containing the integrated circuit. In some embodiments, the adaptive noise cancellation unit 2106 or 2306 or 2406 is implemented in a single integrated circuit die. In other embodiments, the adaptive noise cancellation unit 2106 or 2306 or 2406 is implemented in more than one integrated circuit die of an integrated circuit device which may include a multi-chip package containing the integrated circuit.

In various embodiments, the single channel noise cancellation unit, such as 2018 (FIG. 21), 2318 (FIG. 23), and 2418 (FIG. 24A) is implemented in an integrated circuit device, which may include an integrated circuit package containing the integrated circuit. In some embodiments, the single channel noise cancellation unit 2118 or 2318 or 2418 is implemented in a single integrated circuit die. In other embodiments, the single channel noise cancellation unit 2118 or 2318 or 2418 is implemented in more than one integrated circuit die of an integrated circuit device which may include a multi-chip package containing the integrated circuit.

In various embodiments, the filter control, such as 2112 (FIGS. 21 & 22) or 2312 (FIG. 23) is implemented in an integrated circuit device, which may include an integrated circuit package containing the integrated circuit. In some embodiments, the filter control 2112 or 2312 is implemented in a single integrated circuit die. In other embodiments, the filter control 2112 or 2312 is implemented in more than one integrated circuit die of an integrated circuit device which may include a multi-chip package containing the integrated circuit.

In various embodiments, the beamformer, such as 2305 (FIG. 23) or 2405 (FIG. 24A) is implemented in an integrated circuit device, which may include an integrated circuit package containing the integrated circuit. In some embodiments, the beamformer 2305 or 2405 is implemented in a single integrated circuit die. In other embodiments, the beamformer 2305 or 2405 is implemented in more than one integrated circuit die of an integrated circuit device which may include a multi-chip package containing the integrated circuit.

Figure 25A:
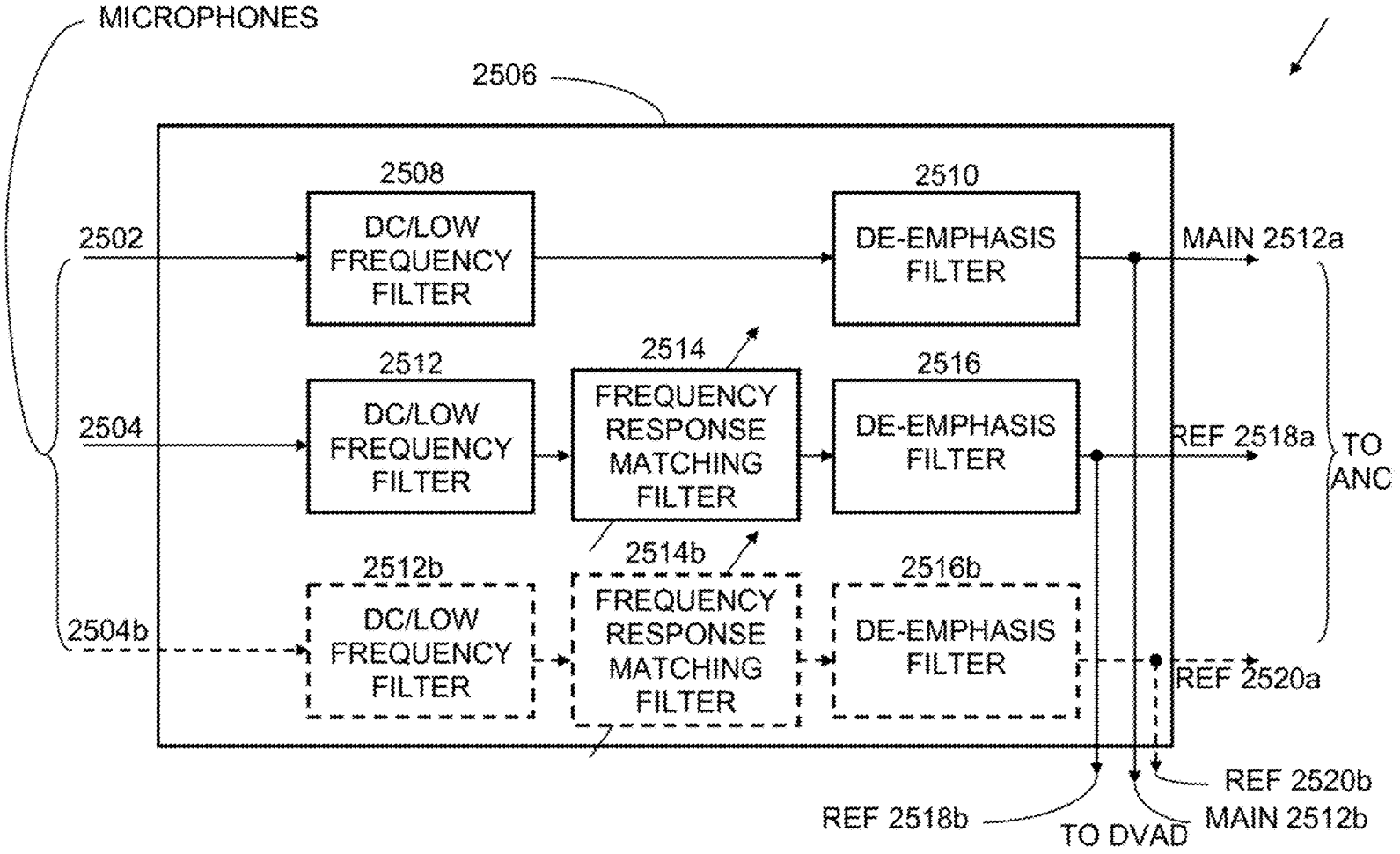
FIG. 25A illustrates beamforming according to embodiments of the invention.

FIG. 25A illustrates, generally at 2500, beamforming according to embodiments of the invention. With reference to FIG. 25A, a beamforming block 2506 is applied to two microphone inputs 2502 and 2504. In one or more embodiments, the microphone input 2502 can originate from a first directional microphone and the microphone input 2504 can originate from a second directional microphone or microphone signals 2502 and 2504 can originate from omni-directional microphones. In yet other embodiments, microphone signals 2502 and 2504 are provided by the outputs of a bi-directional pressure gradient microphone. Various directional microphones can be used, such as but not limited to, microphones having a cardioid beam pattern, a dipole beam pattern, an omni-directional beam pattern, or a user defined beam pattern. In some embodiments, one or more acoustic elements are configured to provide the microphone input 2502 and 2504.

In various embodiments, beamforming block 2506 includes a filter 2508. Depending on the type of microphone used and the specific application, the filter 2508 can provide a direct current (DC) blocking filter which filters the DC and very low frequency components of Microphone input 2502. Following the filter 2508, in some embodiments additional filtering is provided by a filter 2510. Some microphones have non-flat responses as a function of frequency. In such a case, it can be desirable to flatten the frequency response of the microphone with a de-emphasis filter. The filter 2510 can provide de-emphasis, thereby flattening a microphone's frequency response. Following de-emphasis filtering by the filter 2510, a main microphone channel is supplied to the adaptive noise cancellation unit at 2512*a* and the desired voice activity detector at 2512*b*.

A microphone input 2504 is input into the beamforming block 2506 and in some embodiments is filtered by a filter 2512. Depending on the type of microphone used and the specific application, the filter 2512 can provide a direct current (DC) blocking filter which filters the DC and very low frequency components of Microphone input 2504. A filter 2514 filters the acoustic signal which is output from the filter 2512. The filter 2514 adjusts the gain, phase, and can also shape the frequency response of the acoustic signal. Following the filter 2514, in some embodiments additional filtering is provided by a filter 2516. Some microphones have non-flat responses as a function of frequency. In such a case, it can be desirable to flatten the frequency response of the microphone with a de-emphasis filter. The filter 2516 can provide de-emphasis, thereby flattening a microphone's frequency response. Following de-emphasis filtering by the filter 2516, a reference microphone channel is supplied to the adaptive noise cancellation unit at 2518*a* and to the desired voice activity detector at 2518*b*.

Optionally, a third microphone channel is input at 2504*b* into the beamforming block 2506. Similar to the signal path described above for the channel 2504, the third microphone channel is filtered by a filter 2512*b*. Depending on the type of microphone used and the specific application, the filter 2512*b* can provide a direct current (DC) blocking filter which filters the DC and very low frequency components of Microphone input 2504*b*. A filter 2514*b* filters the acoustic signal which is output from the filter 2512*b*. The filter 2514*b* adjusts the gain, phase, and can also shape the frequency response of the acoustic signal. Following the filter 2514*b*, in some embodiments additional filtering is provided by a filter 2516*b*. Some microphones have non-flat responses as a function of frequency. In such a case, it can be desirable to flatten the frequency response of the microphone with a de-emphasis filter. The filter 2516*b* can provide de-emphasis, thereby flattening a microphone's frequency response. Following de-emphasis filtering by the filter 2516*b*, a second reference microphone channel is supplied to the adaptive noise cancellation unit at 2520*a* and to the desired voice activity detector at 2520*b*

Figure 25B:
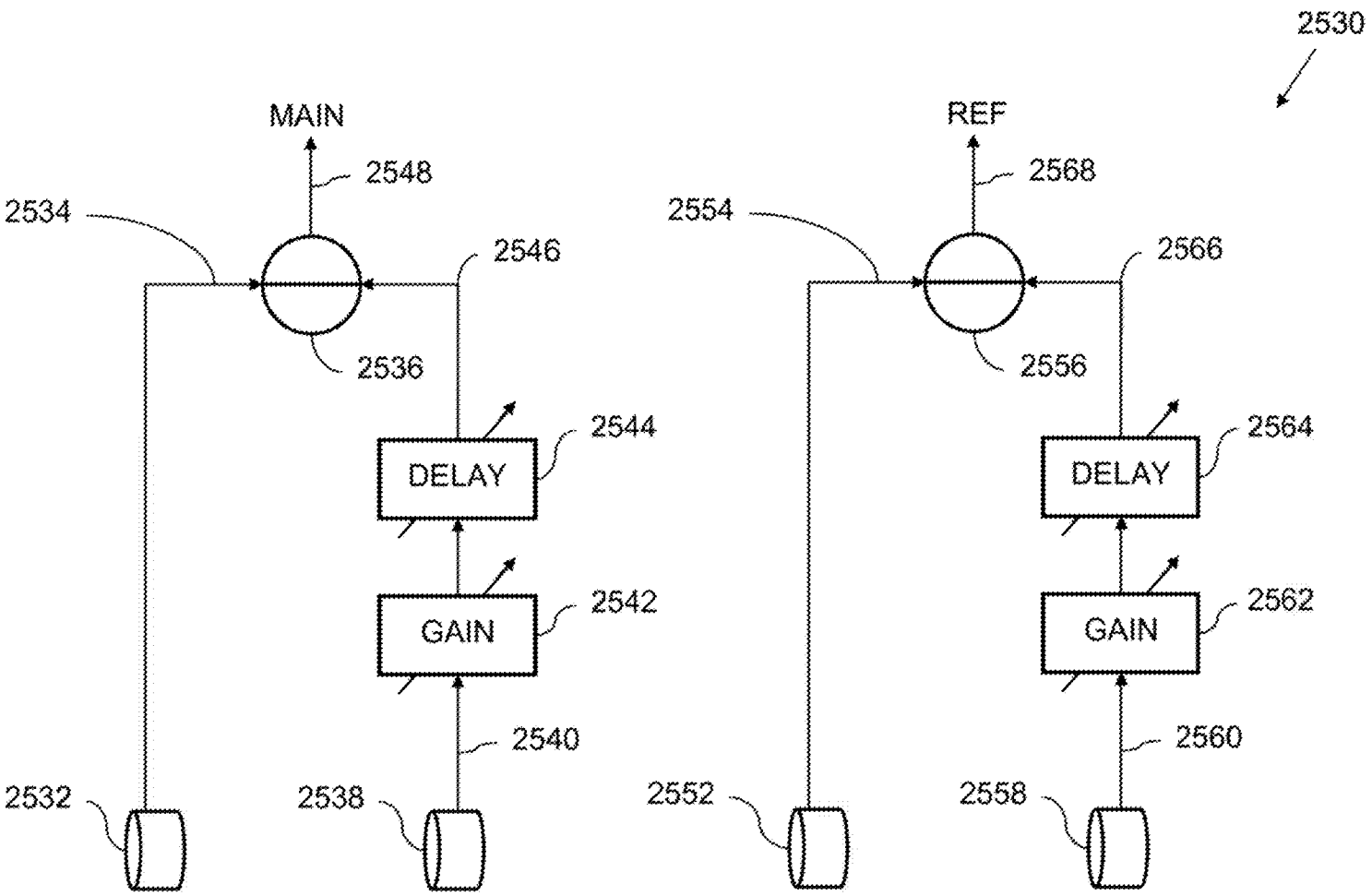
FIG. 25B presents another illustration of beamforming according to embodiments of the invention.

FIG. 25B presents, generally at 2530, another illustration of beamforming according to embodiments of the invention. With reference to FIG. 25B, a beam pattern is created for a main channel using a first microphone 2532 and a second microphone 2538. A signal 2534 output from the first microphone 2532 is input to an adder 2536. A signal 2540 output from the second microphone 2538 has its amplitude adjusted at a block 2542 and its phase adjusted by applying a delay at a block 2544 resulting in a signal 2546 which is input to the adder 2536. The adder 2536 subtracts one signal from the other resulting in output signal 2548. Output signal 2548 has a beam pattern which can take on a variety of forms depending on the initial beam patterns of microphone 2532 and 2538 and the gain applied at 2542 and the delay applied at 2544. By way of non-limiting example, beam patterns can include cardioid, dipole, etc.

A beam pattern is created for a reference channel using a third microphone 2552 and a fourth microphone 2558. A signal 2554 output from the third microphone 2552 is input to an adder 2556. A signal 2560 output from the fourth microphone 2558 has its amplitude adjusted at a block 2562 and its phase adjusted by applying a delay at a block 2564 resulting in a signal 2566 which is input to the adder 2556. The adder 2556 subtracts one signal from the other resulting in output signal 2568. Output signal 2568 has a beam pattern which can take on a variety of forms depending on the initial beam patterns of microphone 2552 and 2558 and the gain applied at 2562 and the delay applied at 2564. By way of non-limiting example, beam patterns can include cardioid, dipole, etc.

Figure 25C:
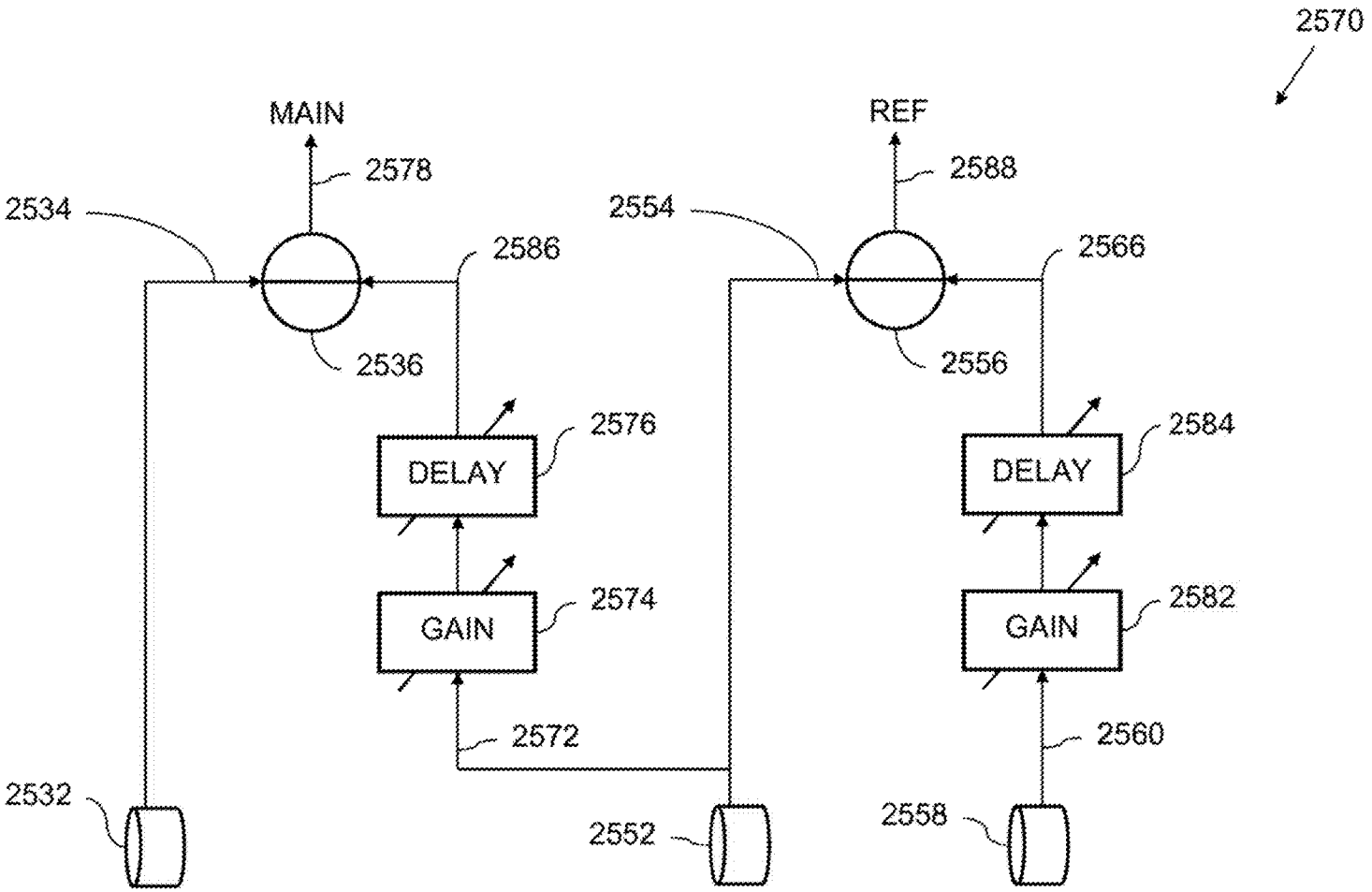
FIG. 25C illustrates beamforming with shared acoustic elements according to embodiments of the invention.

FIG. 25C illustrates, generally at 2570, beamforming with shared acoustic elements according to embodiments of the invention. With reference to FIG. 25C, a microphone 2552 is shared between the main acoustic channel and the reference acoustic channel. The output from microphone 2552 is split and travels at 2572 to gain 2574 and to delay 2576 and is then input at 2586 into the adder 2536. Appropriate gain at 2574 and delay at 2576 can be selected to achieve equivalently an output 2578 from the adder 2536 which is equivalent to the output 2548 from adder 2536 (FIG. 25B). Similarly gain 2582 and delay 2584 can be adjusted to provide an output signal 2588 which is equivalent to 2568 (FIG. 25B). By way of non-limiting example, beam patterns can include cardioid, dipole, etc.

Figure 26:
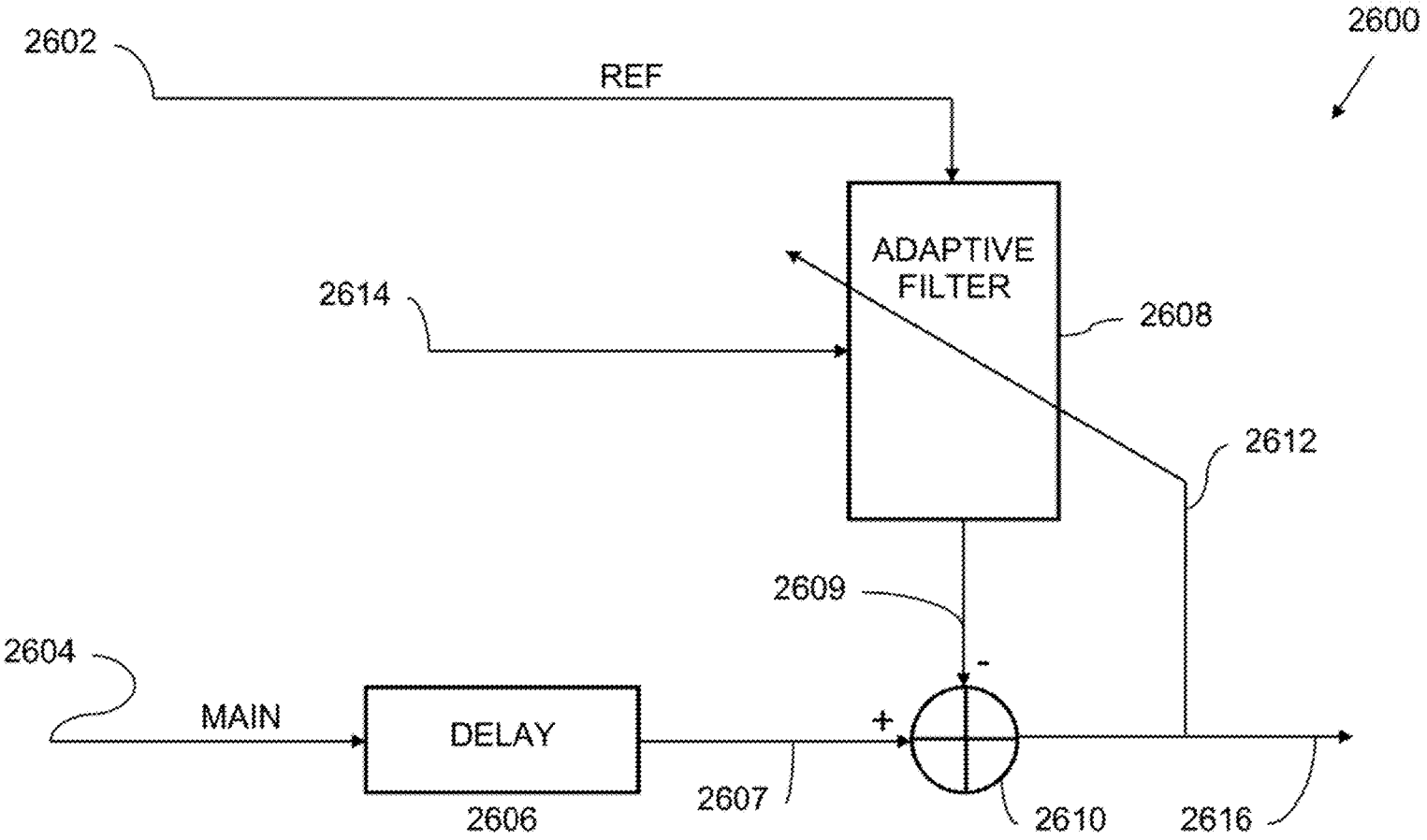
FIG. 26 illustrates multi-channel adaptive filtering according to embodiments of the invention.

FIG. 26 illustrates, generally at 2600, multi-channel adaptive filtering according to embodiments of the invention. With reference to FIG. 26, embodiments of an adaptive filter unit are illustrated with a main channel 2604 (containing a microphone signal) input into a delay element 2606. A reference channel 2602 (containing a microphone signal) is input into an adaptive filter 2608. In various embodiments, the adaptive filter 2608 can be an adaptive FIR filter designed to implement normalized least-mean-square-adaptation (NLMS) or another algorithm. Embodiments of the invention are not limited to NLMS adaptation. The adaptive FIR filter filters an estimate of desired audio from the reference signal 2602. In one or more embodiments, an output 2609 of the adaptive filter 2608 is input into an adder 2610. The delayed main channel signal 2607 is input into the adder 2610 and the output 2609 is subtracted from the delayed main channel signal 2607. The output of the adder 2616 provides a signal containing desired audio with a reduced amount of undesired audio.

Many environments that acoustic systems employing embodiments of the invention are used in present reverberant conditions. Reverberation results in a form of noise and contributes to the undesired audio which is the object of the filtering and signal extraction described herein. In various embodiments, the two channel adaptive FIR filtering represented at 2600 models the reverberation between the two channels and the environment they are used in. Thus, undesired audio propagates along the direct path and the reverberant path requiring the adaptive FIR filter to model the impulse response of the environment. Various approximations of the impulse response of the environment can be made depending on the degree of precision needed. In one non-limiting example, the amount of delay is approximately equal to the impulse response time of the environment. In another non-limiting example, the amount of delay is greater than an impulse response of the environment. In one embodiment, an amount of delay is approximately equal to a multiple n of the impulse response time of the environment, where n can equal 2 or 3 or more for example. Alternatively, an amount of delay is not an integer number of impulse response times, such as for example, 0.5, 1.4, 2.75, etc. For example, in one embodiment, the filter length is approximately equal to twice the delay chosen for 2606. Therefore, if an adaptive filter having 200 taps is used, the length of the delay 2606 would be approximately equal to a time delay of 100 taps. A time delay equivalent to the propagation time through 100 taps is provided merely for illustration and does not imply any form of limitation to embodiments of the invention.

Embodiments of the invention can be used in a variety of environments which have a range of impulse response times. Some examples of impulse response times are given as non-limiting examples for the purpose of illustration only and do not limit embodiments of the invention. For example, an office environment typically has an impulse response time of approximately 100 milliseconds to 200 milliseconds. The interior of a vehicle cabin can provide impulse response times ranging from 30 milliseconds to 60 milliseconds. In general, embodiments of the invention are used in environments whose impulse response times can range from several milliseconds to 500 milliseconds or more.

The adaptive filter unit 2600 is in communication at 2614 with inhibit logic such as inhibit logic 2214 and filter control signal 2114 (FIG. 22). Signals 2614 controlled by inhibit logic 2214 are used to control the filtering performed by the filter 2608 and adaptation of the filter coefficients. An output 2616 of the adaptive filter unit 2600 is input to a single channel noise cancellation unit such as those described above in the preceding figures, for example; 2118 (FIG. 21), 2318 (FIG. 23), and 2418 (FIG. 24A). A first level of undesired audio has been extracted from the main acoustic channel resulting in the output 2616. Under various operating conditions the level of the noise, i.e., undesired audio can be very large relative to the signal of interest, i.e., desired audio. Embodiments of the invention are operable in conditions where some difference in signal-to-noise ratio between the main and reference channels exists. In some embodiments, the differences in signal-to-noise ratio are on the order of 1 decibel (dB) or less. In other embodiments, the differences in signal-to-noise ratio are on the order of 1 decibel (dB) or more. The output 2616 is filtered additionally to reduce the amount of undesired audio contained therein in the processes that follow using a single channel noise reduction unit.

Inhibit logic, described in FIG. 22 above including signal 2614 (FIG. 26) provide for the substantial non-operation of filter 2608 and no adaptation of the filter coefficients when either the main or the reference channels are determined to be inactive. In such a condition, the signal present on the main channel 2604 is output at 2616.

If the main channel and the reference channels are active and desired audio is detected or a pause threshold has not been reached then adaptation is disabled, with filter coefficients frozen, and the signal on the reference channel 2602 is filtered by the filter 2608 subtracted from the main channel 2607 with adder 2610 and is output at 2616.

If the main channel and the reference channel are active and desired audio is not detected and the pause threshold (also called pause time) is exceeded then filter coefficients are adapted. A pause threshold is application dependent. For example, in one non-limiting example, in the case of Automatic Speech Recognition (ASR) the pause threshold can be approximately a fraction of a second.

Figure 27:
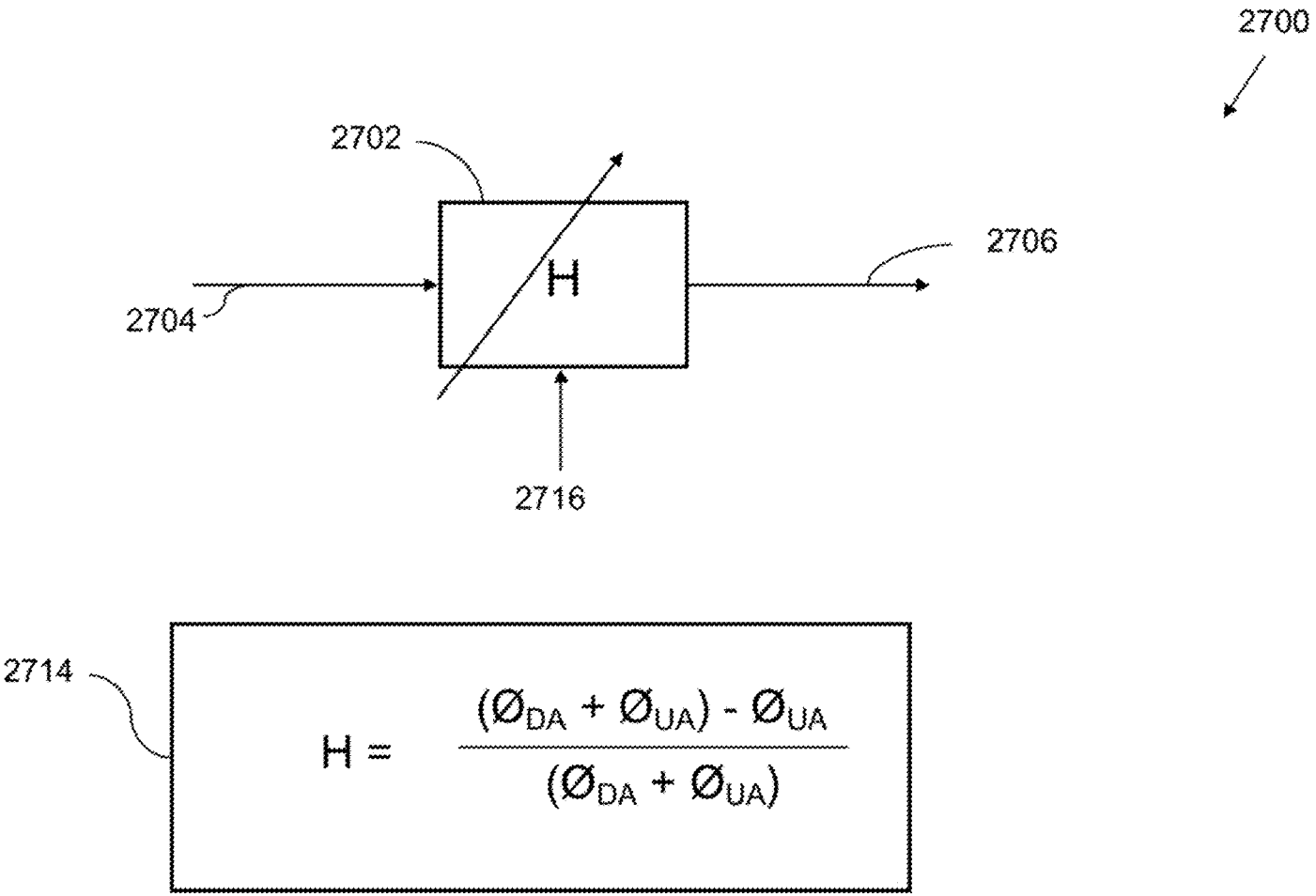
FIG. 27 illustrates single channel filtering according to embodiments of the invention.

FIG. 27 illustrates, generally at 2700, single channel filtering according to embodiments of the invention. With reference to FIG. 27, a single channel noise reduction unit utilizes a linear filter having a single channel input. Examples of filters suitable for use therein are a Wiener filter, a filter employing Minimum Mean Square Error (MMSE), etc. An output from an adaptive noise cancellation unit (such as one described above in the preceding figures) is input at 2704 into a filter 2702. The input signal 2704 contains desired audio and a noise component, i.e., undesired audio, represented in equation 2714 as the total power ($Ø_{DA}$+$Ø_{UA}$). The filter 2702 applies the equation shown at 2714 to the input signal 2704. An estimate for the total power ($Ø_{DA}$+$Ø_{UA}$) is one term in the numerator of equation 2714 and is obtained from the input to the filter 2704. An estimate for the noise $Ø_{UA}$, i.e., undesired audio, is obtained when desired audio is absent from signal 2704. The noise estimate $Ø_{UA}$ is the other term in the numerator, which is subtracted from the total power ($Ø_{DA}$+$Ø_{UA}$). The total power is the term in the denominator of equation 2714. The estimate of the noise $Ø_{UA}$ (obtained when desired audio is absent) is obtained from the input signal 2704 as informed by signal 2716 received from inhibit logic, such as inhibit logic 2214 (FIG. 22) which indicates when desired audio is present as well as when desired audio is not present. The noise estimate is updated when desired audio is not present on signal 2704. When desired audio is present, the noise estimate is frozen and the filtering proceeds with the noise estimate previously established during the last interval when desired audio was not present.

Figure 28A:
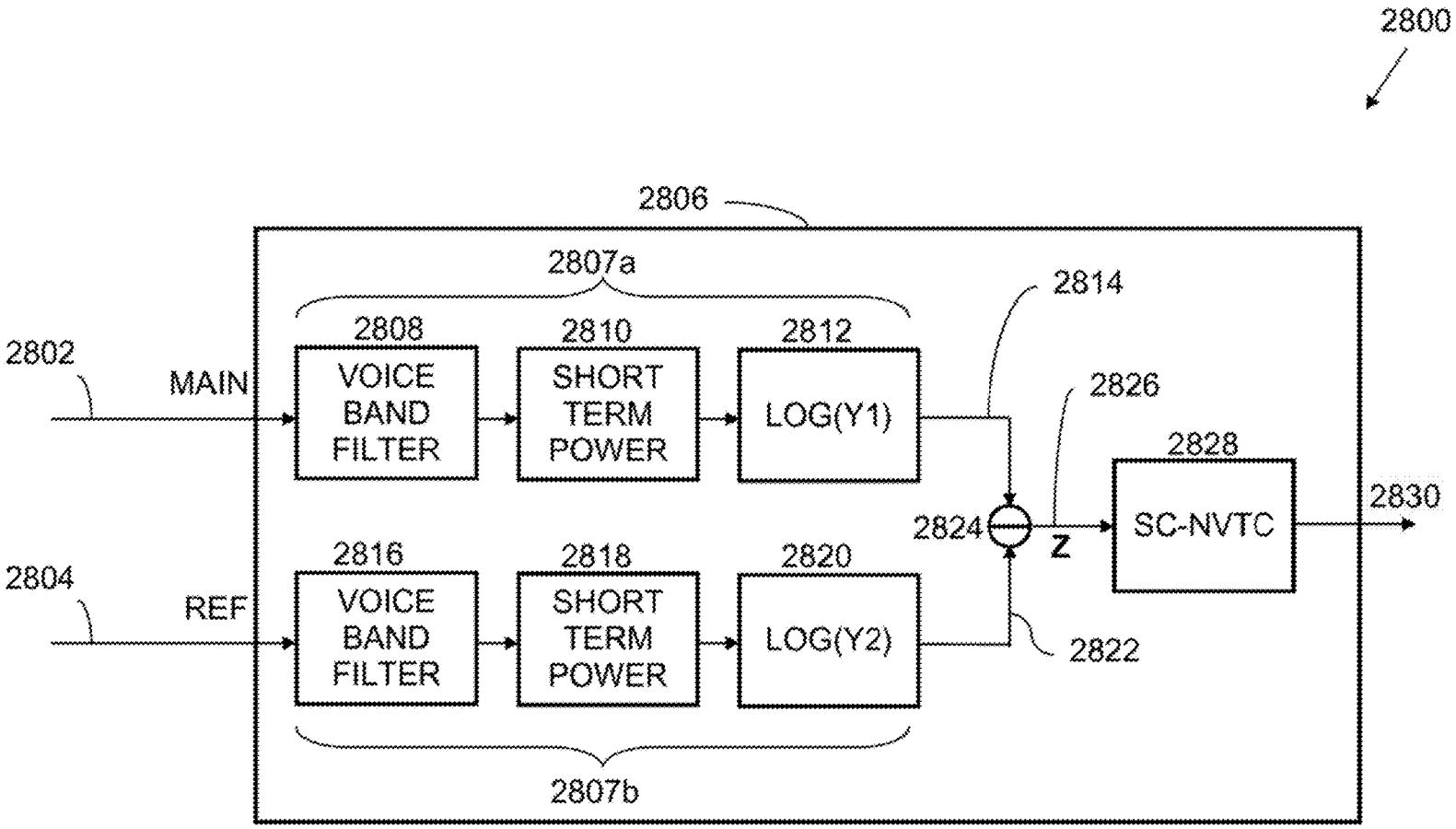
FIG. 28A illustrates desired voice activity detection according to embodiments of the invention.

FIG. 28A illustrates, generally at 2800, desired voice activity detection according to embodiments of the invention. With reference to FIG. 28A, a dual input desired voice detector is shown at 2806. Acoustic signals from a main channel are input at 2802, from for example, a beamformer or from a main acoustic channel as described above in conjunction with the previous figures, to a first signal path 2807*a* of the dual input desired voice detector 2806. The first signal path 2807*a* includes a voice band filter 2808. The voice band filter 2808 captures the majority of the desired voice energy in the main acoustic channel 2802. In various embodiments, the voice band filter 2808 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The first signal path 2807*a* includes a short-term power calculator 2810. Short-term power calculator 2810 is implemented in various embodiments as a root mean square (RMS) measurement, a power detector, an energy detector, etc. Short-term power calculator 2810 can be referred to synonymously as a short-time power calculator 2810. The short-term power detector 2810 calculates approximately the instantaneous power in the filtered signal. The output of the short-term power detector 2810 (Y1) is input into a signal compressor 2812. In various embodiments compressor 2812 converts the signal to the $Log_2$ domain, $Log_{10}$ domain, etc. In other embodiments, the compressor 2812 performs a user defined compression algorithm on the signal Y1.

Similar to the first signal path described above, acoustic signals from a reference acoustic channel are input at 2804, from for example, a beamformer or from a reference acoustic channel as described above in conjunction with the previous figures, to a second signal path 2807*b* of the dual input desired voice detector 2806. The second signal path 2807*b* includes a voice band filter 2816. The voice band filter 2816 captures the majority of the desired voice energy in the reference acoustic channel 2804. In various embodiments, the voice band filter 2816 is a band-pass filter characterized by a lower corner frequency an upper corner frequency and a roll-off from the upper corner frequency as described above for the first signal path and the voice-band filter 2808.

The second signal path 2807*b* includes a short-term power calculator 2818. Short-term power calculator 2818 is implemented in various embodiments as a root mean square (RMS) measurement, a power detector, an energy detector, etc. Short-term power calculator 2818 can be referred to synonymously as a short-time power calculator 2818. The short-term power detector 2818 calculates approximately the instantaneous power in the filtered signal. The output of the short-term power detector 2818 (Y2) is input into a signal compressor 2820. In various embodiments compressor 2820 converts the signal to the $Log_2$ domain, $Log_{10}$ domain, etc. In other embodiments, the compressor 2820 performs a user defined compression algorithm on the signal Y2.

The compressed signal from the second signal path 2822 is subtracted from the compressed signal from the first signal path 2814 at a subtractor 2824, which results in a normalized main signal at 2826 (Z). In other embodiments, different compression functions are applied at 2812 and 2820 which result in different normalizations of the signal at 2826. In other embodiments, a division operation can be applied at 2824 to accomplish normalization when logarithmic compression is not implemented. Such as for example when compression based on the square root function is implemented.

The normalized main signal 2826 is input to a single channel normalized voice threshold comparator (SC-NVTC) 2828, which results in a normalized desired voice activity detection signal 2830. Note that the architecture of the dual channel voice activity detector provides a detection of desired voice using the normalized desired voice activity detection signal 2830 that is based on an overall difference in signal-to-noise ratios for the two input channels. Thus, the normalized desired voice activity detection signal 2830 is based on the integral of the energy in the voice band and not on the energy in particular frequency bins, thereby maintaining linearity within the noise cancellation units described above. The compressed signals 2814 and 2822, utilizing logarithmic compression, provide an input at 2826 (Z) which has a noise floor that can take on values that vary from below zero to above zero (see column 2895*c*, column 2895*d*, or column 2895*e* FIG. 28E below), unlike an uncompressed single channel input which has a noise floor which is always above zero (see column 2895*b* FIG. 28E below).

Figure 28B:
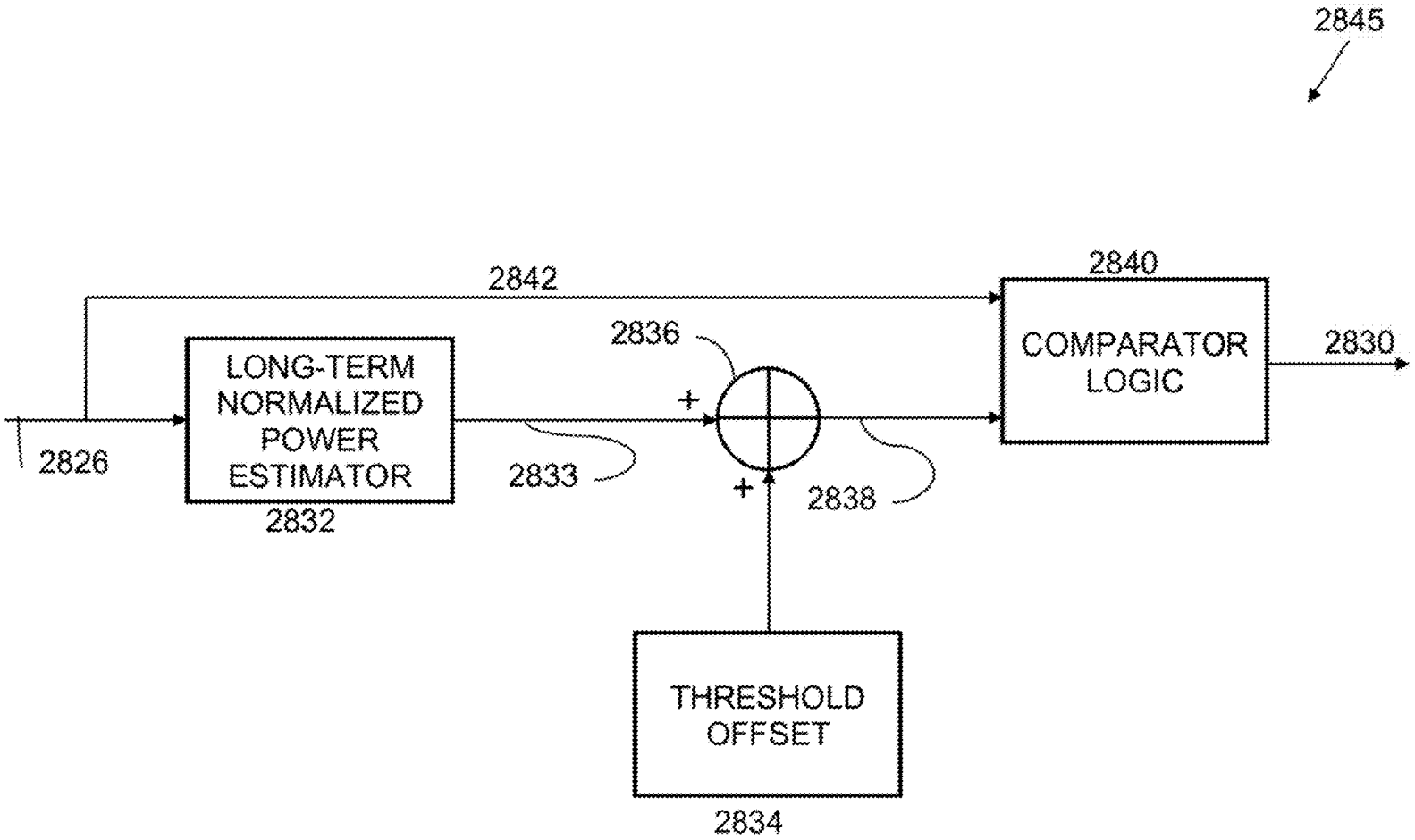
FIG. 28B illustrates a normalized voice threshold comparator according to embodiments of the invention.

FIG. 28B illustrates, generally at 2850, a single channel normalized voice threshold comparator (SC-NVTC) according to embodiments of the invention. With reference to FIG. 28B, a normalized main signal 2826 is input into a long-term normalized power estimator 2832. The long-term normalized power estimator 2832 provides a running estimate of the normalized main signal 2826. The running estimate provides a floor for desired audio. An offset value 2834 is added in an adder 2836 to a running estimate of the output of the long-term normalized power estimator 2832. The output of the adder 2838 is input to comparator 2840. An instantaneous estimate 2842 of the normalized main signal 2826 is input to the comparator 2840. The comparator 2840 contains logic that compares the instantaneous value at 2842 to the running ratio plus offset at 2838. If the value at 2842 is greater than the value at 2838, desired audio is detected and a flag is set accordingly and transmitted as part of the normalized desired voice activity detection signal 2830. If the value at 2842 is less than the value at 2838 desired audio is not detected and a flag is set accordingly and transmitted as part of the normalized desired voice activity detection signal 2830. The long-term normalized power estimator 2832 averages the normalized main signal 2826 for a length of time sufficiently long in order to slow down the change in amplitude fluctuations. Thus, amplitude fluctuations are slowly changing at 2833. The averaging time can vary from a fraction of a second to minutes, by way of non-limiting examples. In various embodiments, an averaging time is selected to provide slowly changing amplitude fluctuations at the output of 2832.

Figure 28C:
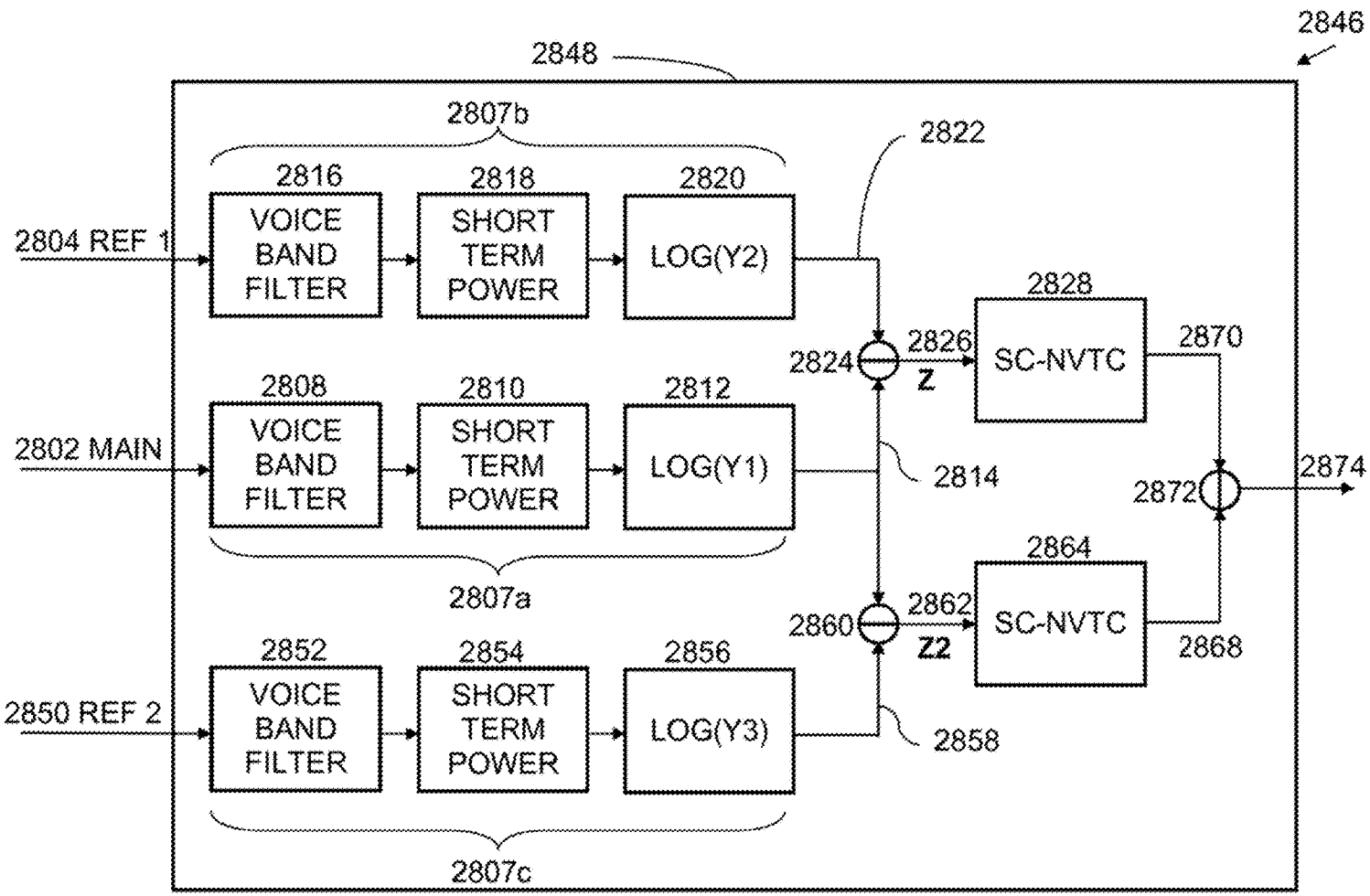
FIG. 28C illustrates desired voice activity detection utilizing multiple reference channels, according to embodiments of the invention.

FIG. 28C illustrates, generally at 2846, desired voice activity detection utilizing multiple reference channels, according to embodiments of the invention. With reference to FIG. 28C, a desired voice detector is shown at 2848. The desired voice detector 2848 includes as an input the main channel 2802 and the first signal path 2807*a* (described above in conjunction with FIG. 28A) together with the reference channel 2804 and the second signal path 2807*b* (also described above in conjunction with FIG. 28A). In addition thereto, is a second reference acoustic channel 2850 which is input into the desired voice detector 2848 and is part of a third signal path 2807*c*. Similar to the second signal path 2807*b* (described above), acoustic signals from the second reference acoustic channel are input at 2850, from for example, a beamformer or from a second reference acoustic channel as described above in conjunction with the previous figures, to a third signal path 2807*c* of the multi-input desired voice detector 2848. The third signal path 2807*c* includes a voice band filter 2852. The voice band filter 2852 captures the majority of the desired voice energy in the second reference acoustic channel 2850. In various embodiments, the voice band filter 2852 is a band-pass filter characterized by a lower corner frequency an upper corner frequency and a roll-off from the upper corner frequency as described above for the second signal path and the voice-band filter 2808.

The third signal path 2807*c* includes a short-term power calculator 2854. Short-term power calculator 2854 is implemented in various embodiments as a root mean square (RMS) measurement, a power detector, an energy detector, etc. Short-term power calculator 2854 can be referred to synonymously as a short-time power calculator 2854. The short-term power detector 2854 calculates approximately the instantaneous power in the filtered signal. The output of the short-term power detector 2854 is input into a signal compressor 2856. In various embodiments compressor 2856 converts the signal to the $Log_2$ domain, $Log_{10}$ domain, etc. In other embodiments, the compressor 2854 performs a user defined compression algorithm on the signal Y3.

The compressed signal from the third signal path 2858 is subtracted from the compressed signal from the first signal path 2814 at a subtractor 2860, which results in a normalized main signal at 2862 (Z2). In other embodiments, different compression functions are applied at 2856 and 2812 which result in different normalizations of the signal at 2862. In other embodiments, a division operation can be applied at 2860 when logarithmic compression is not implemented. Such as for example when compression based on the square root function is implemented.

The normalized main signal 2862 is input to a single channel normalized voice threshold comparator (SC-NVTC) 2864, which results in a normalized desired voice activity detection signal 2868. Note that the architecture of the multi-channel voice activity detector provides a detection of desired voice using the normalized desired voice activity detection signal 2868 that is based on an overall difference in signal-to-noise ratios for the two input channels. Thus, the normalized desired voice activity detection signal 2868 is based on the integral of the energy in the voice band and not on the energy in particular frequency bins, thereby maintaining linearity within the noise cancellation units described above. The compressed signals 2814 and 2858, utilizing logarithmic compression, provide an input at 2862 (Z2) which has a noise floor that can take on values that vary from below zero to above zero (see column 2895*c*, column 2895*d*, or column 2895*e* FIG. 28E below), unlike an uncompressed single channel input which has a noise floor which is always above zero (see column 2895*b* FIG. 28E below).

The desired voice detector 2848, having a multi-channel input with at least two reference channel inputs, provides two normalized desired voice activity detection signals 2868 and 2870 which are used to output a desired voice activity signal 2874. In one embodiment, normalized desired voice activity detection signals 2868 and 2870 are input into a logical OR-gate 2872. The logical OR-gate outputs the desired voice activity signal 2874 based on its inputs 2868 and 2870. In yet other embodiments, additional reference channels can be added to the desired voice detector 2848. Each additional reference channel is used to create another normalized main channel which is input into another single channel normalized voice threshold comparator (SC-NVTC) (not shown). An output from the additional single channel normalized voice threshold comparator (SC-NVTC) (not shown) is combined with 2874 via an additional exclusive OR-gate (also not shown) (in one embodiment) to provide the desired voice activity signal which is output as described above in conjunction with the preceding figures. Utilizing additional reference channels in a multi-channel desired voice detector, as described above, results in a more robust detection of desired audio because more information is obtained on the noise field via the plurality of reference channels.

Figure 28D:
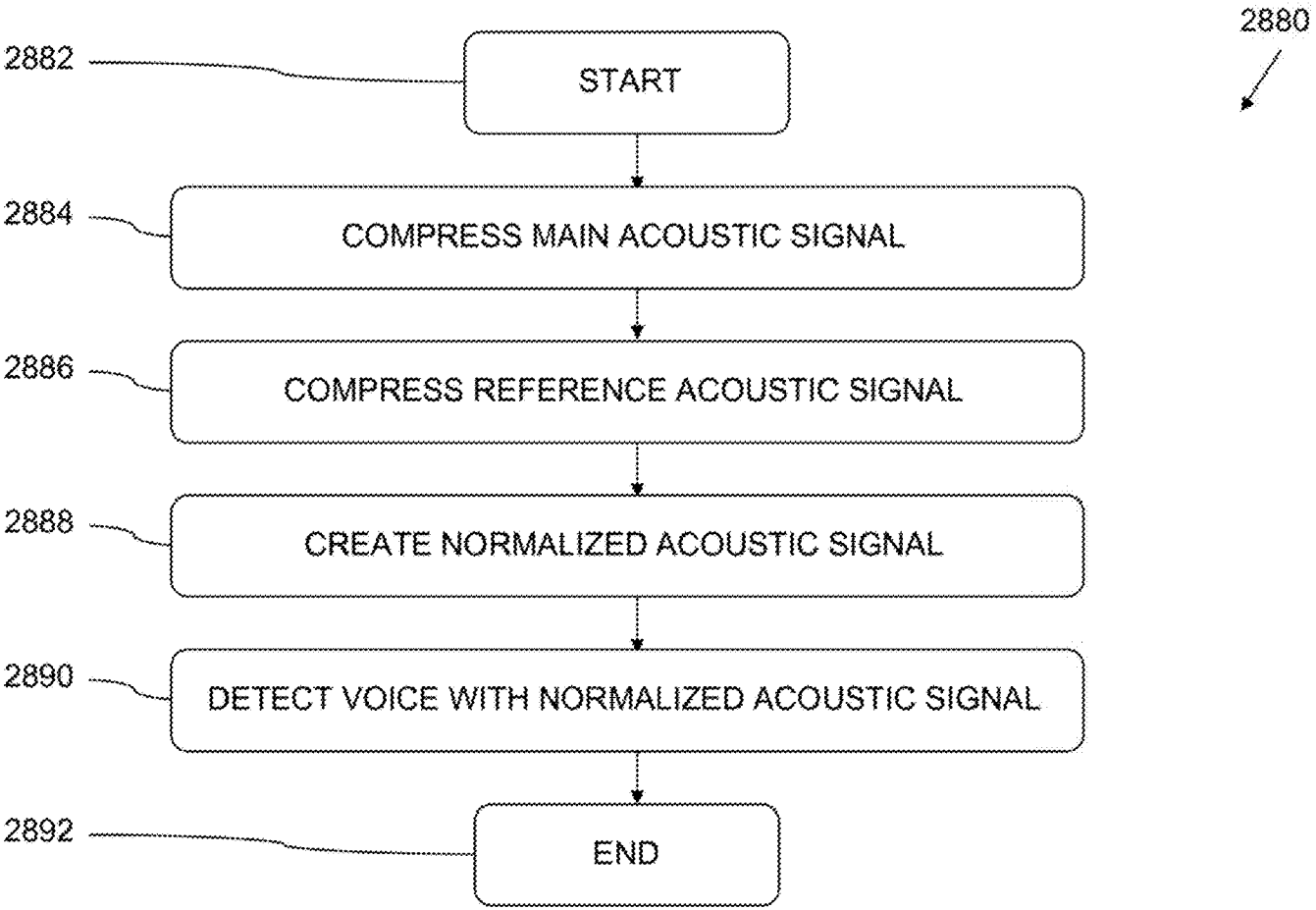
FIG. 28D illustrates a process utilizing compression according to embodiments of the invention.

FIG. 28D illustrates, generally at 2880, a process utilizing compression according to embodiments of the invention. With reference to FIG. 28D, a process starts at a block 2882. At a block 2884 a main acoustic channel is compressed, utilizing for example $Log_{10}$ compression or user defined compression as described in conjunction with FIG. 28A or FIG. 28C. At a block 2886 a reference acoustic signal is compressed, utilizing for example $Log_{10}$ compression or user defined compression as described in conjunction with FIG. 28A or FIG. 28C. At a block 2888 a normalized main acoustic signal is created. At a block 2890 desired voice is detected with the normalized acoustic signal. The process stops at a block 2892.

FIG. 28E illustrates, generally at 2893, different functions to provide compression according to embodiments of the invention. With reference to FIG. 28E, a table 2894 presents several compression functions for the purpose of illustration, no limitation is implied thereby. Column 2895*a* contains six sample values for a variable X. In this example, variable X takes on values as shown at 2896 ranging from 0.01 to 1000.0. Column 2895*b* illustrates no compression where Y=X. Column 2895*c* illustrates Log base 10 compression where the compressed value Y=Log 10(X). Column 2895*d* illustrates 1n(X) compression where the compressed value Y=ln(X). Column 2895*e* illustrates Log base 2 compression where Y=Log 2(X). A user defined compression (not shown) can also be implemented as desired to provide more or less compression than 2895*c*, 2895*d*, or 2895*e*. Utilizing a compression function at 2812 and 2820 (FIG. 28A) to compress the result of the short-term power detectors 2810 and 2818 reduces the dynamic range of the normalized main signal at 2826 (Z) which is input into the single channel normalized voice threshold comparator (SC-NVTC) 2828. Similarly utilizing a compression function at 2812, 2820 and 2856 (FIG. 28C) to compress the results of the short-term power detectors 2810, 2818, and 2854 reduces the dynamic range of the normalized main signals at 2826 (Z) and 2862 (Z2) which are input into the SC-NVTC 828 and SC-NVTC 864 respectively. Reduced dynamic range achieved via compression can result in more accurately detecting the presence of desired audio and therefore a greater degree of noise reduction can be achieved by the embodiments of the invention presented herein.

In various embodiments, the components of the multi-input desired voice detector, such as shown in FIG. 28A, FIG. 28B, FIG. 28C, FIG. 28D, and FIG. 28E are implemented in an integrated circuit device, which may include an integrated circuit package containing the integrated circuit. In some embodiments, the multi-input desired voice detector is implemented in a single integrated circuit die. In other embodiments, the multi-input desired voice detector is implemented in more than one integrated circuit die of an integrated circuit device which may include a multi-chip package containing the integrated circuit.

Figure 29A:
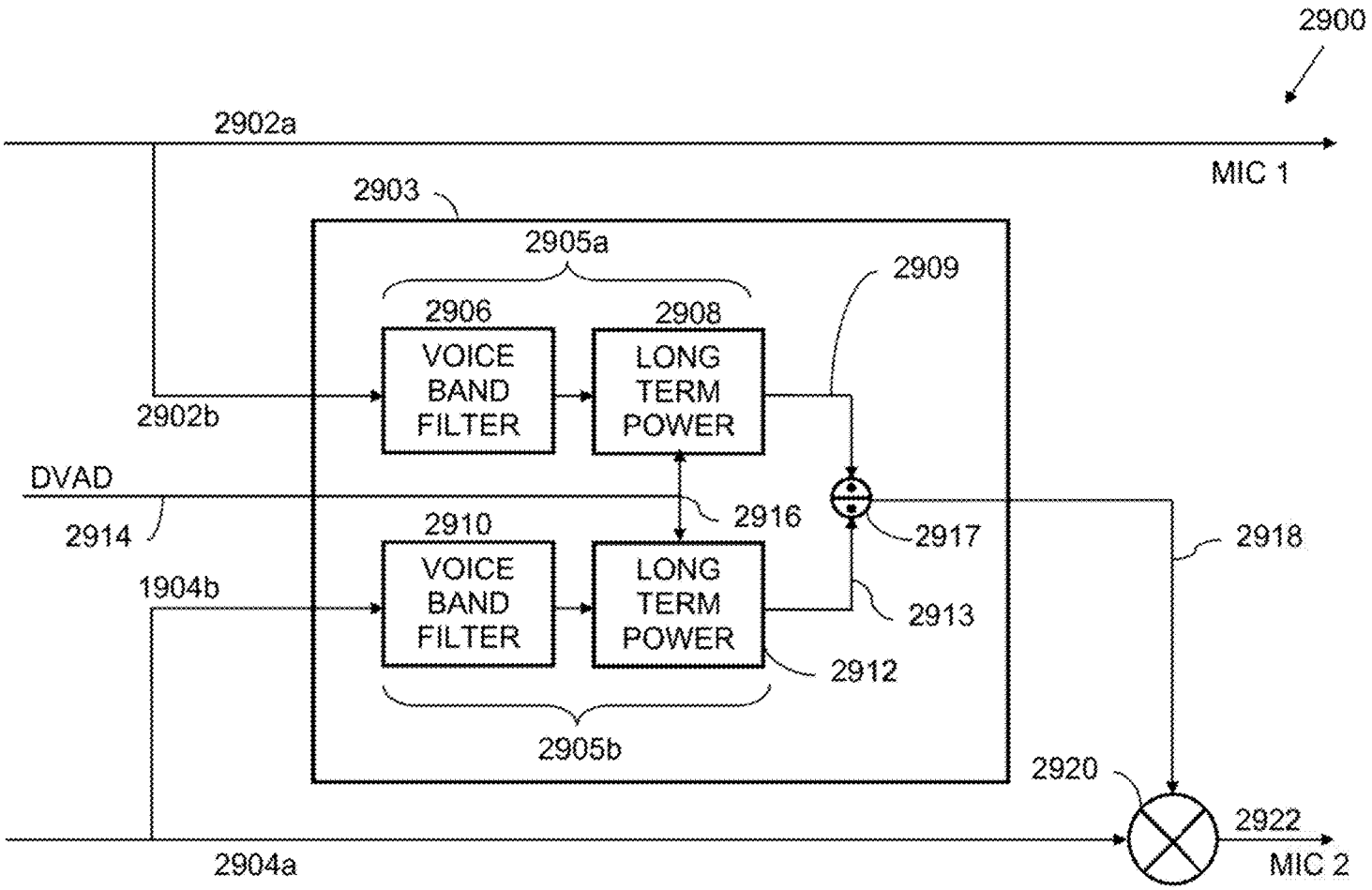
FIG. 29A illustrates an auto-balancing architecture according to embodiments of the invention.

FIG. 29A illustrates, generally at 2900, an auto-balancing architecture according to embodiments of the invention. With reference to FIG. 29A, an auto-balancing component 2903 has a first signal path 2905*a* and a second signal path 2905*b*. A first acoustic channel 2902*a* (MIC 1) is coupled to the first signal path 2905*a* at 2902*b*. A second acoustic channel 2904*a* is coupled to the second signal path 2905*b* at 2904*b*. Acoustic signals are input at 2902*b* into a voice-band filter 2906. The voice band filter 2906 captures the majority of the desired voice energy in the first acoustic channel 2902*a*. In various embodiments, the voice band filter 1906 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The first signal path 2905*a* includes a long-term power calculator 2908. Long-term power calculator 2908 is implemented in various embodiments as a root mean square (RMS) measurement, a power detector, an energy detector, etc. Long-term power calculator 2908 can be referred to synonymously as a long-time power calculator 2908. The long-term power calculator 2908 calculates approximately the running average long-term power in the filtered signal. The output 2909 of the long-term power calculator 2908 is input into a divider 2917. A control signal 2914 is input at 2916 to the long-term power calculator 2908. The control signal 2914 provides signals as described above in conjunction with the desired audio detector, e.g., FIG. 28A, FIG. 28B, FIG. 28C which indicate when desired audio is present and when desired audio is not present. Segments of the acoustic signals on the first channel 2902*b* which have desired audio present are excluded from the long-term power average produced at 2908.

Acoustic signals are input at 2904*b* into a voice-band filter 2910 of the second signal path 2905*b*. The voice band filter 2910 captures the majority of the desired voice energy in the second acoustic channel 2904*a*. In various embodiments, the voice band filter 2910 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The second signal path 2905*b* includes a long-term power calculator 2912. Long-term power calculator 2912 is implemented in various embodiments as a root mean square (RMS) measurement, a power detector, an energy detector, etc. Long-term power calculator 2912 can be referred to synonymously as a long-time power calculator 2912. The long-term power calculator 2912 calculates approximately the running average long-term power in the filtered signal. The output 2913 of the long-term power calculator 2912 is input into a divider 2917. A control signal 2914 is input at 2916 to the long-term power calculator 2912. The control signal 2916 provides signals as described above in conjunction with the desired audio detector, e.g., FIG. 28A, FIG. 28B, FIG. 28C which indicate when desired audio is present and when desired audio is not present. Segments of the acoustic signals on the second channel 2904*b* which have desired audio present are excluded from the long-term power average produced at 2912.

In one embodiment, the output 2909 is normalized at 2917 by the output 2913 to produce an amplitude correction signal 2918. In one embodiment, a divider is used at 2917. The amplitude correction signal 2918 is multiplied at multiplier 2920 times an instantaneous value of the second microphone signal on 2904*a* to produce a corrected second microphone signal at 2922.

In another embodiment, alternatively the output 2913 is normalized at 2917 by the output 2909 to produce an amplitude correction signal 2918. In one embodiment, a divider is used at 2917. The amplitude correction signal 2918 is multiplied by an instantaneous value of the first microphone signal on 1902*a* using a multiplier coupled to 2902*a* (not shown) to produce a corrected first microphone signal for the first microphone channel 2902*a*. Thus, in various embodiments, either the second microphone signal is automatically balanced relative to the first microphone signal or in the alternative the first microphone signal is automatically balanced relative to the second microphone signal.

It should be noted that the long-term averaged power calculated at 2908 and 2912 is performed when desired audio is absent. Therefore, the averaged power represents an average of the undesired audio which typically originates in the far field. In various embodiments, by way of non-limiting example, the duration of the long-term power calculator ranges from approximately a fraction of a second such as, for example, one-half second to five seconds to minutes in some embodiments and is application dependent.

Figure 29B:
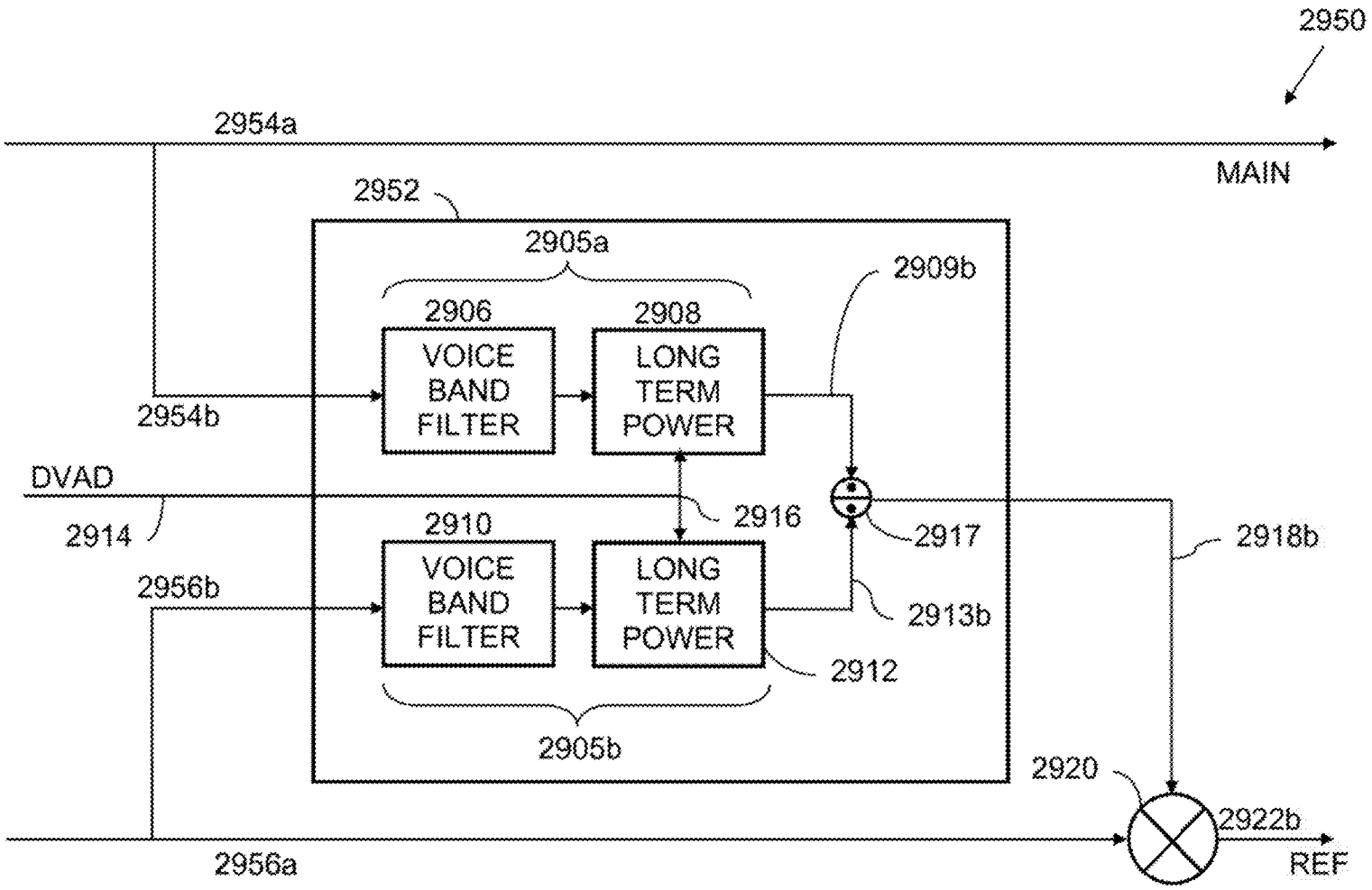
FIG. 29B illustrates auto-balancing according to embodiments of the invention.

FIG. 29B illustrates, generally at 2950, auto-balancing according to embodiments of the invention. With reference to FIG. 29B, an auto-balancing component 2952 is configured to receive as inputs a main acoustic channel 2954*a* and a reference acoustic channel 2956*a*. The balancing function proceeds similarly to the description provided above in conjunction with FIG. 29A using the first acoustic channel 2902*a* (MIC 1) and the second acoustic channel 2904*a* (MIC 2).

With reference to FIG. 29B, an auto-balancing component 2952 has a first signal path 2905*a* and a second signal path 2905*b*. A first acoustic channel 2954*a* (MAIN) is coupled to the first signal path 2905*a* at 2954*b*. A second acoustic channel 2956*a* is coupled to the second signal path 2905*b* at 2956*b*. Acoustic signals are input at 2954*b* into a voice-band filter 2906. The voice band filter 2906 captures the majority of the desired voice energy in the first acoustic channel 2954*a*. In various embodiments, the voice band filter 2906 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The first signal path 2905*a* includes a long-term power calculator 2908. Long-term power calculator 2908 is implemented in various embodiments as a root mean square (RMS) measurement, a power detector, an energy detector, etc. Long-term power calculator 2908 can be referred to synonymously as a long-time power calculator 2908. The long-term power calculator 2908 calculates approximately the running average long-term power in the filtered signal. The output 2909*b* of the long-term power calculator 2908 is input into a divider 2917. A control signal 2914 is input at 2916 to the long-term power calculator 2908. The control signal 2914 provides signals as described above in conjunction with the desired audio detector, e.g., FIG. 28A, FIG. 28B, FIG. 28C which indicate when desired audio is present and when desired audio is not present. Segments of the acoustic signals on the first channel 2954*b* which have desired audio present are excluded from the long-term power average produced at 2908.

Acoustic signals are input at 2956*b* into a voice-band filter 2910 of the second signal path 2905*b*. The voice band filter 2910 captures the majority of the desired voice energy in the second acoustic channel 2956*a*. In various embodiments, the voice band filter 2910 is a band-pass filter characterized by a lower corner frequency an upper corner frequency and a roll-off from the upper corner frequency. In various embodiments, the lower corner frequency can range from 50 to 300 Hz depending on the application. For example, in wide band telephony, a lower corner frequency is approximately 50 Hz. In standard telephony the lower corner frequency is approximately 300 Hz. The upper corner frequency is chosen to allow the filter to pass a majority of the speech energy picked up by a relatively flat portion of the microphone's frequency response. Thus, the upper corner frequency can be placed in a variety of locations depending on the application. A non-limiting example of one location is 2,500 Hz. Another non-limiting location for the upper corner frequency is 4,000 Hz.

The second signal path 2905*b* includes a long-term power calculator 2912. Long-term power calculator 2912 is implemented in various embodiments as a root mean square (RMS) measurement, a power detector, an energy detector, etc. Long-term power calculator 2912 can be referred to synonymously as a long-time power calculator 2912. The long-term power calculator 2912 calculates approximately the running average long-term power in the filtered signal. The output 2913*b* of the long-term power calculator 2912 is input into the divider 2917. A control signal 2914 is input at 2916 to the long-term power calculator 2912. The control signal 2916 provides signals as described above in conjunction with the desired audio detector, e.g., FIG. 28A, FIG. 28, FIG. 28C which indicate when desired audio is present and when desired audio is not present. Segments of the acoustic signals on the second channel 2956*b* which have desired audio present are excluded from the long-term power average produced at 2912.

In one embodiment, the output 2909*b* is normalized at 2917 by the output 2913*b* to produce an amplitude correction signal 2918*b*. In one embodiment, a divider is used at 2917. The amplitude correction signal 2918*b* is multiplied at multiplier 2920 times an instantaneous value of the second microphone signal on 2956*a* to produce a corrected second microphone signal at 2922*b*.

In another embodiment, alternatively the output 2913*b* is normalized at 2917 by the output 2909*b* to produce an amplitude correction signal 2918*b*. In one embodiment, a divider is used at 2917. The amplitude correction signal 2918*b* is multiplied by an instantaneous value of the first microphone signal on 2954*a* using a multiplier coupled to 2954*a* (not shown) to produce a corrected first microphone signal for the first microphone channel 2954*a*. Thus, in various embodiments, either the second microphone signal is automatically balanced relative to the first microphone signal or in the alternative the first microphone signal is automatically balanced relative to the second microphone signal.

It should be noted that the long-term averaged power calculated at 2908 and 2912 is performed when desired audio is absent. Therefore, the averaged power represents an average of the undesired audio which typically originates in the far field. In various embodiments, by way of non-limiting example, the duration of the long-term power calculator ranges from approximately a fraction of a second such as, for example, one-half second to five seconds to minutes in some embodiments and is application dependent.

Embodiments of the auto-balancing component 2902 or 2952 are configured for auto-balancing a plurality of microphone channels such as is indicated in FIG. 24A. In such configurations, a plurality of channels (such as a plurality of reference channels) is balanced with respect to a main channel. Or a plurality of reference channels and a main channel are balanced with respect to a particular reference channel as described above in conjunction with FIG. 29A or FIG. 29B.

Figure 29C:
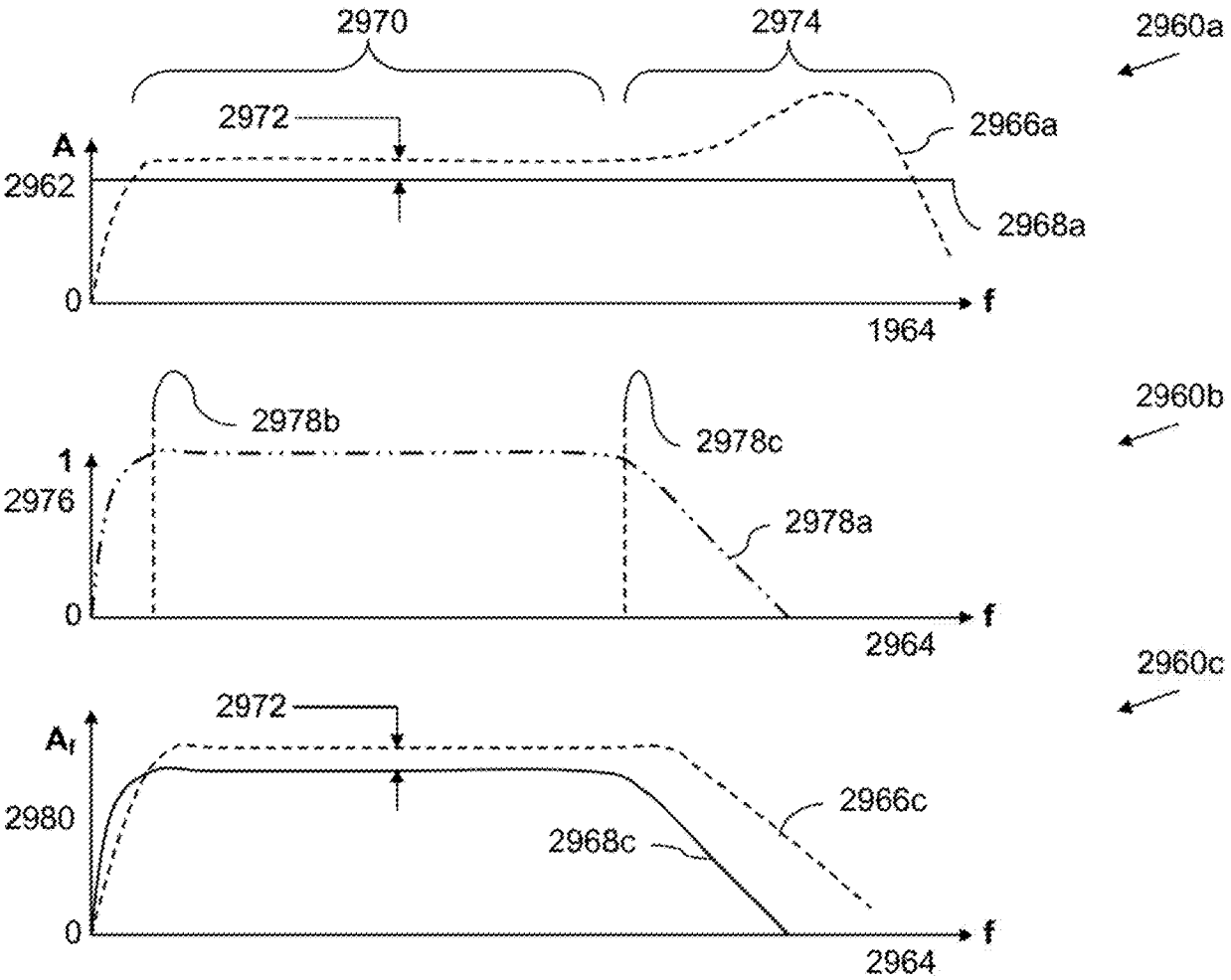
FIG. 29C illustrates filtering according to embodiments of the invention.

FIG. 29C illustrates filtering according to embodiments of the invention. With reference to FIG. 29C, 2960*a* shows two microphone signals 2966*a* and 2968*a* having amplitude 2962 plotted as a function of frequency 2964. In some embodiments, a microphone does not have a constant sensitivity as a function of frequency. For example, microphone response 2966*a* can illustrate a microphone output (response) with a non-flat frequency response excited by a broadband excitation which is flat in frequency. The microphone response 2966*a* includes a non-flat region 2974 and a flat region 2970. For this example, a microphone which produced the response 2968*a* has a uniform sensitivity with respect to frequency; therefore 2968*a* is substantially flat in response to the broadband excitation which is flat with frequency. In some embodiments, it is of interest to balance the flat region 2970 of the microphones' responses. In such a case, the non-flat region 2974 is filtered out so that the energy in the non-flat region 2974 does not influence the microphone auto-balancing procedure. What is of interest is a difference 2972 between the flat regions of the two microphones' responses.

In 2960*b* a filter function 2978*a* is shown plotted with an amplitude 2976 plotted as a function of frequency 2964. In various embodiments, the filter function is chosen to eliminate the non-flat portion 2974 of a microphone's response. Filter function 2978*a* is characterized by a lower corner frequency 2978*b* and an upper corner frequency 2978*c*. The filter function of 2960*b* is applied to the two microphone signals 2966*a* and 2968*a* and the result is shown in 2960*c*.

In 2960*c* filtered representations 2966*c* and 2968*c* of microphone signals 2966*a* and 2968*a* are plotted as a function of amplitude 2980 and frequency 2966. A difference 2972 characterizes the difference in sensitivity between the two filtered microphone signals 2966*c* and 2968*c*. It is this difference between the two microphone responses that is balanced by the systems described above in conjunction with FIG. 29A and FIG. 29B. Referring back to FIG. 29A and FIG. 29B, in various embodiments, voice band filters 2906 and 2910 can apply, in one non-limiting example, the filter function shown in 2960*b* to either microphone channels 2902*b* and 2904*b* (FIG. 29A) or to main and reference channels 2954*b* and 2956*b* (FIG. 29B). The difference 2972 between the two microphone channels is minimized or eliminated by the auto-balancing procedure described above in FIG. 29A or FIG. 29B.

Figure 30:
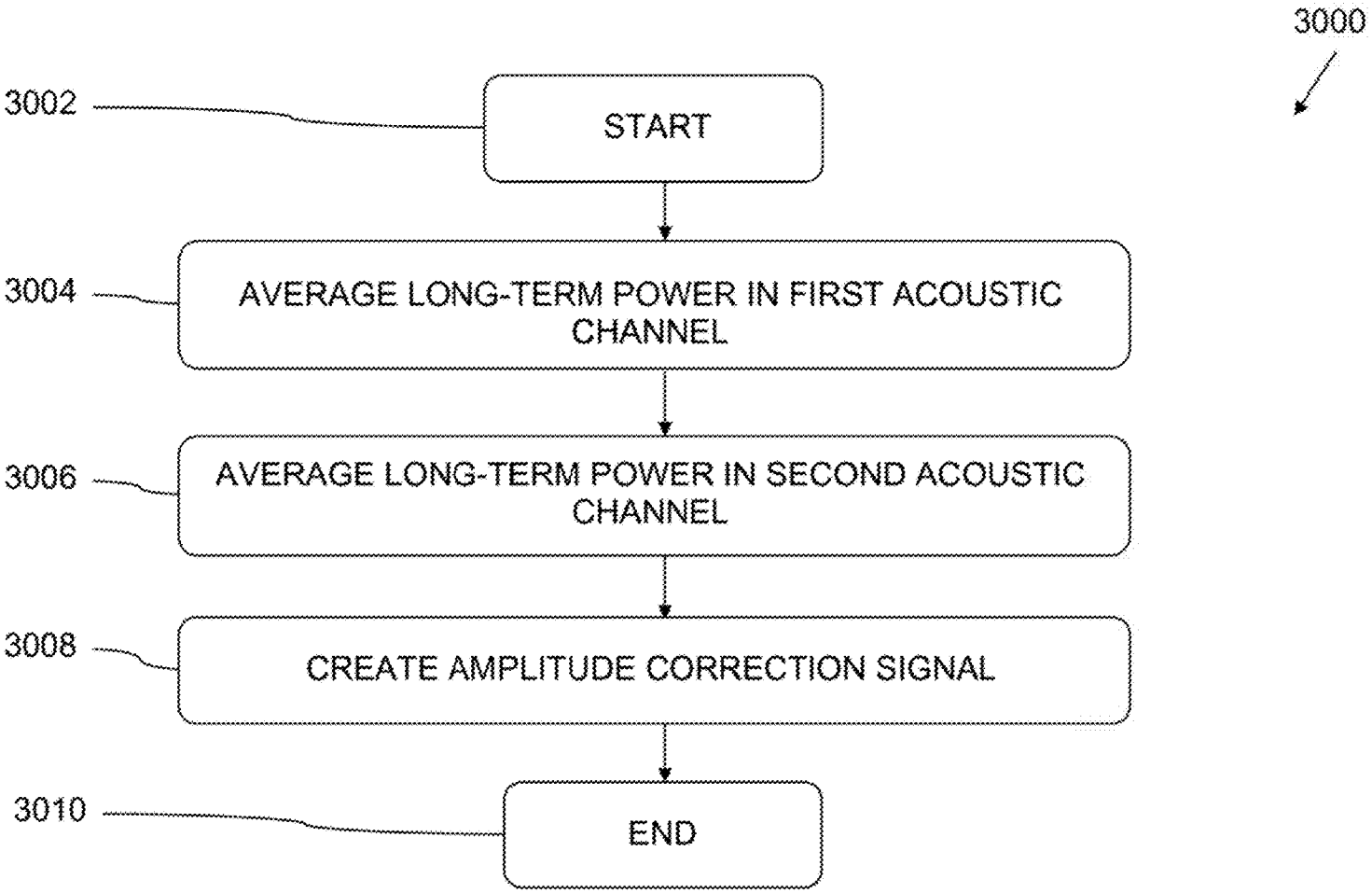
FIG. 30 illustrates a process for auto-balancing according to embodiments of the invention.

FIG. 30 illustrates, generally at 3000, a process for auto-balancing according to embodiments of the invention. With reference to FIG. 30, a process starts at a block 3002. At a block 3004 an average long-term power in a first microphone channel is calculated. The averaged long-term power calculated for the first microphone channel does not include segments of the microphone signal that occurred when desired audio was present. Input from a desired voice activity detector is used to exclude the relevant portions of desired audio. At a block 3006 an average power in a second microphone channel is calculated. The averaged long-term power calculated for the second microphone channel does not include segments of the microphone signal that occurred when desired audio was present. Input from a desired voice activity detector is used to exclude the relevant portions of desired audio. At a block 3008 an amplitude correction signal is computed using the averages computed in the block 3004 and the block 3006.

In various embodiments, the components of auto-balancing component 2903 or 2952 are implemented in an integrated circuit device, which may include an integrated circuit package containing the integrated circuit. In some embodiments, auto-balancing components 2903 or 2952 are implemented in a single integrated circuit die. In other embodiments, auto-balancing components 2903 or 2952 are implemented in more than one integrated circuit die of an integrated circuit device which may include a multi-chip package containing the integrated circuit.

Figure 31:
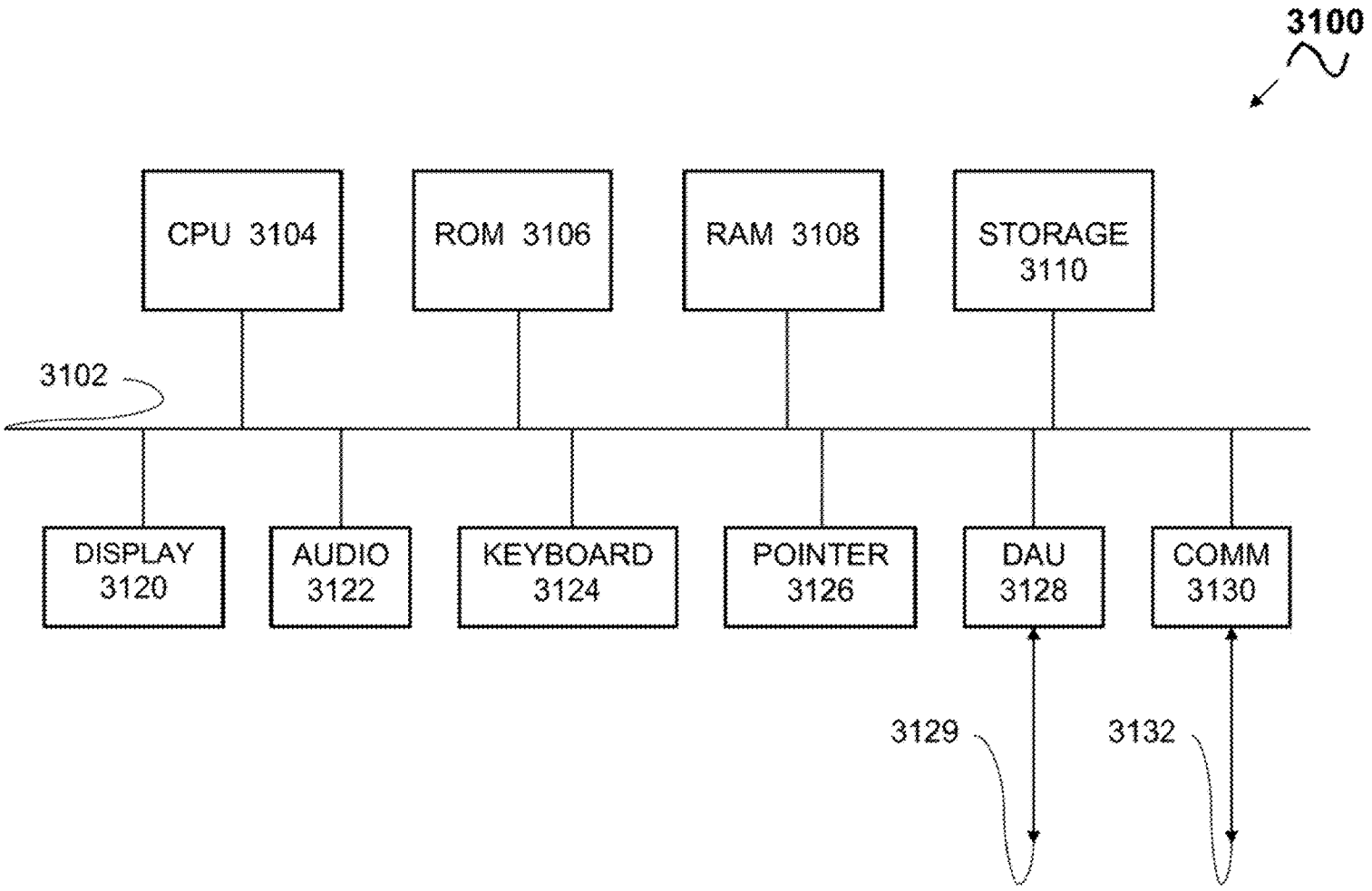
FIG. 31 illustrates an acoustic signal processing system according to embodiments of the invention.

FIG. 31 illustrates, generally at 3100, an acoustic signal processing system in which embodiments of the invention may be used. The block diagram is a high-level conceptual representation and may be implemented in a variety of ways and by various architectures. With reference to FIG. 31, bus system 3102 interconnects a Central Processing Unit (CPU) 3104, Read Only Memory (ROM) 3106, Random Access Memory (RAM) 3108, storage 3110, display 3120, audio 3122, keyboard 3124, pointer 3126, data acquisition unit (DAU) 3128, and communications 3130. The bus system 3102 may be for example, one or more of such buses as a system bus, Peripheral Component Interconnect (PC), Advanced Graphics Port (AGP), Small Computer System Interface (SCSI), Institute of Electrical and Electronics Engineers (IEEE) standard number 1394 (FireWire), Universal Serial Bus (USB), or a dedicated bus designed for a custom application, etc. The CPU 3104 may be a single, multiple, or even a distributed computing resource or a digital signal processing (DSP) chip. Storage 3110 may be Compact Disc (CD), Digital Versatile Disk (DVD), hard disks (HD), optical disks, tape, flash, memory sticks, video recorders, etc. The acoustic signal processing system 3100 can be used to receive acoustic signals that are input from a plurality of microphones (e.g., a first microphone, a second microphone, etc.) or from a main acoustic channel and a plurality of reference acoustic channels as described above in conjunction with the preceding figures. Note that depending upon the actual implementation of the acoustic signal processing system, the acoustic signal processing system may include some, all, more, or a rearrangement of components in the block diagram. In some embodiments, aspects of the system 3100 are performed in software. While in some embodiments, aspects of the system 3100 are performed in dedicated hardware such as a digital signal processing (DSP) chip, etc. as well as combinations of dedicated hardware and software as is known and appreciated by those of ordinary skill in the art.

Thus, in various embodiments, acoustic signal data is received at 3129 for processing by the acoustic signal processing system 3100. Such data can be transmitted at 3132 via communications interface 3130 for further processing in a remote location. Connection with a network, such as an intranet or the Internet is obtained via 3132, as is recognized by those of skill in the art, which enables the acoustic signal processing system 3100 to communicate with other data processing devices or systems in remote locations.

For example, embodiments of the invention can be implemented on a computer system 3100 configured as a desktop computer or work station, on for example a WINDOWS® compatible computer running operating systems such as WINDOWS® XP Home or WINDOWS® XP Professional, Linux, Unix, etc. as well as computers from APPLE COMPUTER, Inc. running operating systems such as OS X, etc. Alternatively, or in conjunction with such an implementation, embodiments of the invention can be configured with devices such as speakers, earphones, video monitors, etc. configured for use with a BLUETOOTH® communication channel. In yet other implementations, embodiments of the invention are configured to be implemented by mobile devices such as a smart phone, a tablet computer, a wearable device, such as eye glasses, a near-to-eye (NTE) headset, a head wearable device of general configuration such as but not limited to glasses, goggles, a visor, a head band, a helmet, etc. or the like.

For purposes of discussing and understanding the embodiments of the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

Some portions of the description may be presented in terms of algorithms and symbolic representations of operations on, for example, data bits within a computer memory. These algorithmic descriptions and representations are the means used by those of ordinary skill in the data processing arts to most effectively convey the substance of their work to others of ordinary skill in the art. An algorithm is here, and generally, conceived to be a self-consistent sequence of acts leading to a desired result. The acts are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, waveforms, data, time series or the like.

It should be borne in mind, however, that all of these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

An apparatus for performing the operations herein can implement the present invention. This apparatus may be specially constructed for the required purposes, or it may comprise a general-purpose computer, selectively activated or reconfigured by a computer program stored in the computer. Such a computer program may be stored in a computer readable storage medium, such as, but not limited to, any type of disk including floppy disks, hard disks, optical disks, compact disk read-only memories (CD-ROMs), and magnetic-optical disks, read-only memories (ROMs), random access memories (RAMs), electrically programmable read-only memories (EPROM)s, electrically erasable programmable read-only memories (EEPROMs), FLASH memories, magnetic or optical cards, etc., or any type of media suitable for storing electronic instructions either local to the computer or remote to the computer.

The algorithms and displays presented herein are not inherently related to any particular computer or other apparatus. Various general-purpose systems may be used with programs in accordance with the teachings herein, or it may prove convenient to construct more specialized apparatus to perform the required method. For example, any of the methods according to the present invention can be implemented in hard-wired circuitry, by programming a general-purpose processor, or by any combination of hardware and software. One of ordinary skill in the art will immediately appreciate that the invention can be practiced with computer system configurations other than those described, including hand-held devices, multiprocessor systems, microprocessor-based or programmable consumer electronics, digital signal processing (DSP) devices, network PCs, minicomputers, mainframe computers, and the like. The invention can also be practiced in distributed computing environments where tasks are performed by remote processing devices that are linked through a communications network. In other examples, embodiments of the invention as described above in FIG. 1 through FIG. 31 can be implemented using a system on a chip (SOC), a BLUETOOTH® chip, a digital signal processing (DSP) chip, a codec with integrated circuits (ICs) or in other implementations of hardware and software.

The methods of the invention may be implemented using computer software. If written in a programming language conforming to a recognized standard, sequences of instructions designed to implement the methods can be compiled for execution on a variety of hardware platforms and for interface to a variety of operating systems. In addition, the present invention is not described with reference to any particular programming language. It will be appreciated that a variety of programming languages may be used to implement the teachings of the invention as described herein. Furthermore, it is common in the art to speak of software, in one form or another (e.g., program, procedure, application, driver, . . . ), as taking an action or causing a result. Such expressions are merely a shorthand way of saying that execution of the software by a computer causes the processor of the computer to perform an action or produce a result.

It is to be understood that various terms and techniques are used by those knowledgeable in the art to describe communications, protocols, applications, implementations, mechanisms, etc. One such technique is the description of an implementation of a technique in terms of an algorithm or mathematical expression. That is, while the technique may be, for example, implemented as executing code on a computer, the expression of that technique may be more aptly and succinctly conveyed and communicated as a formula, algorithm, mathematical expression, flow diagram or flow chart. Thus, one of ordinary skill in the art would recognize a block denoting A+B=C as an additive function whose implementation in hardware and/or software would take two inputs (A and B) and produce a summation output (C). Thus, the use of formula, algorithm, or mathematical expression as descriptions is to be understood as having a physical embodiment in at least hardware and/or software (such as a computer system in which the techniques of the present invention may be practiced as well as implemented as an embodiment).

Non-transitory machine-readable media is understood to include any mechanism for storing information in a form readable by a machine (e.g., a computer). For example, a machine-readable medium, synonymously referred to as a computer-readable medium, includes read only memory (ROM); random access memory (RAM); magnetic disk storage media; optical storage media; flash memory devices; except electrical, optical, acoustical or other forms of transmitting information via propagated signals (e.g., carrier waves, infrared signals, digital signals, etc.); etc.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

Thus, embodiments of the invention can be used to reduce or eliminate undesired audio from acoustic systems that process and deliver desired audio. Some non-limiting examples of systems are, but are not limited to, use in short boom headsets, such as an audio headset for telephony suitable for enterprise call centers, industrial and general mobile usage, an in-line "ear buds" headset with an input line (wire, cable, or other connector), mounted on or within the frame of eyeglasses, a near-to-eye (NTE) headset display or headset computing device, a long boom headset for very noisy environments such as industrial, military, and aviation applications as well as a gooseneck desktop-style microphone which can be used to provide theater or symphony-hall type quality acoustics without the structural costs. Other embodiments of the invention are readily implemented in a head wearable device of general configuration such as but not limited to glasses, goggles, a visor, a head band, a helmet, etc. or the like.

While the invention has been described in terms of several embodiments, those of skill in the art will recognize that the invention is not limited to the embodiments described, but can be practiced with modification and alteration within the spirit and scope of the appended claims. The description is thus to be regarded as illustrative instead of limiting.

What is claimed is:

1. An apparatus to be worn on a user's head, comprising:

a head wearable device, the head wearable device is configured to be worn on the user's head;

a first microphone, the first microphone is coupled to the head wearable device, and is positioned on the head wearable device to receive a voice signal from the user when the head wearable device is on the user's head, a first signal from the first microphone is to be input as a main channel to a two-stage noise cancellation unit; and a second microphone, the second microphone is coupled to the head wearable device, a first acoustic distance between the first microphone and the user's mouth is less than a second acoustic distance between the second microphone and the user's mouth when the head wearable device is on the user's head, a second signal from the second microphone is to be input as a reference channel to the two-stage noise cancellation unit, wherein a first signal-to-noise ratio of the first signal from the first microphone is larger than a second signal-to-noise ratio of the second signal from the second microphone, and the two-stage noise cancellation unit is configured to reduce noise from any arrival angle of desired audio, where the arrival angle is relative to an axis passing through the first microphone and the second microphone.

2. The apparatus of claim 1, further comprising:

a wireless communication system, the wireless communication system is coupled to the head wearable device and is electrically coupled to the first microphone and to the second microphone.

3. The apparatus of claim 2, wherein the wireless communication system is compatible with a BLUETOOTH® communication protocol.

4. The apparatus of claim 1, further comprising:

an adaptive noise cancellation unit, the adaptive noise cancellation unit to receive the first signal from the first microphone and the second signal from the second microphone, the adaptive noise cancellation unit reduces undesired audio from the main channel;

a single channel noise cancellation unit, an output signal from the adaptive noise cancellation unit is input to the single channel noise cancellation unit, the single channel noise cancellation unit reduces undesired audio from the output signal to provide mostly desired audio; and a filter control, the filter control to create a control signal from a normalized main signal, the apparatus normalizes the first signal by the second signal to create the normalized main signal, the control signal is electrically coupled to the adaptive noise cancellation unit and the single channel noise cancellation unit to control filtering in the adaptive noise cancellation unit and to control filtering in the single channel noise cancellation unit.

5. The apparatus of claim 4, further comprising:

a beamformer, the beamformer is configured to receive the first signal from the first microphone and the second signal from the second microphone and to provide a main signal on the main channel and at least one reference signal on at least one reference channel to the adaptive noise cancellation unit and to the filter control.

6. The apparatus of claim 4, wherein the head wearable device is selected from the group consisting of eye glasses, goggles, a visor, a helmet, and a user defined head wearable device.

7. The apparatus of claim 4, wherein at least one of the adaptive noise cancellation unit, the single channel noise cancellation unit, and the filter control are part of an integrated circuit and the integrated circuit is coupled to the head wearable device.

8. The apparatus of claim 4, wherein the adaptive noise cancellation unit, the single channel noise cancellation unit, and the filter control are part of an integrated circuit and the integrated circuit is coupled to the head wearable device.

9. The apparatus of claim 1, wherein the first microphone and the second microphone have substantially omni-directional response patterns.

10. The apparatus of claim 9, wherein a first location for the first microphone and a second location for the second microphone provide a signal-to-noise ratio difference.

11. The apparatus of claim 10, wherein the signal-to-noise ratio difference is established during design of the apparatus from a value of a curve selected from the group consisting of FIG. 3C, FIG. 4C, FIG. 5C, and a user defined curve.

12. The apparatus of claim 1, wherein the first microphone has a first response pattern and a first response pattern main sensitivity axis and the second microphone has a second response pattern and a second response pattern main sensitivity axis, the second response pattern is different from the first response pattern and the second response pattern main sensitivity axis is misaligned with a direction of desired audio, wherein a signal-to-noise ratio difference between the first microphone and the second microphone is enhanced by the misalignment.

13. The apparatus of claim 12, wherein the first response pattern is selected from the group consisting of omni-directional, cardioid, bidirectional, super cardioid, hyper cardioid, and user defined, and the second response pattern is selected from the group consisting of omni-directional, cardioid, bidirectional, super cardioid, hyper cardioid, and user defined.

14. The apparatus of claim 12, further comprising:

an adaptive noise cancellation unit, the adaptive noise cancellation unit to receive the first signal from the first microphone and the second signal from the second microphone, the adaptive noise cancellation unit to reduce undesired audio from the main channel;

a single channel noise cancellation unit, an output signal from the adaptive noise cancellation unit is input to the single channel noise cancellation unit, the single channel noise cancellation unit reduces undesired audio from the output signal to provide mostly desired audio; and a filter control, the filter control to create a control signal from a normalized main signal, the apparatus normalizes the first signal by the second signal to create the normalized main signal, the control signal is electrically coupled to the adaptive noise cancellation unit and the single channel noise cancellation unit to control filtering in the adaptive noise cancellation unit and to control filtering in the single channel noise cancellation unit.

15. The apparatus of claim 12, wherein the second microphone is positioned on the head wearable device at substantially any location.

16. The apparatus of claim 15, wherein the first microphone and the second microphone are substantially co-located.

17. The apparatus of claim 1, further comprising:

a beamformer, the beamformer is configured to receive the first signal and the second signal and to output a main signal on a main channel and at least one reference signal on at least one reference channel.

18. The apparatus of claim 17, further comprising:

a third microphone, the third microphone is input into the beamformer, the beamformer configured to output a main signal and two reference signals.

19. An apparatus to be worn on a user's head, comprising:

a head wearable device, the head wearable device is configured to be worn on the user's head;

a first microphone, the first microphone has a first response pattern and the first response pattern has a first major response axis, the first microphone is coupled to the head wearable device, the first microphone is positioned on the head wearable device to receive a voice signal from the user;

a second microphone, the second microphone is coupled to the head wearable device, the second microphone and the first microphone are separated by a distance on the head wearable device such that a first acoustic distance between the first microphone and the user's mouth is less than a second acoustic distance between the second microphone and the user's mouth when the head wearable device is on the user's head;

a beamformer, the beamformer is configured to receive input signals from at least the first microphone and the second microphone and to provide a main signal on a main channel and at least one reference signal on at least one reference channel;

an adaptive noise cancellation unit, the adaptive noise cancellation unit is coupled to receive the main signal and the at least one reference signal from the beamformer, the adaptive noise cancellation unit to reduce a first amount of undesired audio from the main signal to form a filtered output signal;

a filter control, the filter control is coupled to the beamformer, the filter control to create a control signal from the main signal and the at least one reference signal to control reduction of undesired audio; and a single channel noise reduction unit, the single channel noise reduction unit is coupled to receive the filtered output signal and is coupled to the filter control, the single channel noise reduction unit reduces a second amount of undesired audio from the filtered output signal to provide mostly desired audio in the main signal.

20. The apparatus of claim 19, wherein a first location for the first microphone and a second location for the second microphone provide a signal-to-noise ratio difference between the first microphone and second microphone.

21. The apparatus of claim 20, wherein the signal-to-noise ratio difference is established during design of the apparatus from a value of a curve selected from the group consisting of FIG. 3C, FIG. 4C, FIG. 5C, and a user defined curve.

22. An apparatus to be worn on a users head, comprising:

a head wearable device, the head wearable device having a first microphone and a second microphone;

a data processing system, the data processing system is configured to process acoustic signals, wherein the acoustic signals from the first microphone and the second microphone, are input to the data processing system and the data processing system is contained within the head wearable device; and a computer readable medium containing executable computer program instructions, which when executed by the data processing system, cause the data processing system to perform a method comprising:

receiving a main signal and a reference signal;

producing a filter control signal from the main signal and the reference signal, wherein the apparatus normalizes the main signal by the reference signal during the producing;

applying a first stage of filtering with the main signal and the reference signal input to a multi-channel filter to reduce a first amount of undesired audio from the main signal, wherein the filter control signal is provided to the first stage of filtering and is used by the first stage of filtering to separate desired audio from undesired audio during the applying; and applying a second stage of filtering to an output of the first stage to further reduce undesired audio from the main signal, the filter control signal is provided to the second stage of filtering and is used by the second stage of filtering to separate desired audio from undesired audio in the second stage, the second stage outputs a main signal which is mostly desired audio.

23. The apparatus of claim 22, wherein in the method performed by the data processing system, the applying the first stage further comprising:

controlling adaptation of the multi-channel filter with the filter control signal, wherein the filter control signal utilizes a combination of the main signal and the reference signal.

24. The apparatus of claim 22, wherein in the method performed by the data processing system, the method further comprising:

beamforming with signals from a number of microphone channels to create the main signal and the reference signal.

25. The apparatus of claim 24, wherein the first microphone is positioned on the head wearable device to receive a voice signal from the user and the second microphone is positioned on the head wearable device at substantially any location.

26. The apparatus of claim 24, wherein the second microphone and the first microphone are separated by a distance on the head wearable device such that a first acoustic distance between the first microphone and the users mouth is less than a second acoustic distance between the second microphone and the user's mouth.

27. The apparatus of claim 22, wherein a second microphone has a second response pattern and a second response pattern main sensitivity axis, a first microphone has a first response pattern and a first response pattern main sensitivity axis and the second response pattern is different from the first response pattern and the second response pattern main sensitivity axis is misaligned with a direction of desired audio, wherein a signal-to-noise ratio difference between the first microphone and the second microphone is enhanced by the misalignment.

28. The apparatus of claim 27, wherein the first response pattern is omni-directional and the second response pattern is cardioid.

29. The apparatus of claim 27, wherein the first response pattern is selected from the group consisting of omni-directional, cardioid, bidirectional, super cardioid, hyper cardioid, and user defined, and the second response pattern is selected from the group consisting of omni-directional, cardioid, bidirectional, super cardioid, hyper cardioid, and user defined.

30. A method, comprising:

locating a main microphone channel at a first location on a head wearable device, the main microphone channel has a first signal-to-noise ratio when the head wearable device is worn on a user's head and desired audio is received on the main microphone channel and the desired audio originated from the users mouth;

locating a reference microphone channel at a second location on the head wearable device, the reference microphone channel has a second signal-to-noise ratio when desired audio is received on the reference microphone channel and the desired audio received on the reference microphone channel originated from the user's mouth; and providing a signal-to-noise ratio difference between the main microphone channel and the reference microphone channel to a first stage of a two-stage linear noise cancellation system when acoustic signals are received by the main microphone channel and the reference microphone channel, wherein the two-stage linear noise cancellation system is coupled to the head wearable device.

31. The method of claim 30, further comprising:

using a normalized main microphone channel signal to control the noise cancellation system, wherein the normalized main microphone channel signal is obtained by normalizing the main microphone channel signal by the reference microphone channel signal.

32. The method of claim 30, wherein at least one of a main microphone and a reference microphone has a directivity pattern different from omni-directional.

33. The method of claim 30, further comprising:

beamforming to provide the main microphone channel and the reference microphone channel, wherein the beamforming contributes to a signal-to-noise ratio difference between the main microphone channel and the reference microphone channel.

34. The method of claim 30, wherein the main microphone channel and the reference microphone channel are substantially co-located.

35. An apparatus to be worn on a user's head, comprising:

a head wearable device, the head wearable device is configured to be worn on the user's head;

a first microphone, the first microphone is coupled to the head wearable device, and is positioned on the head wearable device to receive a voice signal from the user when the head wearable device is on the user's head, a first signal from the first microphone is to be input as a main channel to a noise cancellation unit;

a second microphone, the second microphone is coupled to the head wearable device, a first acoustic distance between the first microphone and the user's mouth is less than a second acoustic distance between the second microphone and the user's mouth when the head wearable device is on the user's head, a second signal from the second microphone is to be input as a reference channel to the noise cancellation unit, wherein a first signal-to-noise ratio of the first signal from the first microphone is larger than a second signal-to-noise ratio of the second signal from the second microphone;

an adaptive noise cancellation unit, the adaptive noise cancellation unit to receive the first signal from the first microphone and the second signal from the second microphone, the adaptive noise cancellation unit reduces undesired audio from the main channel;

a single channel noise cancellation unit, an output signal from the adaptive noise cancellation unit is input to the single channel noise cancellation unit, the single channel noise cancellation unit reduces undesired audio from the output signal to provide mostly desired audio; and a filter control, the filter control to create a control signal from a normalized main signal, the apparatus normalizes the first signal by the second signal to create the normalized main signal, the control signal is electrically coupled to the adaptive noise cancellation unit and the single channel noise cancellation unit to control filtering in the adaptive noise cancellation unit and to control filtering in the single channel noise cancellation unit.

36. The apparatus of claim 35, further comprising:

a beamformer, the beamformer is configured to receive the first signal from the first microphone and the second signal from the second microphone and to provide a main signal on the main channel and at least one reference signal on at least one reference channel to the adaptive noise cancellation unit and to the filter control.

37. The apparatus of claim 35, wherein the head wearable device is selected from the group consisting of eye glasses, goggles, a visor, a helmet, and a user defined head wearable device.

38. The apparatus of claim 35, wherein at least one of the adaptive noise cancellation unit, the single channel noise cancellation unit, and the filter control are part of an integrated circuit and the integrated circuit is coupled to the head wearable device.

39. The apparatus of claim 35, wherein the adaptive noise cancellation unit, the single channel noise cancellation unit, and the filter control are part of an integrated circuit and the integrated circuit is coupled to the head wearable device.

40. A method, comprising:

locating a main microphone channel at a first location on a head wearable device, the main Microphone channel has a first signal-to-noise ratio when the head wearable device is worn on a user's head and desired audio is received on the main microphone channel and the desired audio originated from the user's mouth;

locating a reference microphone channel at a second location on the head wearable device, the reference microphone channel has a second signal-to-noise ratio when desired audio is received on the reference microphone channel and the desired audio received on the reference microphone channel originated from the user's mouth;

providing a signal-to-noise ratio difference between the main microphone channel and the reference microphone channel to a first stage of a two-stage noise cancellation system when acoustic signals are received by the main microphone channel and the reference microphone channel, wherein the noise cancellation system is coupled to the head wearable device; and using a normalized main microphone channel signal to control the noise cancellation system, wherein the normalized main microphone channel signal is obtained by normalizing the main microphone channel signal by the reference microphone channel signal.

41. An apparatus to be worn on a user's head, comprising:

a head wearable device, the head wearable device is configured to be worn on the users head;

a first microphone, the first microphone is coupled to the head wearable device, and is positioned on the head wearable device to receive a voice signal from the user when the head wearable device is on the user's head, a first signal from the first microphone is to be input as a main channel to a two-stage noise cancellation unit; and a second microphone, the second microphone is coupled to the head wearable device, a first acoustic distance between the first microphone and the user's mouth is substantially equivalent to a second acoustic distance between the second microphone and the user's mouth when the head wearable device is on the user's head, a first response pattern of the first microphone is different from a second response pattern of the second microphone, a second signal from the second microphone is to be input as a reference channel to the two-stage noise cancellation unit, wherein a first signal-to-noise ratio of the first signal from the first microphone is larger than a second signal-to-noise ratio of the second signal from the second microphone, and the two-stage noise cancellation unit is configured to reduce noise from any arrival angle of desired audio, where the arrival angle is relative to an axis passing through the first microphone and the second microphone.

42. The apparatus of claim 41, wherein the first response pattern is omni-directional and the second response pattern is cardioid.

* * * * *